US007231969B2

(12) United States Patent
Folk et al.

(10) Patent No.: US 7,231,969 B2
(45) Date of Patent: Jun. 19, 2007

(54) WELLBORE TOP DRIVE POWER SYSTEMS AND METHODS OF USE

(75) Inventors: Robert Alden Folk, Calgary (CA); Steven Lorne Folk, Sherwood Park (CA)

(73) Assignee: Varco I/P, Inc., Houston, TX (US)

( * ) Notice: Subject to any disclaimer, the term of this patent is extended or adjusted under 35 U.S.C. 154(b) by 429 days.

(21) Appl. No.: 10/877,949

(22) Filed: Jun. 24, 2004

(65) Prior Publication Data

US 2005/0269072 A1 Dec. 8, 2005

Related U.S. Application Data

(62) Division of application No. 10/862,787, filed on Jun. 7, 2004.

(51) Int. Cl.
*E21B 3/02* (2006.01)
*E21B 19/00* (2006.01)

(52) U.S. Cl. ..... 166/77.51; 166/78.1; 175/162; 175/220

(58) Field of Classification Search ..... 166/77.51, 166/78.1; 175/162, 220
See application file for complete search history.

(56) References Cited

U.S. PATENT DOCUMENTS

| | | | | |
|---|---|---|---|---|
| 1,377,575 A | | 5/1921 | Greve | |
| 2,589,119 A | | 3/1952 | O'Leary | |
| 3,766,991 A | * | 10/1973 | Brown | 173/20 |
| 4,010,600 A | | 3/1977 | Poole et al. | 57/129 |
| 4,115,911 A | | 9/1978 | Poole et al. | 29/402.12 |
| 4,205,423 A | | 6/1980 | Poole et al. | 29/402.11 |
| 4,421,179 A | | 12/1983 | Boyadjieff | 173/44 |
| 4,449,596 A | | 5/1984 | Boyadjieff | 175/85 |
| 4,458,768 A | | 7/1984 | Boyadjieff | 175/85 |
| 4,529,045 A | | 7/1985 | Boyadjieff et al. | 173/164 |

(Continued)

FOREIGN PATENT DOCUMENTS

GB 185465 9/1922

OTHER PUBLICATIONS

PCT/GB2005/050085: Invitation To Pay Additional Fees: 5pp.: mailed Aug. 26, 2005.

(Continued)

*Primary Examiner*—Jennifer H. Gay
*Assistant Examiner*—Shane Bomar
(74) *Attorney, Agent, or Firm*—Guy McClung

(57) ABSTRACT

A top drive system having a drive motor, a gear system coupled to the drive motor, a drive quill coupled to the gear system, a top drive support system for supporting the drive motor, the gear system, and the drive quill, a lower support apparatus connected to the top drive support system, tubular handling apparatus connected to and below and supported by the lower support apparatus, the tubular handling apparatus including hydraulic-fluid-powered apparatus, provision apparatus connected to the tubular handling apparatus for providing hydraulic fluid to power the hydraulic-fluid-powered apparatus, the provision apparatus including flow line apparatus for providing hydraulic fluid to the hydraulic-fluid-powered apparatus and electrically-operable control apparatus for controlling fluid flow to and from the flow line apparatus, and electrical power generating apparatus connected to the tubular handling apparatus for providing electrical power to the electrically-operable control apparatus.

19 Claims, 45 Drawing Sheets

U.S. PATENT DOCUMENTS

| | | | | |
|---|---|---|---|---|
| 4,589,503 | A | 5/1986 | Johnson et al. | 175/113 |
| 4,605,077 | A | 8/1986 | Boyadjieff | 175/85 |
| 4,753,300 | A | 6/1988 | Shaw et al. | 173/164 |
| 4,759,239 | A | 7/1988 | Hamilton et al. | 81/57.34 |
| 4,793,422 | A | 12/1988 | Krasnov | 175/57 |
| 4,800,968 | A | 1/1989 | Shaw et al. | 175/85 |
| 4,813,493 | A | 3/1989 | Shaw et al. | 173/164 |
| 4,854,383 | A | 8/1989 | Arnold et al. | 166/70 |
| 4,865,135 | A | 9/1989 | Moses | 175/57 |
| 4,878,546 | A | 11/1989 | Shaw et al. | 173/163 |
| 4,899,832 | A | 2/1990 | Bierscheid, Jr. | 173/23 |
| 5,038,871 | A | 8/1991 | Dinsdale | 175/52 |
| 5,107,940 | A | 4/1992 | Berry | 175/85 |
| 5,251,709 | A | 10/1993 | Richardson | 175/220 |
| 5,255,751 | A | 10/1993 | Stogner | 175/203 |
| 5,381,867 | A | 1/1995 | Berry | 175/85 |
| 5,388,651 | A | 2/1995 | Berry | 175/85 |
| 5,433,279 | A | 7/1995 | Tessari et al. | 173/213 |
| 5,501,286 | A | 3/1996 | Berry | 175/52 |
| 5,755,296 | A | 5/1998 | Richardson et al. | 175/162 |
| 6,024,181 | A | 2/2000 | Richardson et al. | 175/162 |
| 6,050,348 | A | 4/2000 | Richarson et al. | 175/26 |
| 6,276,450 | B1 | 8/2001 | Seneviratne | 166/85.1 |
| 6,412,554 | B1 | 7/2002 | Allen et al. | 166/80.1 |
| 6,527,047 | B1 | 3/2003 | Pietras | 166/77.51 |
| 6,536,520 | B1 | 3/2003 | Snider et al. | 166/78.1 |
| 6,622,796 | B1 | 9/2003 | Pietras | 166/379 |
| 6,679,333 | B2 | 1/2004 | York et al. | 166/379 |
| 6,688,398 | B2 | 2/2004 | Pietras | 166/380 |
| 6,705,405 | B1 | 3/2004 | Pietras | 166/380 |
| 6,725,938 | B1 | 4/2004 | Pietras | 166/380 |
| 6,725,949 | B2 | 4/2004 | Seneviratne | 175/85 |
| 6,742,596 | B2 | 6/2004 | Haugen | 166/380 |
| 6,913,096 | B1 | 7/2005 | Nielsen et al. | 175/85 |
| 6,925,807 | B2 * | 8/2005 | Jones et al. | 60/721 |
| 6,935,440 | B2 | 8/2005 | Nelson et al. | 175/52 |
| 6,973,979 | B2 | 12/2005 | Carriere et al. | 175/203 |
| 6,994,174 | B2 | 2/2006 | Seneviratne | 175/85 |
| 7,007,753 | B2 | 3/2006 | Robichaux et al. | 166/291 |
| 7,021,374 | B2 | 4/2006 | Pietras | 166/77.51 |
| 7,026,950 | B2 * | 4/2006 | Guggari et al. | 340/853.3 |
| 7,055,594 | B1 | 6/2006 | Springett et al. | 166/85.1 |
| 2005/0173154 | A1 * | 8/2005 | Lesko | 175/57 |
| 2006/0096751 | A1 * | 5/2006 | Brown et al. | 166/77.52 |

OTHER PUBLICATIONS

PCT/GB2005/050085:Annex To FormPCT/ISA/206: 2 pp.: mailed Aug. 26, 2005.

Int'l Search Report; PCT/GB2005/050085; 5 pages; Feb. 28, 2006.

Written Opinion; PCT/GB2005/050085; 7 pages; Feb. 28, 2006.

An Overview of Top-Drive Drilling Systems Applications and Experiences, G. I. Boyadjieff, 1ADC/SPE 14716. 8 pp. 1986.

Varco Pioneers AC Top Drive, Engineering Award Winners, AC Top Drive Technology Update #1, Hart's Petroleum Engineer, 4 pp., Apr. 1997.

Challenger Rig & Mfg., Inc., Doghouse, Composite Catalog 1982—83, p. 1984-C, 1982.

AC Top Drive Technology Update #2, Varco Systems, 1 p. Prior to 2002.

Top Drive Drilling System TD 500 PAC Variable Frequency AC Top Drive, National Oilwell, 6 pp., 2002.

1000 Ton AC Top Drive—TDS—1000, Varco Systems, 2 pp., 2002.

750 Ton DC Top Drive TDS—45, Varco Systems, 2 pp., 2002.

500 Ton DC Top Drive IDS—1, Varco Systems, 2 pp., 2002.

Varco's Top Drive Systems are advancing the technology of drilling, Varco Systems, 8 pp., 2001.

* cited by examiner

Fig.1F
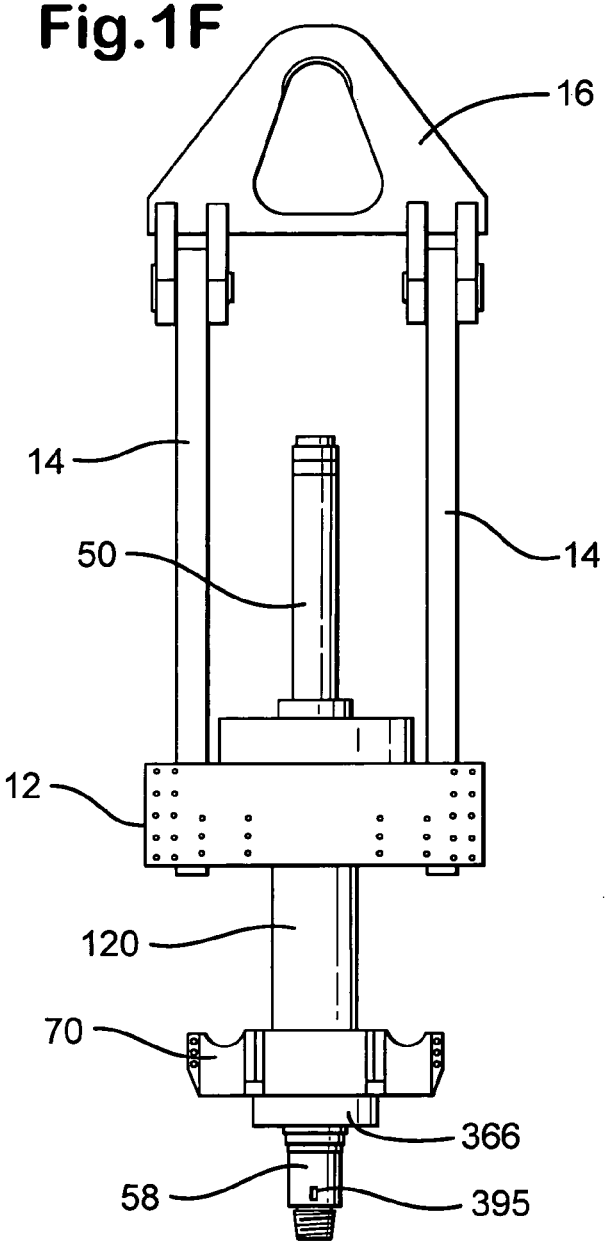
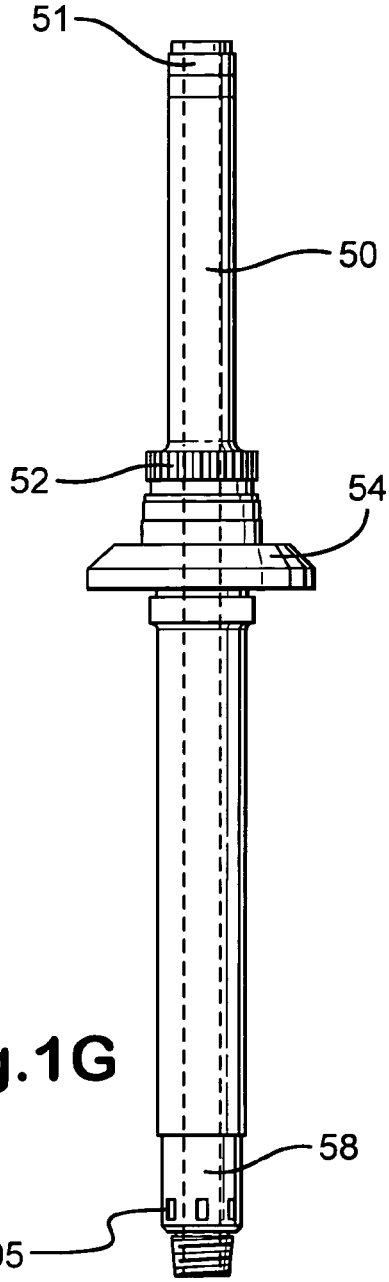
Fig.1G

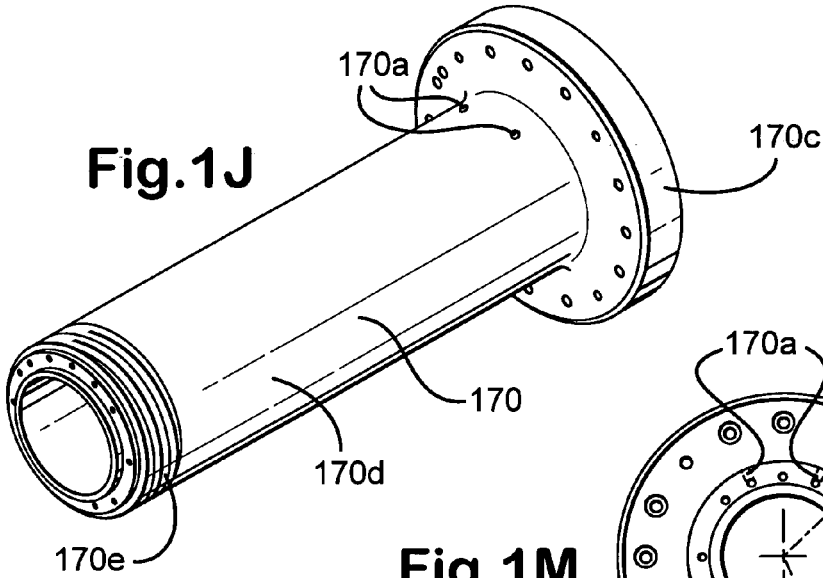
Fig.1J
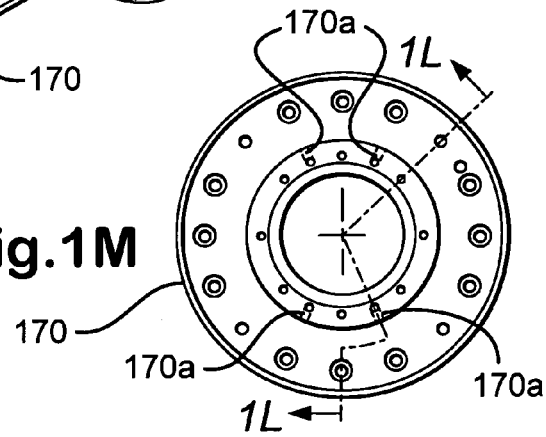
Fig.1M
Fig.1K
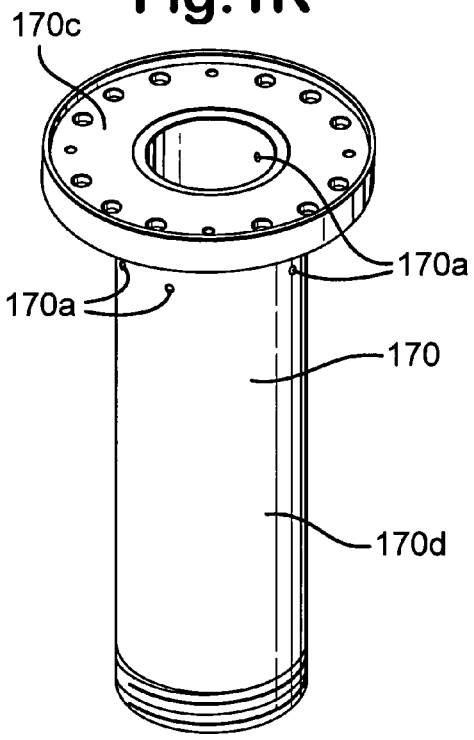
Fig.1L
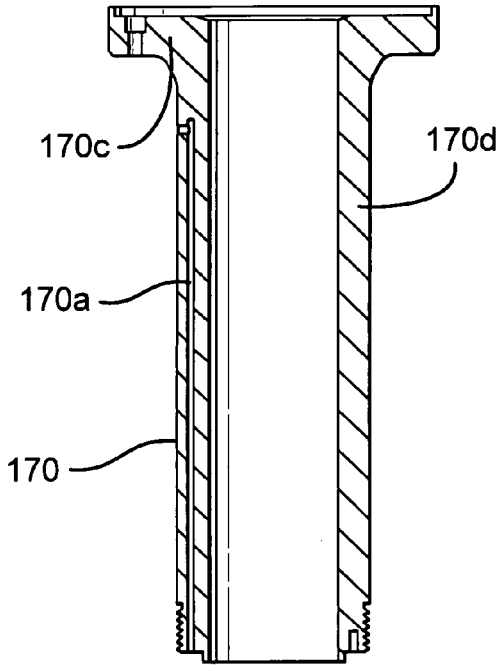

Fig.3IIIII
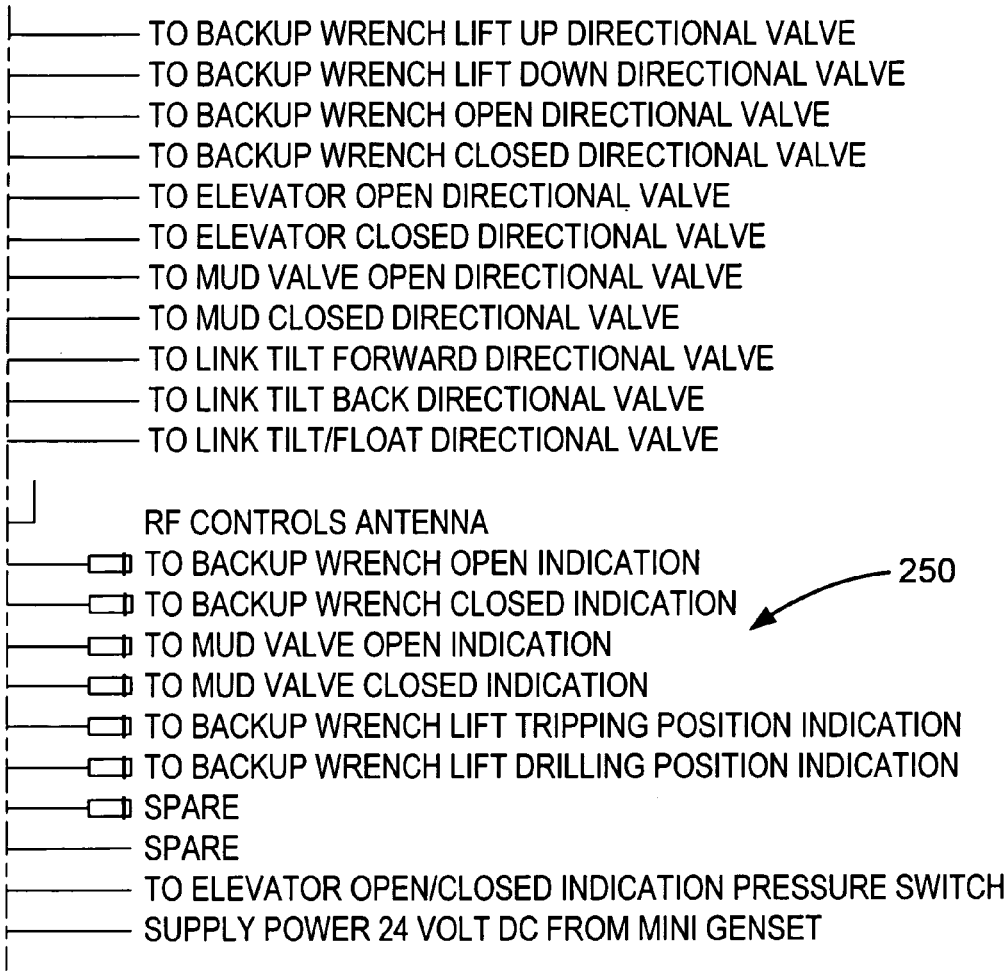
*EXPLODED VIEW OF LOWER JUNCTION BOX*
Fig.3
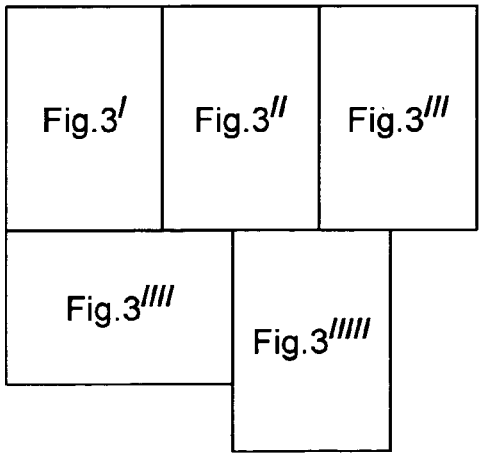

10
P
T
EXTEND
98
SPARE
BRAKE
40
PIPE HANDLER ROTATE MOTORS
190
SPARE
60
75 FOOT DERRICK SERVICE LOOP
PORT 3
PORT 2
PORT 1
CASE DRAIN
SET MOTORS TO 4 RPM ROTATION
PORT #1
PORT #2
PORT #3
SHUT-OFF VALVE
3 PORT ROTARY SEAL
PORT #1
PORT #3
PORT #2
80
75 FOOT DERRICK SERVICE LOOP
TOP DRIVE
OFFICE 15 GPM
HYDRAULIC MOTOR MINI SENSET
400
BACKUP WRENCH LIFT
100
BACKUP WRENCH
100
MUD VALVE
90
ELEVATOR
90
LINK TILT
120

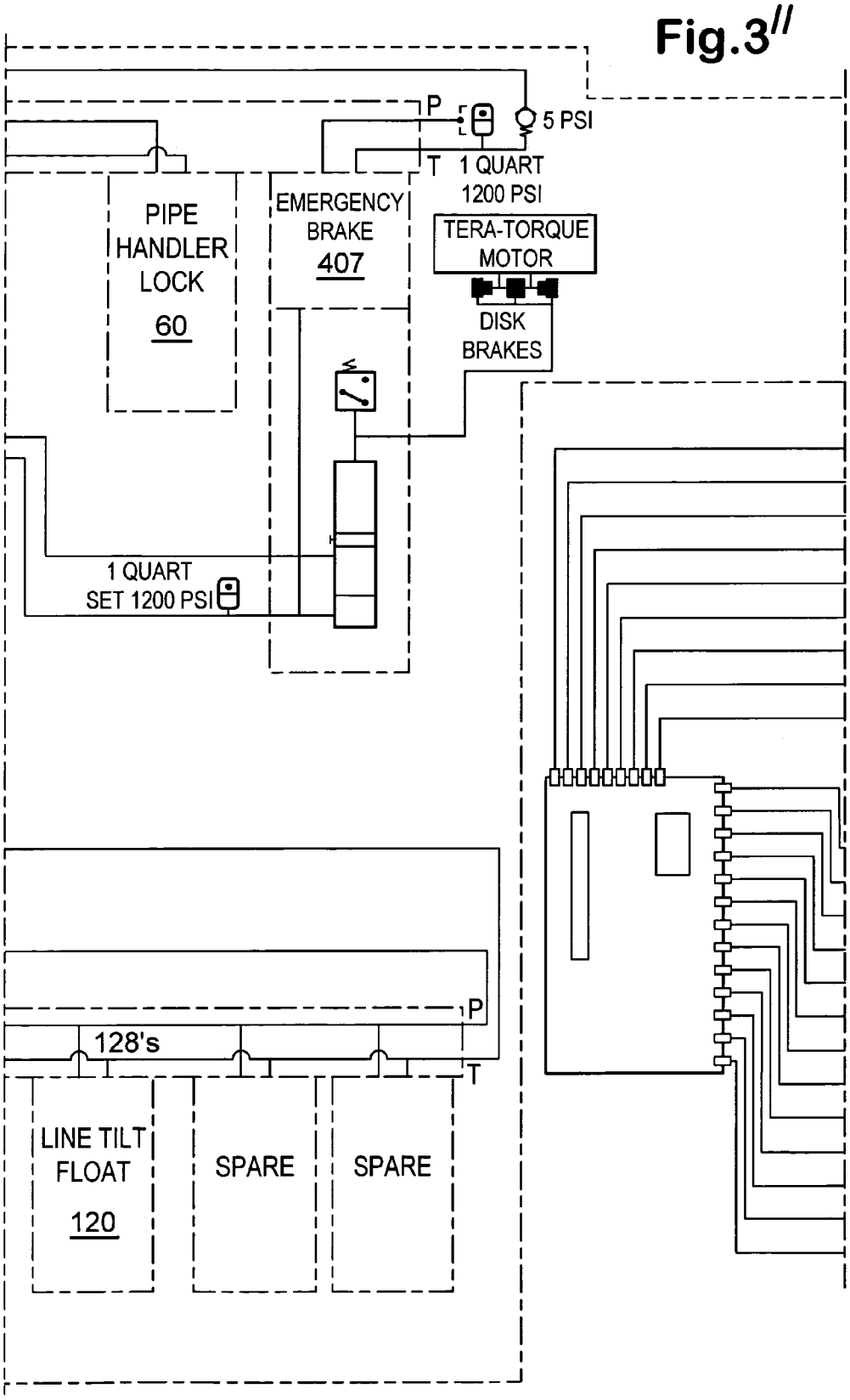
Fig.3//
P
5 PSI
T
1 QUART
1200 PSI
PIPE
HANDLER
LOCK
60
EMERGENCY
BRAKE
407
TERA-TORQUE
MOTOR
DISK
BRAKES
1 QUART
SET 1200 PSI
P
128's
T
LINE TILT
FLOAT
120
SPARE
SPARE

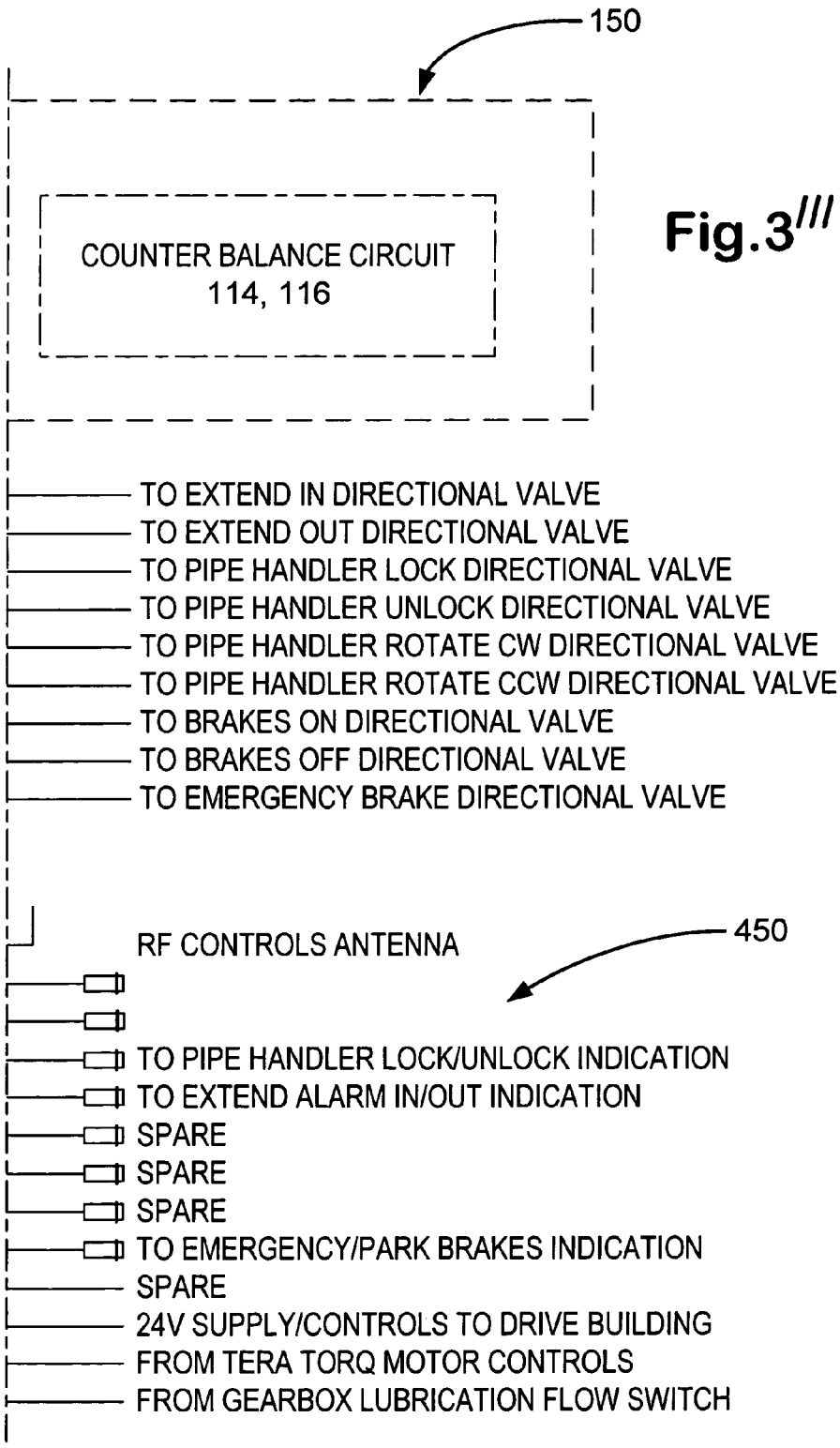
Fig.3///
*EXPLODED VIEW OF UPPER JUNCTION BOX BEHIND ACCESS PLATFORM* 130

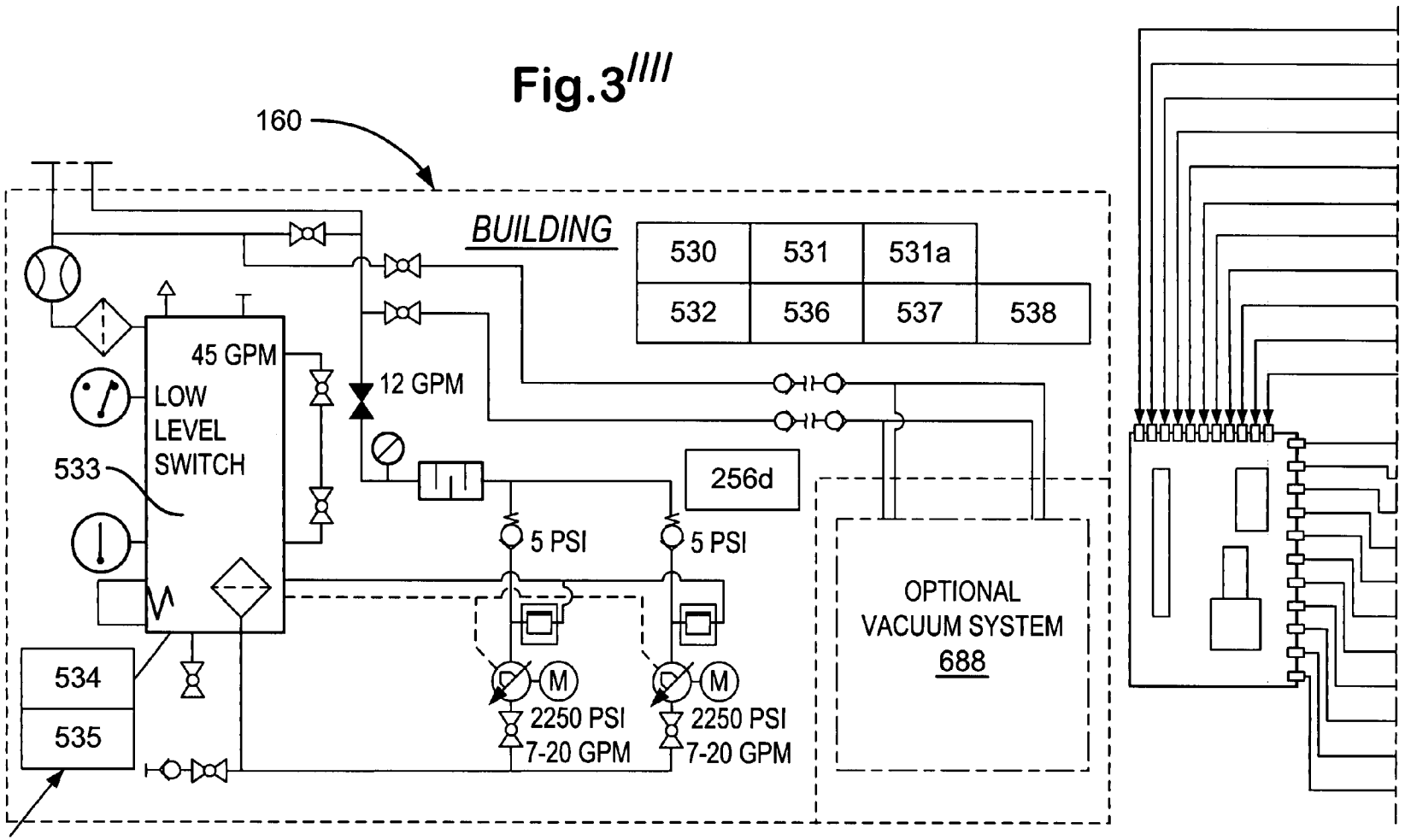
Fig.3////

Fig.5A
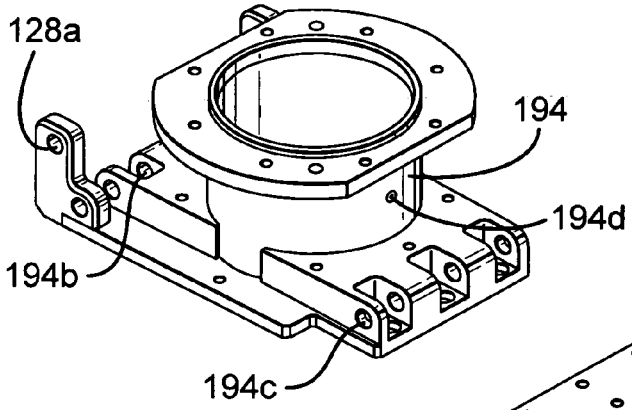
Fig.5B
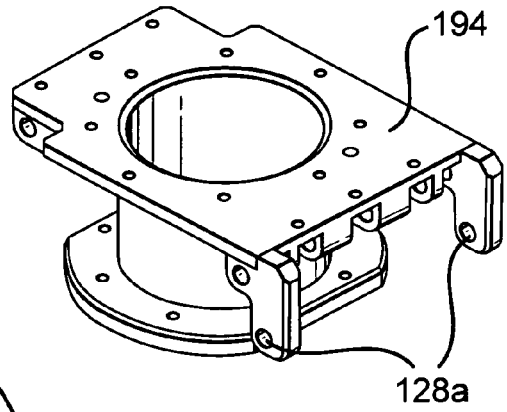
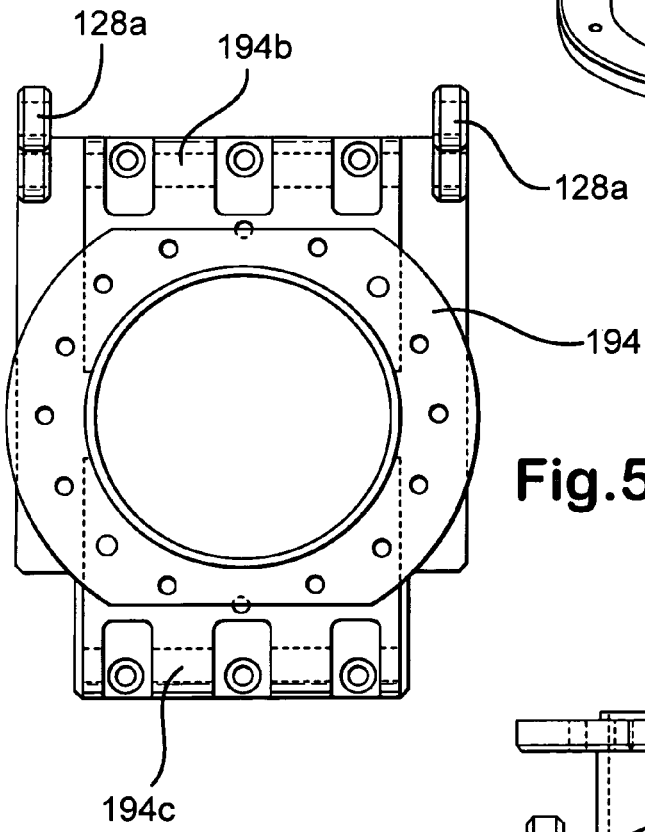
Fig.5C
Fig.5D
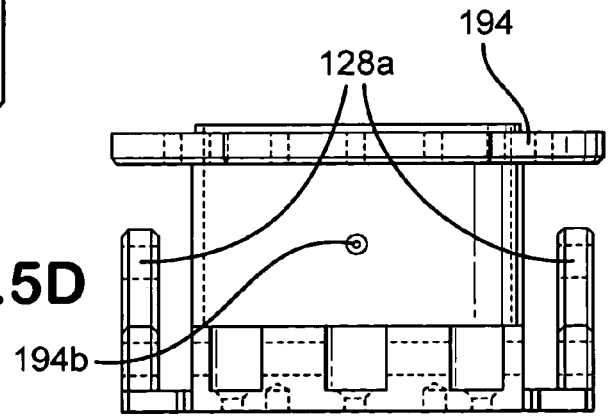

Fig.8P
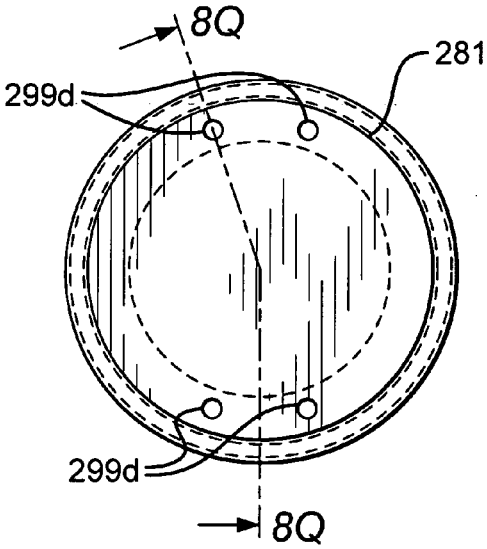
Fig.8Q
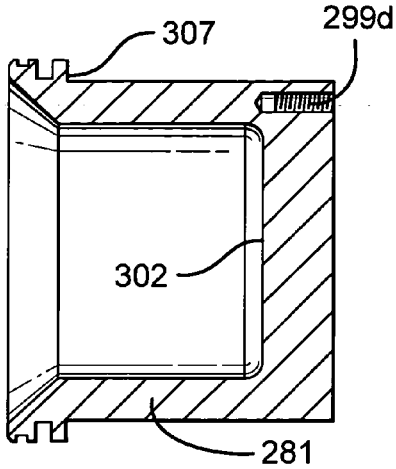
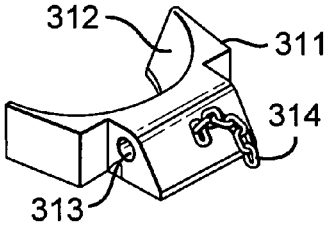
Fig.8R
Fig.8T
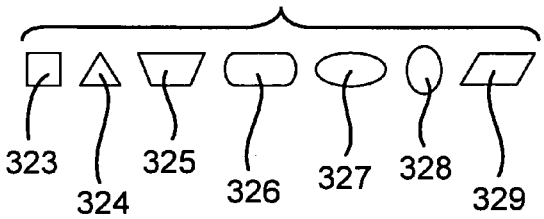
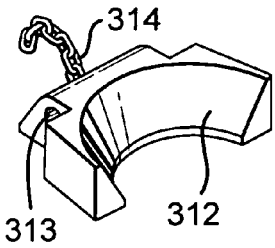
Fig.8S
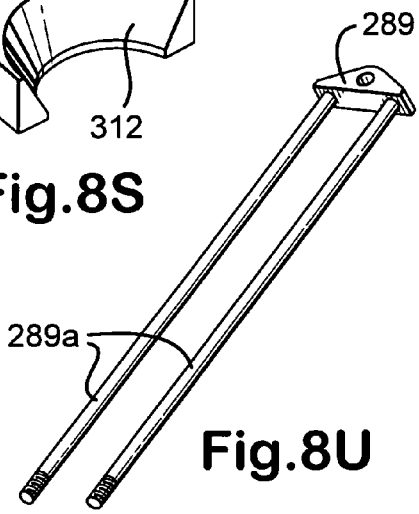
Fig.8U
Fig.8V
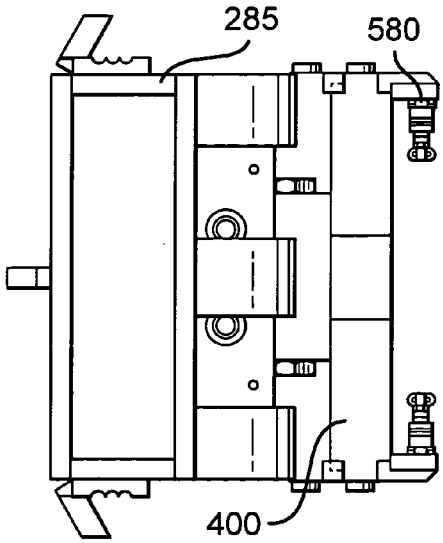

128
121
120
122
126
127
127
72
74

128
121
120
122
126
127
72
74

128
121
120
122
126
127
72
74

Fig.10A
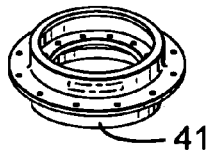
Fig.10B
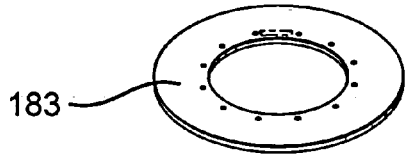
Fig.11A
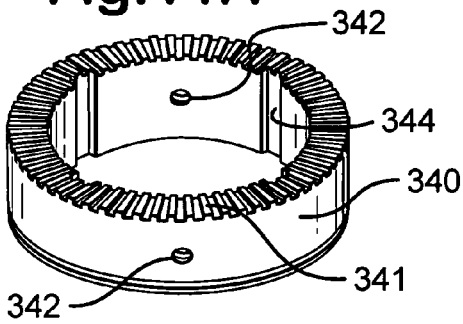
Fig.11B
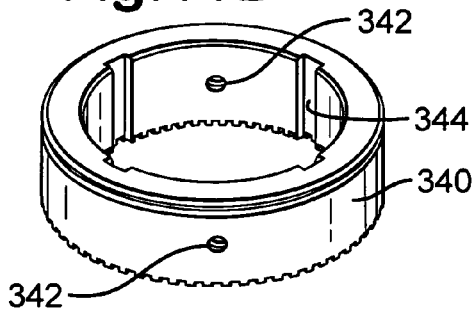
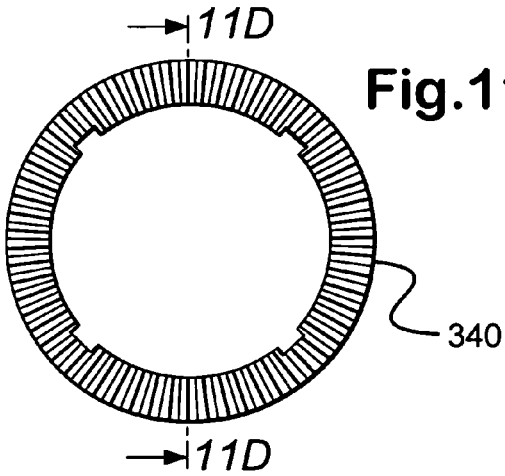
Fig.11C
Fig.11D
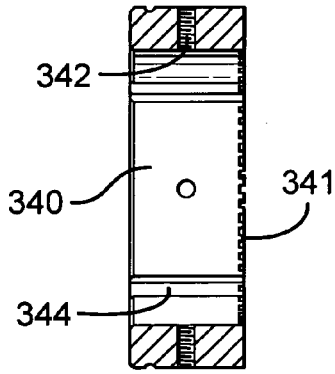
Fig.12A
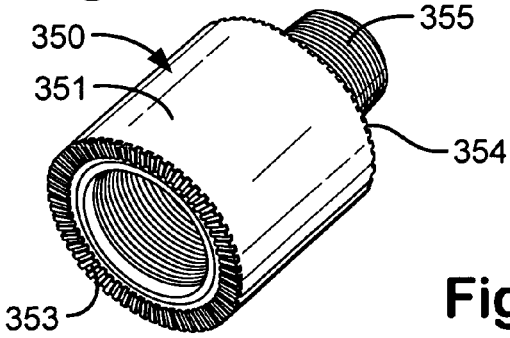
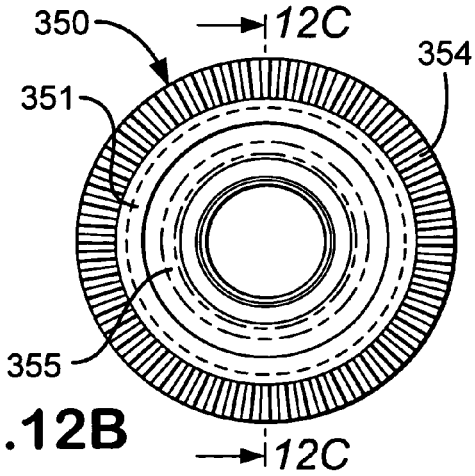
Fig.12B Fig.12C
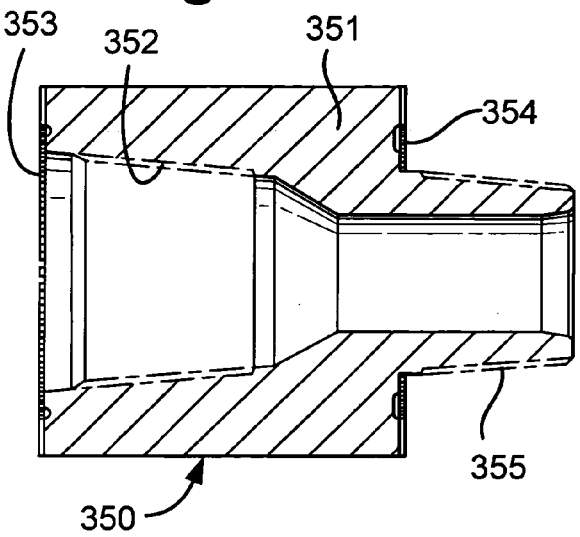
Fig.14A
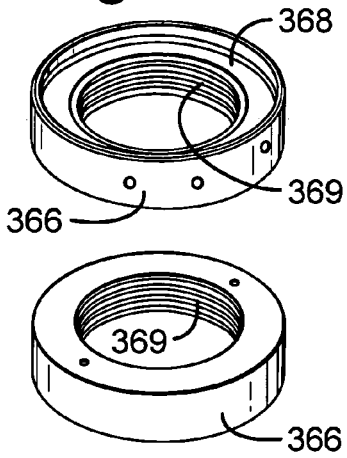
Fig.14B
Fig.13
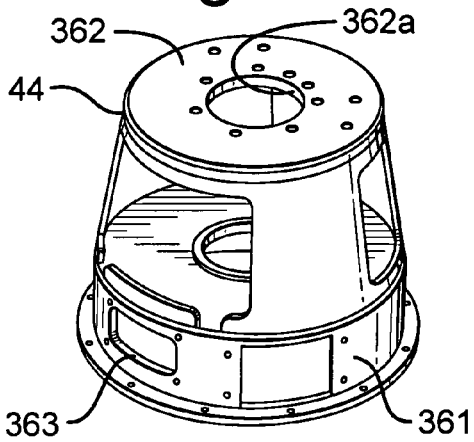
Fig.15A
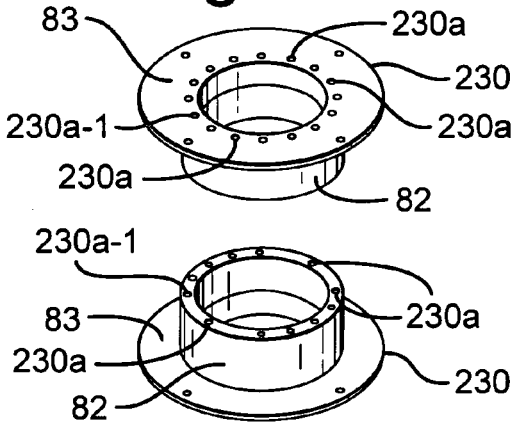
Fig.15B
Fig.15C
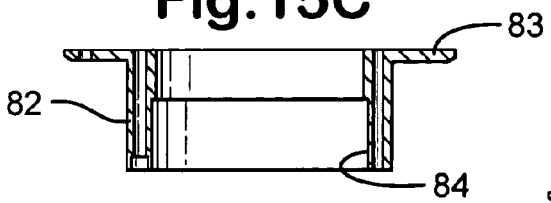
Fig.15F
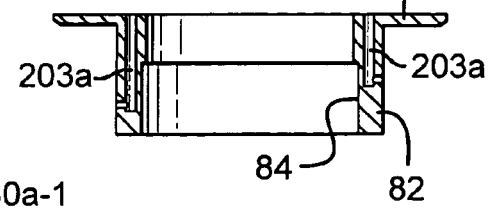
Fig.15D
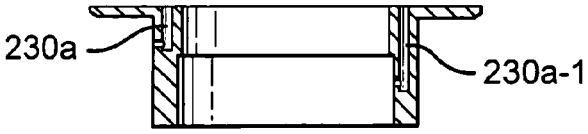

122
127b
127a
A
126
(ϕ2 7/8")

122
B
127b
127a
126
(ϕ3 1/2")

122
127b
C
127a
126
(ϕ4 1/2")

122
127c
127d
127e
127b
127f
6-1/8"
(1/2")
127c
127d
127a 122
127c
127d
127f
127b
6-1/8"
(3/16")
127c
127d
127a 122
127d
127c
127b
127f
7-1/8"
(3/16")
127c
127d
127a

WELLBORE TOP DRIVE POWER SYSTEMS AND METHODS OF USE

RELATED APPLICATION

This is a division of U.S. Ser. No. 10/862,787 filed Jun. 7, 2004 entitled "Top Drive Systems" naming as inventors Robert Folk and Steven Folk.

BACKGROUND OF THE INVENTION

1. Field of the Invention

This invention is directed to top drive systems for use in wellbore rigs, to components of such systems, and to methods of their use.

2. Description of Related Art

The prior art discloses a variety of top drive systems which use a DC or AC motor. U.S. Pat. Nos. 4,458,768; 5,433,279; 6,276,450; 4,813,493; 6,705,405; 4,800,968; 4,878,546; 4,872,577; 4,753,300; 6,536,520; 6,679,333 disclose various top drive systems.

The prior art discloses a Varco Drilling Systems TDS-9S AC Top Drive system with an alternating current motor-powered top drive.

SUMMARY OF THE PRESENT INVENTION

The present invention, in certain aspects, provides a top drive system with a hollowbore electric alternating current permanent magnet motor coupled to a planetary gear system. The central axis of the electric motor and of the planetary gear system are aligned and can be selectively aligned with a wellbore.

In certain aspects, the electric motor has a central bore that is alignable with a central bore of the planetary gear system so that drilling fluid is flowable through the motor, through the planetary gear system, through apparatus located below the planetary gear system, and then into a tubular below or supported by the top drive system.

In certain aspects, the top drive system includes pipe handling apparatus located below the gear system. In one aspect an electric power generator is located at the level of the pipe handler apparatus and the electrical power generator rotates with the pipe handling apparatus.

The present invention discloses, in certain embodiments, a drive system with a permanent magnet motor with a first motor side, a second motor side, and a motor bore therethrough from the first motor side to the second motor side, wherein the permanent magnet motor is a hollow bore alternating current permanent magnet motor; a planetary gear system coupled to the permanent magnet motor, the planetary gear system having a first gear side spaced-apart from the first motor side, a second gear side spaced-apart from the first gear side, and a gear system bore therethrough from the first gear side to the second gear side, the second motor side adjacent the first gear side; and the motor bore aligned with the gear system bore so that fluid is flowable through the drive system from the first motor side of the motor to the second gear side of the planetary gear system; and, in certain aspects, with a hollow drive shaft coupled to the gear system with fluid also flowable from the gear system to and then out of the drive shaft.

The present invention discloses, in certain embodiments, a top drive system for wellbore operations, the top drive system with a permanent magnet motor with a top, a bottom, and a motor bore therethrough from the top to the bottom, the permanent magnet motor being a hollow bore alternating current permanent magnet motor; a planetary gear system coupled to the permanent magnet motor, the planetary gear system having a top, a bottom, and a gear system bore therethrough from top to bottom, the bottom of the permanent magnet motor adjacent the top of the planetary gear system; the motor bore aligned with the gear system bore so that fluid is flowable through the top drive system from the top of the motor to the bottom of the planetary gear system; and a quill drivingly connected to the planetary gear system and rotatable thereby to rotate a tubular member located below the quill, the quill having a top end and a bottom end, fluid flowable through the permanent magnet motor, through the planetary gear system and through the quill to exit a bottom end of the quill.

The present invention discloses, in certain embodiments, a top drive system with a drive motor; a gear system coupled to the drive motor; a drive quill coupled to the gear system; a top drive support system for supporting the drive motor, the gear system, and the drive quill; a lower support apparatus connected to the top drive support system; tubular handling apparatus connected to and supported by the lower support apparatus; the tubular handling apparatus including hydraulic-fluid-powered apparatus; provision apparatus for providing hydraulic fluid to power the hydraulic-fluid-powered apparatus, the provision apparatus including flow line apparatus for providing hydraulic fluid to the hydraulic-fluid-powered apparatus and electrically-operable control apparatus for controlling fluid flow to and from the flow line apparatus; and electrical power generating apparatus connected to the tubular handling apparatus for providing electrical power to the electrically-operable control apparatus.

The present invention discloses, in certain embodiments, an apparatus for releasably holding a member (e.g. but not limited to a tubular, casing tubing, or pipe), the clamping apparatus including a main body; two opposed clamping apparatuses in the main body, the two opposed clamping apparatuses spaced-apart for selective receipt therebetween of a member to be clamped therebetweeen; each of the two opposed clamping apparatuses having a mount and a piston movable within the mount, the piston selectively movable toward and away from a member to be clamped; two spaced-apart legs, each leg with an upper end and a lower end, each lower end connected to the main body; and each leg with an outer leg portion and an inner leg portion, the inner leg portion having part thereof movable within the outer leg portion to provide a range of up/down movement for the main body.

The present invention discloses, in certain embodiments, a container (e.g. but not limited to an ISO container) for a top drive system and a containerized top drive system with a container; top drive apparatus removably disposed within the container; an extension system for moving the top drive apparatus generally horizontally within a derrick, the top drive apparatus secured to the extension system, the extension system removably disposed within the container with the top drive apparatus; a track, the track with of multiple track parts connectible together; the track including at least one track part which is a skid track part, the skid track part with a skid portion and a track portion, the top drive apparatus and the extension system located on the at least one skid track part within the container and the top drive apparatus supported by and movable with the at least one skid track part; at least one first compartment for removably storing the multiple track parts, the multiple track parts removably located in the at least one first compartment; and the track assembleable outside the container to include the multiple track parts and the at least one skid track part so that with the extension system on the track the extension system is movable along the track with the top drive apparatus.

It is, therefore, an object of at least certain preferred embodiments of the present invention to provide:

New, useful, unique, efficient, non-obvious top drive systems and methods of their use;

Such top drive systems with a hollow bore electric motor whose bore is aligned with a bore of a planetary gear system for the flow of drilling fluid through the motor and through the gear system to and through a drive shaft or quill to a tubular or tubular string below the top drive; and Such a top drive system with an electrical power generator which is rotatable with pipe handling apparatus.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, various purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or equivalent embodiments.

FIG. 10 is a top view of the swivel body of FIG. 1N.

FIG. 5A is a top perspective view of a gear collar of the system of FIG. 1A. FIG. 5B is a bottom perspective view of the gear collar of FIG. 5A. FIG. 5C is a top view of the gear collar of FIG. 5A. FIG. 5D is a front view of the gear collar of FIG. 5A.

FIG. 7B is a top view and FIG. 7C is a bottom view.

FIGS. 8N and 80 are perspective views of a piston of the apparatus of FIG. 8G. FIG. 8P is an end view and 8Q is a cross-section view of the piston of FIG. 8N. FIGS. 8R and 8S are perspective views of parts of a pipe guide of the apparatus of FIG. 8A. FIG. 8T illustrates cross-sectional shapes for legs of an apparatus as in FIG. 8A (and for corresponding holes receiving such legs). FIG. 8U is a perspective view of a spring holder of the apparatus of FIG. 8A. FIG. 8V is a top view of an inner leg of the apparatus of FIG. 8A.

FIG. 10A is a perspective view of a brake drum of the brake system of the system of FIG. 1A. FIG. 10B is a perspective view of a brake disc of the brake system of the system of FIG. 1A.

FIGS. 11A (top) and 11B (bottom) are perspective views of a connection lock member according to the present invention for use with the system of FIG. 1A. FIG. 11C is a top view of the member of FIG. 11A. FIG. 11D is a cross-section view of the member of FIG. 11A.

FIG. 12A is a perspective view of a crossover sub according to the present invention. FIG. 12B is a top view of the sub of FIG. 12A. FIG. 12C is a cross-section view along line 12C-12C of FIG. 12B.

FIG. 13 is a perspective view of the bonnet of the system of FIG. 1A.

FIG. 14A is a top view and FIG. 14B is a bottom view of a load nut according to the present invention useful in the system of FIG. 1A.

FIGS. 15A (top) and 15B (bottom) are perspective views of an inner barrel of a rotating head according to the present invention useful in the system of FIG. 1A. FIG. 15C is a cross-section view along line 15C-15C of FIG. 15E. FIG. 15D is a cross-section view alone line 15D-15D of FIG. 15E. FIG. 15F is a cross-section view along line 15F-15F of FIG. 15E.

DESCRIPTION OF EMBODIMENTS PREFERRED AT THE TIME OF FILING FOR THIS PATENT

Figure 1A:
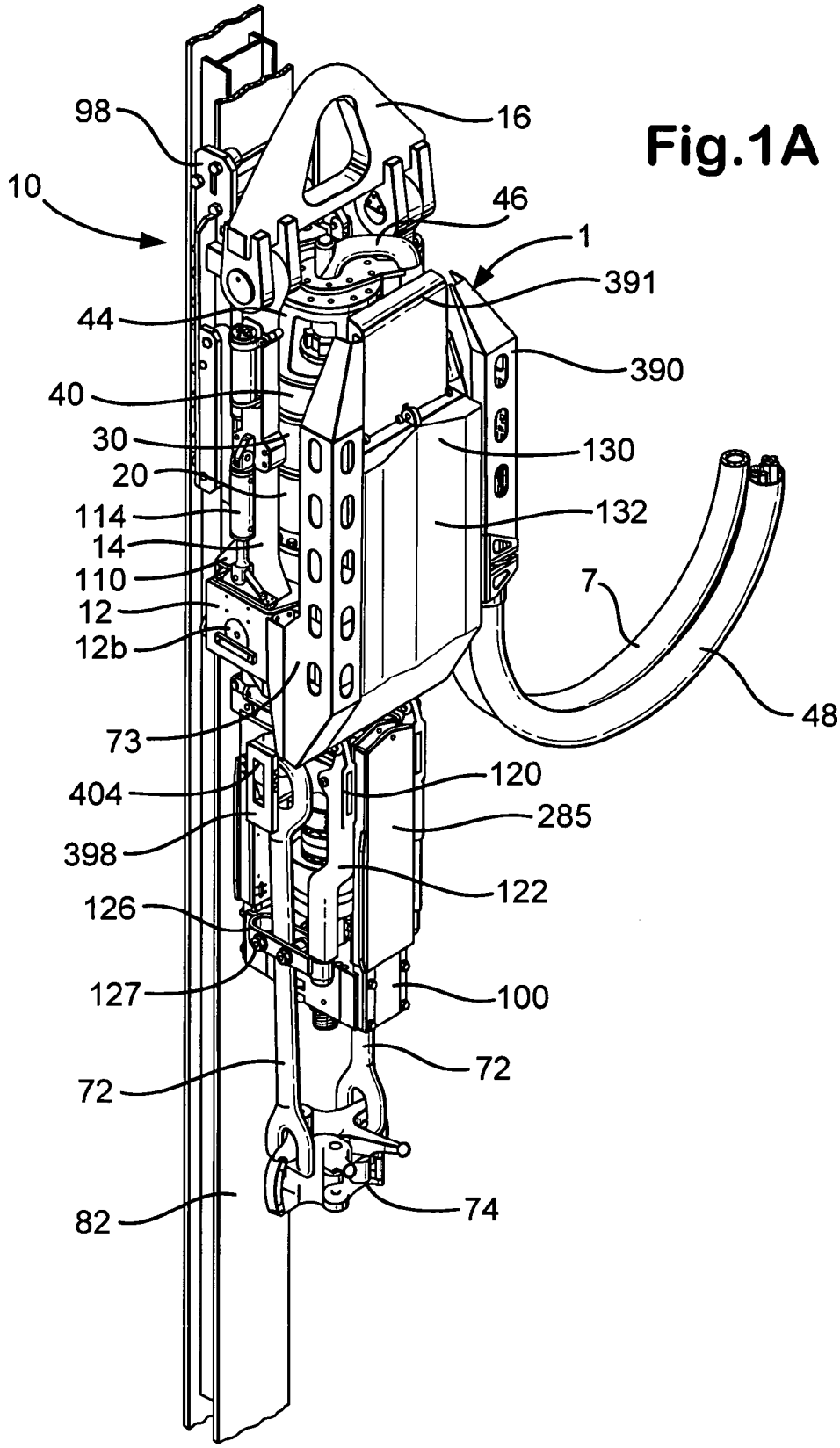
FIG. 1A is a perspective view of a top drive system according to the present invention.

FIGS. 1A-1D show a top drive system 10 according to the present invention which has a swivel body 12 suspended with links 14 from a becket 16. The becket 16 is connected to a travelling block (not shown). A gear system 20 is mounted on a spacer plate 22 which is supported by the swivel body 12.

A hollowbore alternating current permanent magnet motor 30 is coupled to the gear system 20. Any suitable permanent magnet motor may be used; e.g., but not limited to, a commercially available alternating current hollow bore permanent magnet motor model TERA TORQ (™) from Comprehensive Power Ltd., Boston, Mass. (which motor is supplied with a control system and which has associated computer system software and controls; and which can be programmed so that the motor itself can serve as a brake). A brake system 40 connected to the motor 30 is within a bonnet 44 through which extends a gooseneck 46 connected to a kelly hose 7 (which is adjacent a service loop 48) through which flows drilling fluid. An extension system 98 according to the present invention provides horizontal displacement of the top drive system 10 (see FIGS. 2C, 2D, 2E). The emergency brake system 40 can operate either selectively or automatically (e.g., the driller has an emergency brake bottom on the driller's panel 141).

The motor 30 has a splined output shaft 32 which drivingly meshes with a splined portion 26 of the gear system 20 which has a splined portion 224 that mates with a splined portion 52 of a drive quill 50. A flange 54 of the quill 50 bears string load weight and rotates on a main bearing system 56 on the swivel body 12. The quill 50 extends through the motor 30, the gear system 20, the spacer plate 22, the swivel body 12, a locking system 60, a load collar 70, and a rotary seal 80. A lower end 58 of the quill 50 is threadedly connected to a mud saver system 90 which itself is connected to a saver sub 92. A system 100 for selectively gripping tubulars is suspended from a load collar 70. Links 72 suspend an elevator 74 from the load collar 70. Keys 395 in key slots 396 (see FIG. 1I) releasably connect the end of the quill 50 to a connection lock member as described below to insure a connection between the quill 50 and mud saver system 90 is maintained.

A counterbalance system 110 (which can hold the weight of the entire system 10 during stabbing of tubulars) includes two load compensators 112 each with an upper end connected to a link 14 and with a lower end connected to the swivel body 12. Lower ends of the links 14 have openings 14*c* which are sized and configured to permit a range of movement (e.g. about 6 inches) with respect to, pins 13 that maintain the links 14 in the swivel body 12. Thus when the swivel body 12 supports the brakes, motor, gear system and bonnet counter balancing may be needed. Retainer plates 399 secured to the swivel body 12 releasably retain the pins 13 in place in the recesses 12*b* (i.e. the pins 13 do not take up all the space within the link openings). Each load compensator 112 includes a piston/cylinder assembly 114. The cylinders are balanced using charged accumulators 116.

A link tilt system 120 provides selective tilting of the links 72 and thus selective movement and tilting of the elevator 74 and movement of a tubular or stand of tubulars supported by the elevator 74 to and away from a wellbore centerline. Bail retainers 404 retain the links 72 on the load collar 70. Link tilt hydraulic cylinders 128 are interconnected pivotably between the load collar 70 (connected to its ears 128*a*) and arms 122. Each connector 124 is pivotably connected to a lower end of an arm 122 and to a clamp 126 which is clamped to a link 72. Optionally, roller pins 127 extend through the clamps 126 to facilitate movement of the links 72 within the clamps 126.

Guards 73 and 390 are on sides of an access platform 130. The access platform 130 is releasably connected to a rear guard 454 at its top and pivotably at its lower portion to the swivel body 12 so that it can pivot and be lowered to provide a platform on which personnel can stand to access various components on the rear guard. Optionally, the access platform 130 may have an indented portion 132 for facilitating the placement of tubulars thereon and for facilitating movement of tubulars on the exterior of the access platform 130.

The top drive system 10 can be movably mounted on a beam 82 (or "torque tube"). Horizontal displacement is provided by the extension system 98 which includes a torque bushing 98*a*. The extension system 98 with the top drive system attached thereto is movable vertically on the beam 82 with the top drive system attached thereto.

Figure 15E:
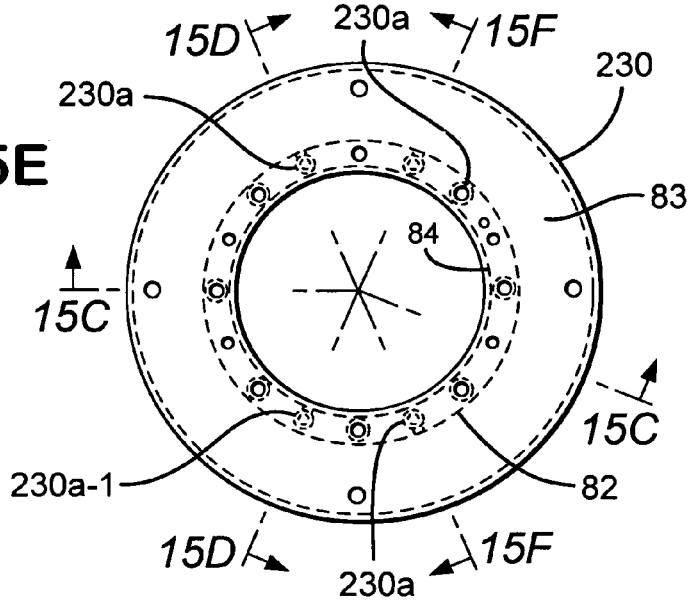
FIG. 15E is a cross-section view of the seal of FIG. 15A.
Figure 15G:
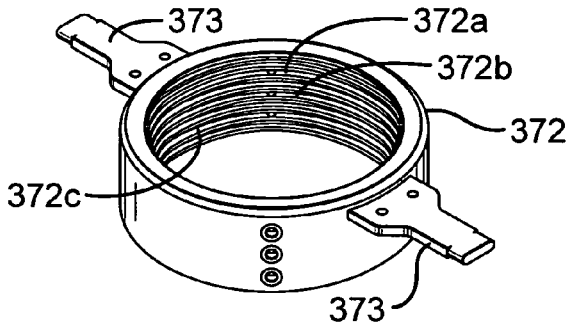
FIG. 15G is a perspective view of an outer barrel of the rotating head.

FIGS. 1J-1M show a load sleeve 170 according to the present invention with four channels 170*a* therethrough. These channels extend to a lower end of the load sleeve 170. At the bottom, each of the four channels is in fluid communication with corresponding channels in a rotating head 80 (see, e.g. FIG. 15A). The rotating head 80 is connected on the lower end of the load sleeve 170. Via the fluid channels in the load sleeve and the corresponding channels in the rotating head 80, hydraulic fluid under pressure provides power and/or lubricating for apparatuses below the rotating head; including, e.g. link tilt apparatus, the clamping of the system 100, the up/down movement of the system 100, the elevator 74 when it is hydraulically powered, and the mud saver system 90. This fluid also flows via appropriate channels to a generator system 240 located at or near the level of pipe handling apparatus, as described below, which produces electrical power for directional valves that control flow in the various channels. A flange 170*c* is connected to or formed integrally of a body 170*d*. A threaded end 170*e* threadedly mates with corresponding threads in a load nut. The flange 170*c* is bolted to the swivel body 12. In one aspect when the link tilt system elevator 74 has received and is holding a tubular or a stand, the cylinder assemblies 128 are under a relatively heavy load. A directional valve 260 allows fluid to flow from the lines connected to the cylinder assemblies 128 thereby relieving the pressure therein and allowing the links 72 to move block ("float" to vertical, see "LINK TILT FLOAT," FIG. 3).

Figure 1B:
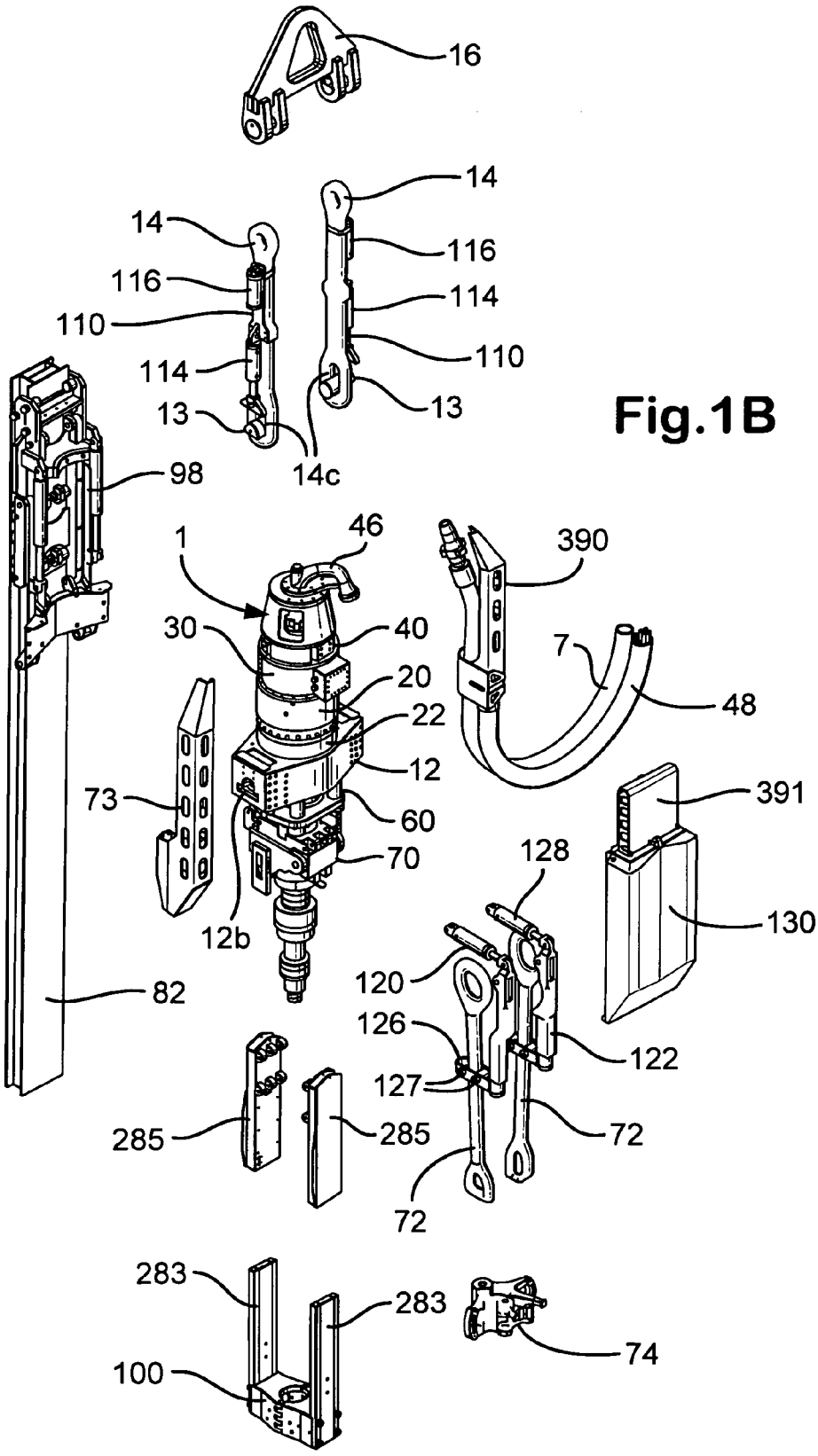
FIG. 1B is an exploded view of the system of FIG. 1A.
Figure 1C:
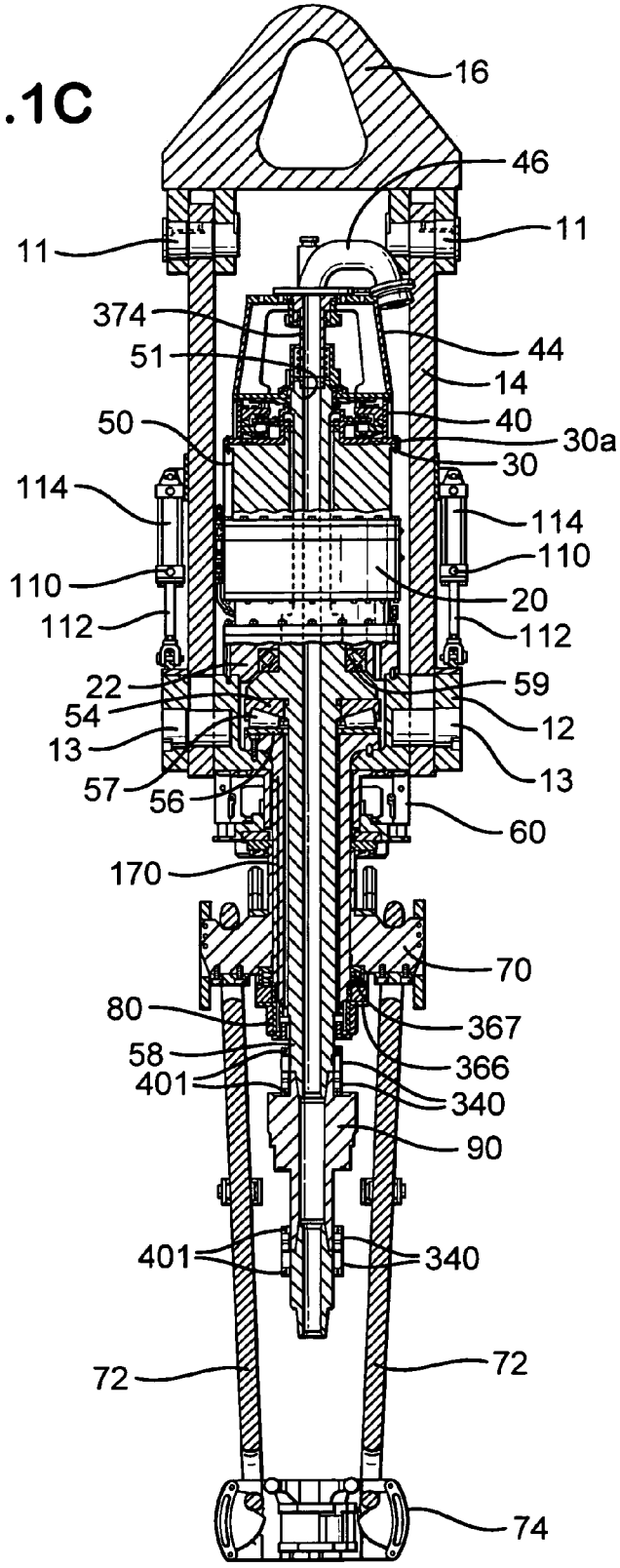
FIG. 1C is a front view in cross-section of the system of FIG. 1A.
Figure 1D:
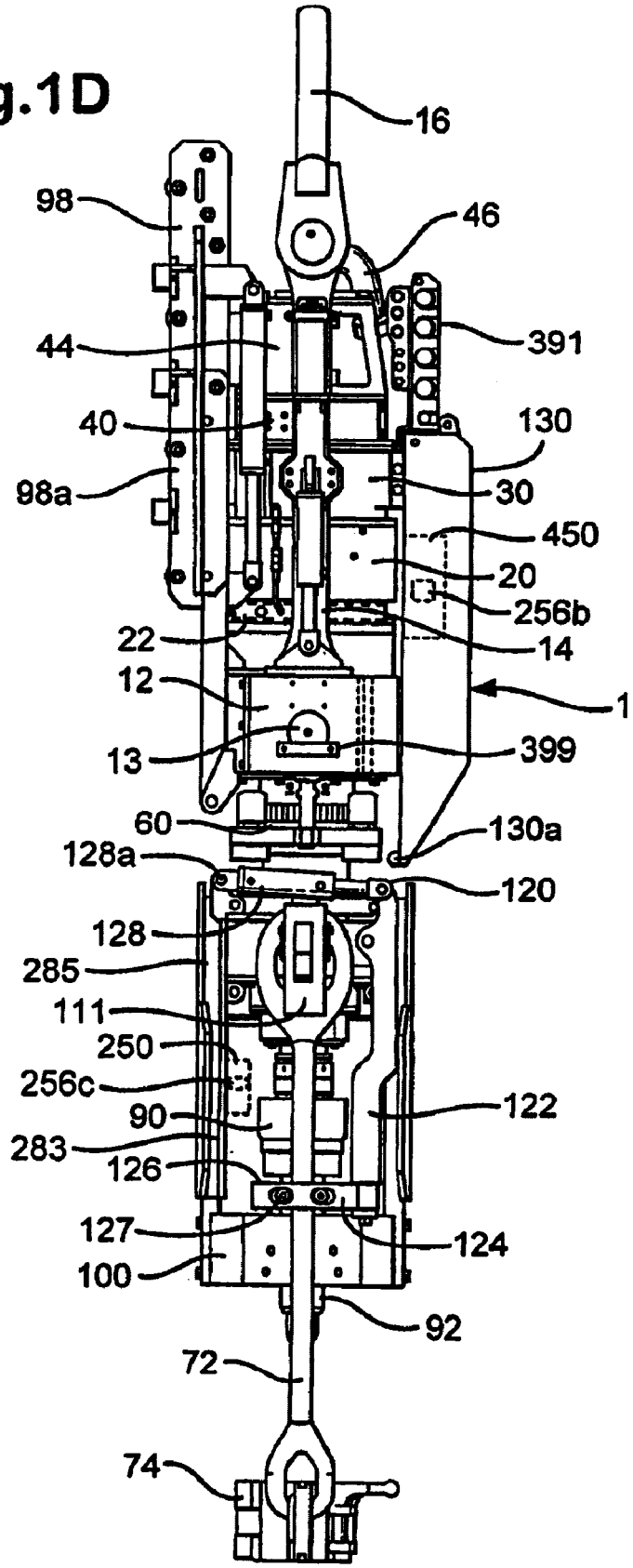
FIG. 1D is a side view of the system of FIG. 1A.
Figure 1E:
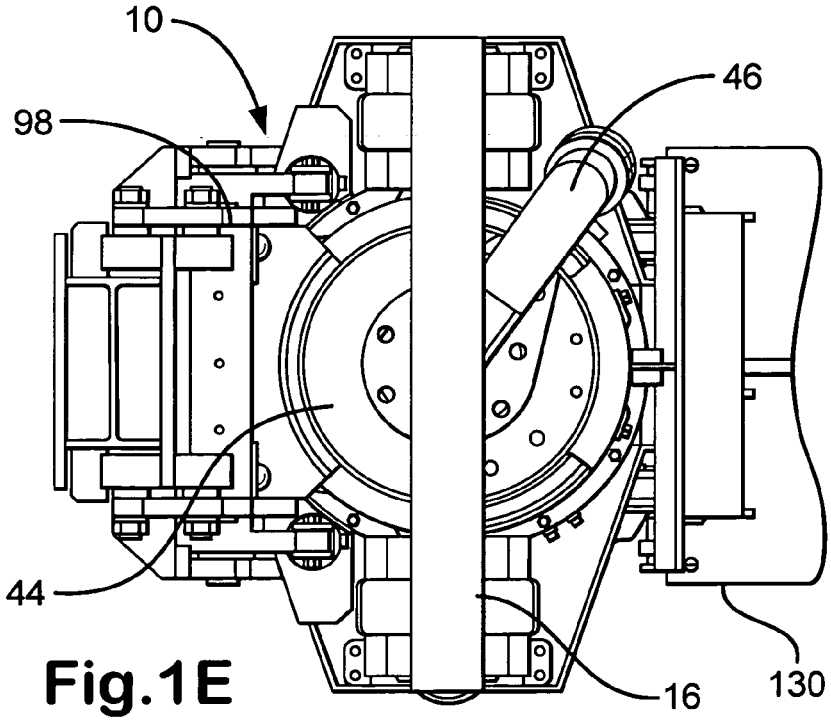
FIG. 1E is a top view of the system of FIG. 1A.
Figure 1H:
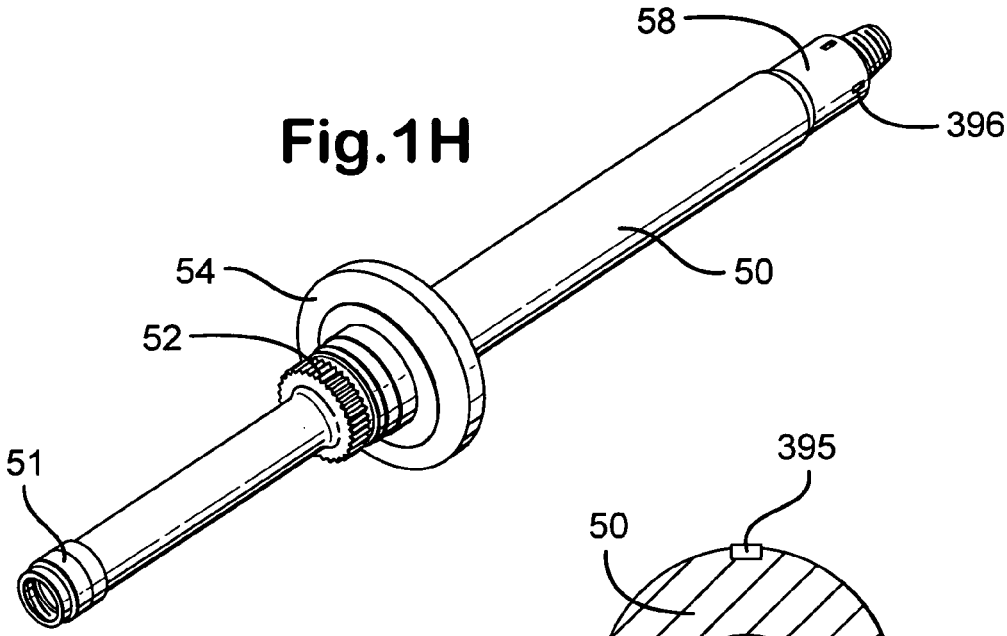
FIG. 1H is a perspective view of the quill of FIG. 1G.
Figure 1I:
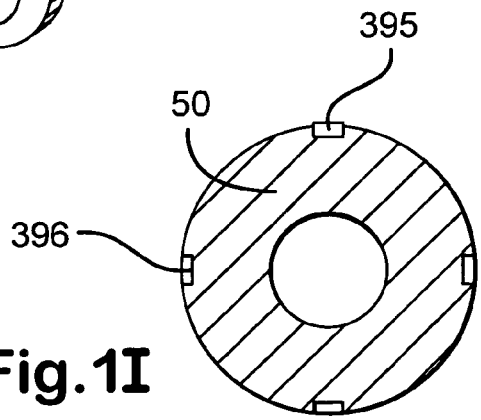
FIG. 1I is a cross-section view of an end of the quill of FIG. 1G.
Figure 1N:
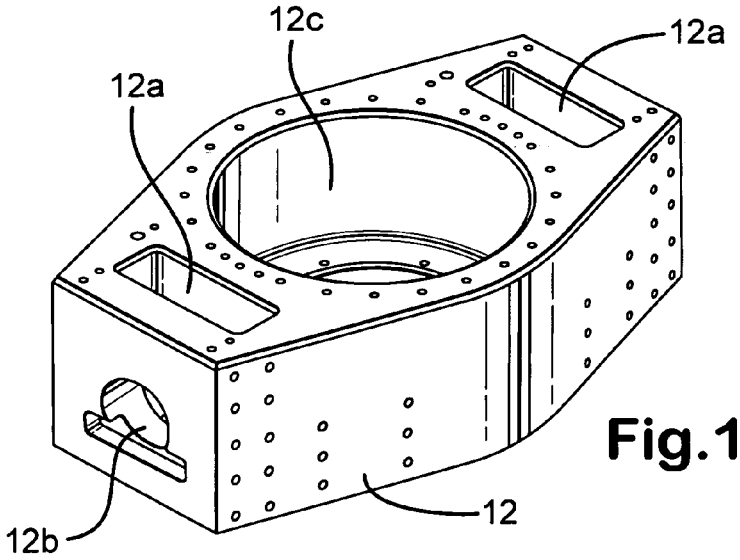
FIGS. 1N and 1S are perspective views of a swivel body of the system of FIG. 1A.
Figure 1O:
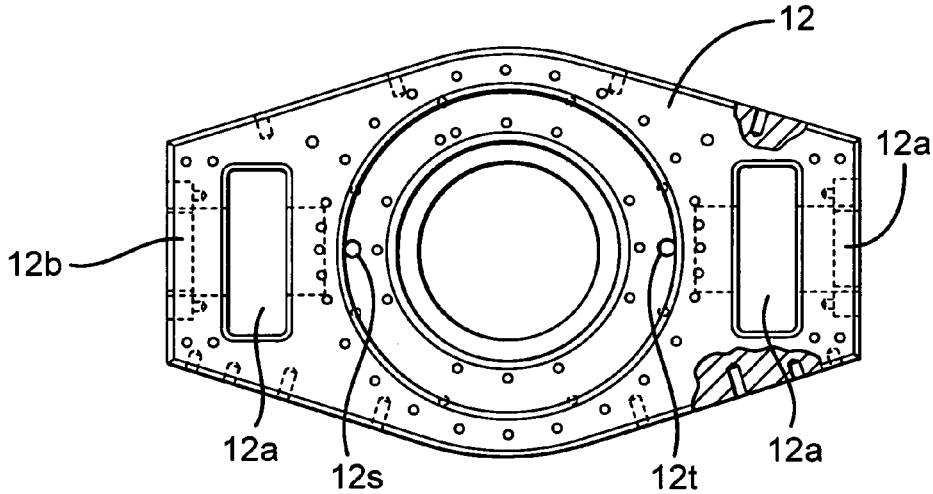
FIG. 1F is a front view of part of the system of FIG. 1A.
FIG. 1G is a side view of a quill for the system of FIG. 1A.
FIGS. 1J and 1K are perspective views of a load sleeve of the system of FIG. 1A.
FIG. 1L is a cross-section view of the load sleeve of FIG. 1J along line 1L-1L of FIG. 1M.
FIG. 1M is an end view of the load sleeve of FIG. 1L.
FIG. 1P is a cross-section view of the swivel body of FIG. 1N.
FIG. 1Q is a bottom view of the swivel body of FIG. 1N.
FIG. 1R is a perspective view, partially cutaway, of the swivel body of FIG. 1N.
Figure 1P:
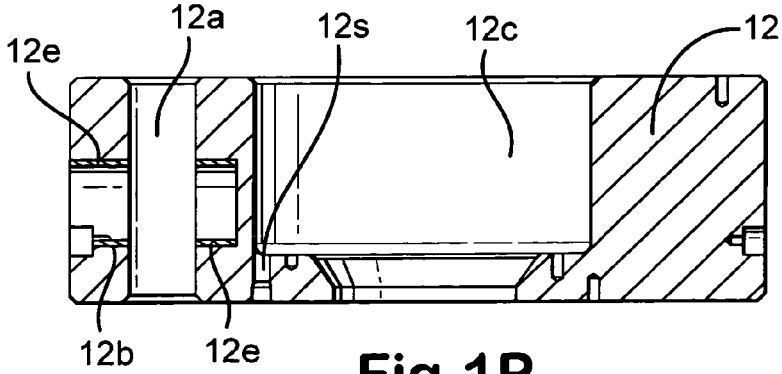
Figure 1Q:
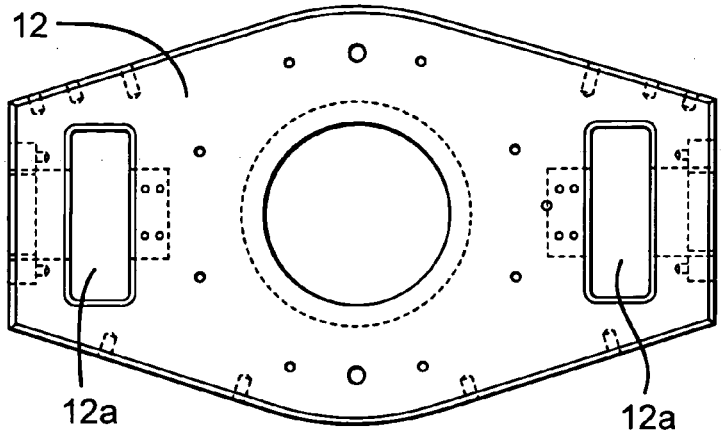
Figure 1R:
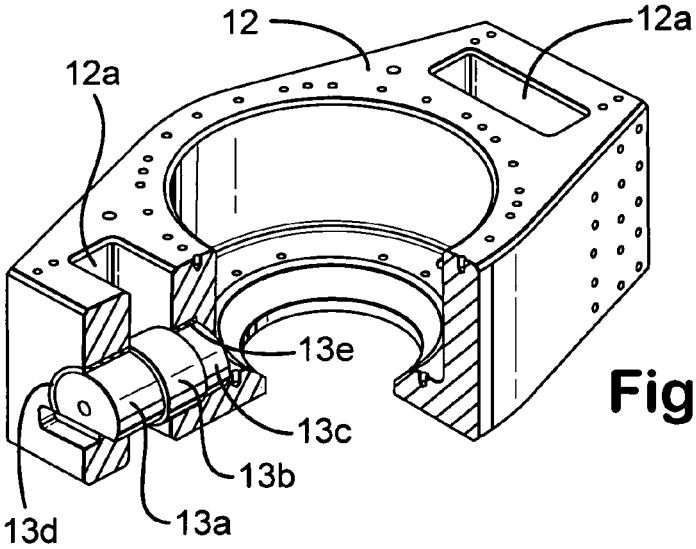
Figure 1S:
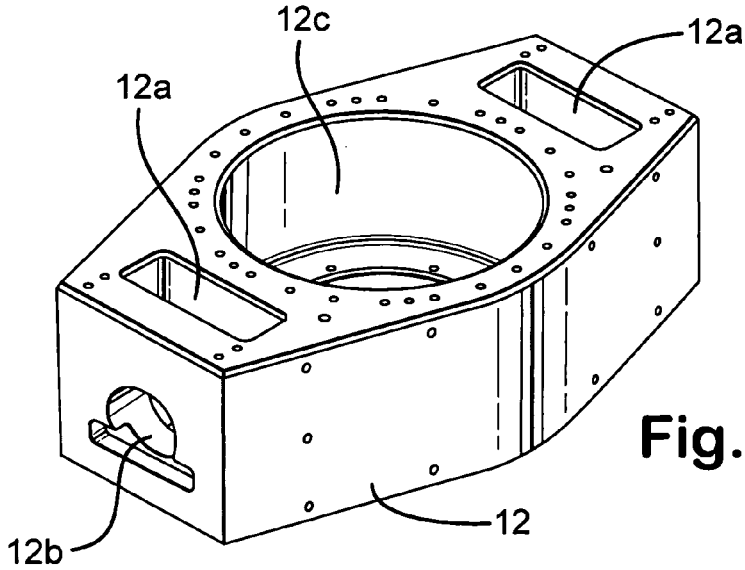

FIGS. 1N-1P show one design and embodiment for a swivel body 12 according to the present invention. FIG. 1N shows one side and end (the other side and end are like the side and end shown). The swivel body 12 has two holes 12*a* for ends of the links 14 and two holes 12*b* for the removable pins 13. The holes 12*b* may have bushings 12*e*. In one particular aspect the bushings 12*e* are phenolic bushings, but they may be made of any suitable material, including, but not limited to, brass, bronze, zinc, aluminum and composite materials. The bushings 12*e* facilitate pin 13 emplacement and removal and the bushings 12*e* are easily replaced. A channel 12*c* extends through the swivel body 12 and receives and holds a main bushing 56. As shown the pins 13 are stepped with portions 13*a*, 13*b*, 13*c* and phenolic bushings 13*d* and 13*e* may be used with the pins 13. Drain port or outlet ports 12*s*, 12*t* (plugged with removable plugs) permit lube oil flow through and permit the draining of oil from the system. Port 12*t* allows lube oil through to lubricate the lower quill stabilizer bearing via access via the load sleeve 170.

The holes 12*a* may be circular, but are shown as rectangular to inhibit turning of the links 14 in the holes. The holes may be any suitable shape to inhibit link turning.

Figure 2A:
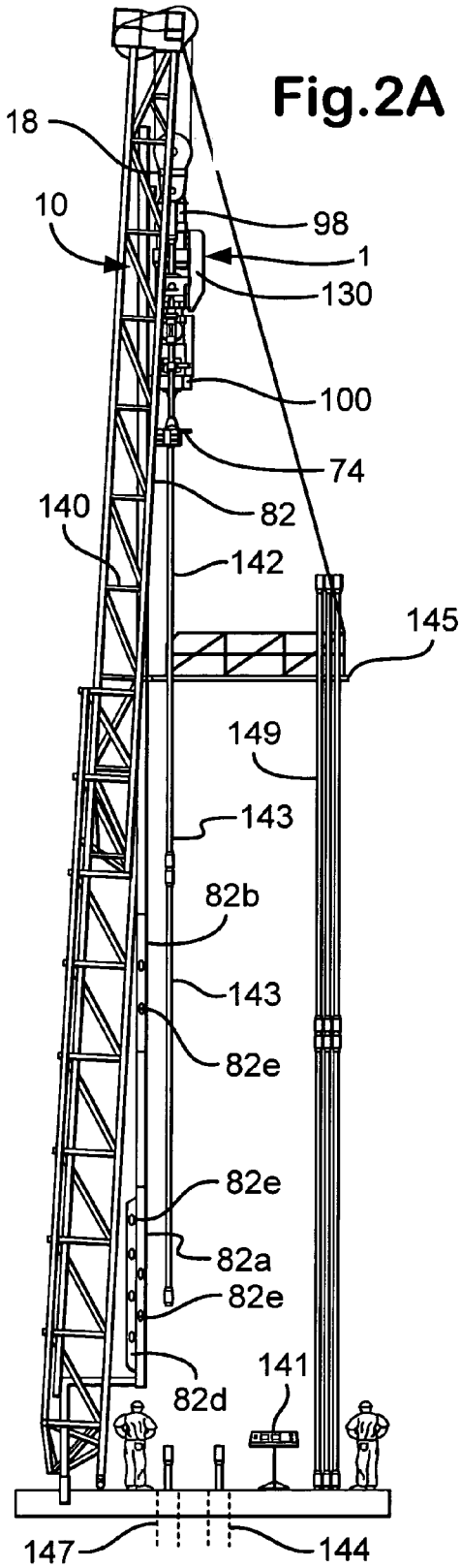
FIG. 2A is a side view of a system according to the present invention with a top drive according to the present invention.
Figure 2B:
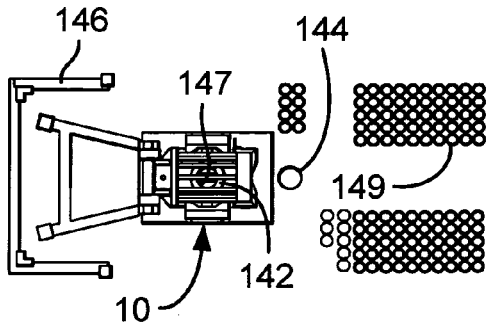
FIG. 2B is a top view of the system of FIG. 2A.
Figure 2F:
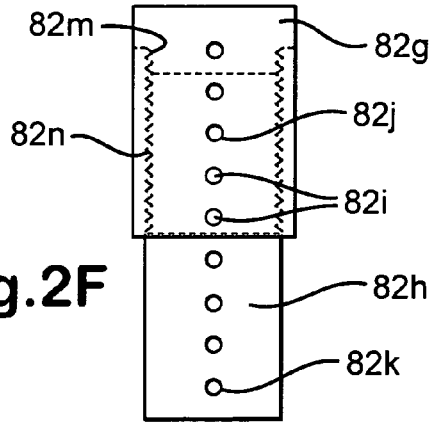
FIG. 2F is a side view of part of a beam or torque tube of the system of FIG. 2A.

FIGS. 2A and 2B illustrate one installation of a top drive system 10 according to the present invention in a derrick 140. The top drive system 10 is suspended from a block becket 18 according to the present invention which is suspended from the derrick 140 in a typical manner. Although it is within the scope of the present invention to use a standard block and hook for hooking a standard becket, in one aspect the present invention provides an integrated block becket 18 which dispenses with the common swiveling hook. As shown in FIG. 2A, the elevator 74 is supporting a tubular stand 142 which includes two pieces of drill pipe 143. The stand 142 has been moved from a monkey board 145 with multiple made-up stands 149 to a position axially aligned with a wellbore 147. A mousehole 144 may be used, e.g. to make stands. A driller controls drilling from a driller's panel 141.

Figure 2G:
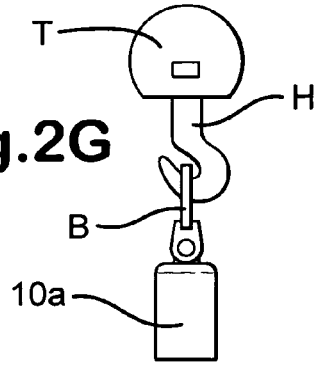
FIG. 2G is a schematic view of a system according to the present invention.

FIG. 2G shows schematically a top drive system 10*a* according to the present invention (which may be any system according to the present invention as disclosed herein, but without a block becket according to the present invention) with a travelling block T, hook H, and becket B (each of which may be a suitable known block, hook, and/or becket, respectively).

The flange 54 of the quill 50 rests on the main bearing 56, a thrust bearing, e.g. a V flat type thrust bearing which has multiple tapered rollers 57. The upper surface of the flange 54 abuts an upper thrust bearing 59 located in a suitable recess 24 of the spacer plate 22 (see e.g. FIGS. 1C, 1D, 1G, 1H). The quill 50 has an upper part 51 in fluid communication with the gooseneck 46 via a wash pipe 374. In one particular aspect the main bearing 56 is a V-type thrust bearing which accommodates eccentricity, if present, in the quill 50 and is self-cleaning.

The swivel body 12 and associated structures provide dual load paths (which is desirable for reducing maintenance requirements. Drilling loads through the quill 50 travel through the main bearing 56, through the swivel body 12, to the links 14, to the becket 16 and then to the travelling block 18 (or to a block becket 18 according to the present invention). Tripping loads (or "string loads" imposed on the system by tubulars being supported by the system) are imposed on the links 72 through the elevator 74, then onto the load collar 70 and the load sleeve 170, to the swivel body 12, to the links 14 and to the becket 16. This dual-load path allows for rotation of the system 100 whether the quill 50 is rotating or not. The tripping loads are not imposed on the quill 50, but are transferred via the tripping load path around the quill 50 through the swivel body 12 and links 14.

Figures 28A, 28B:
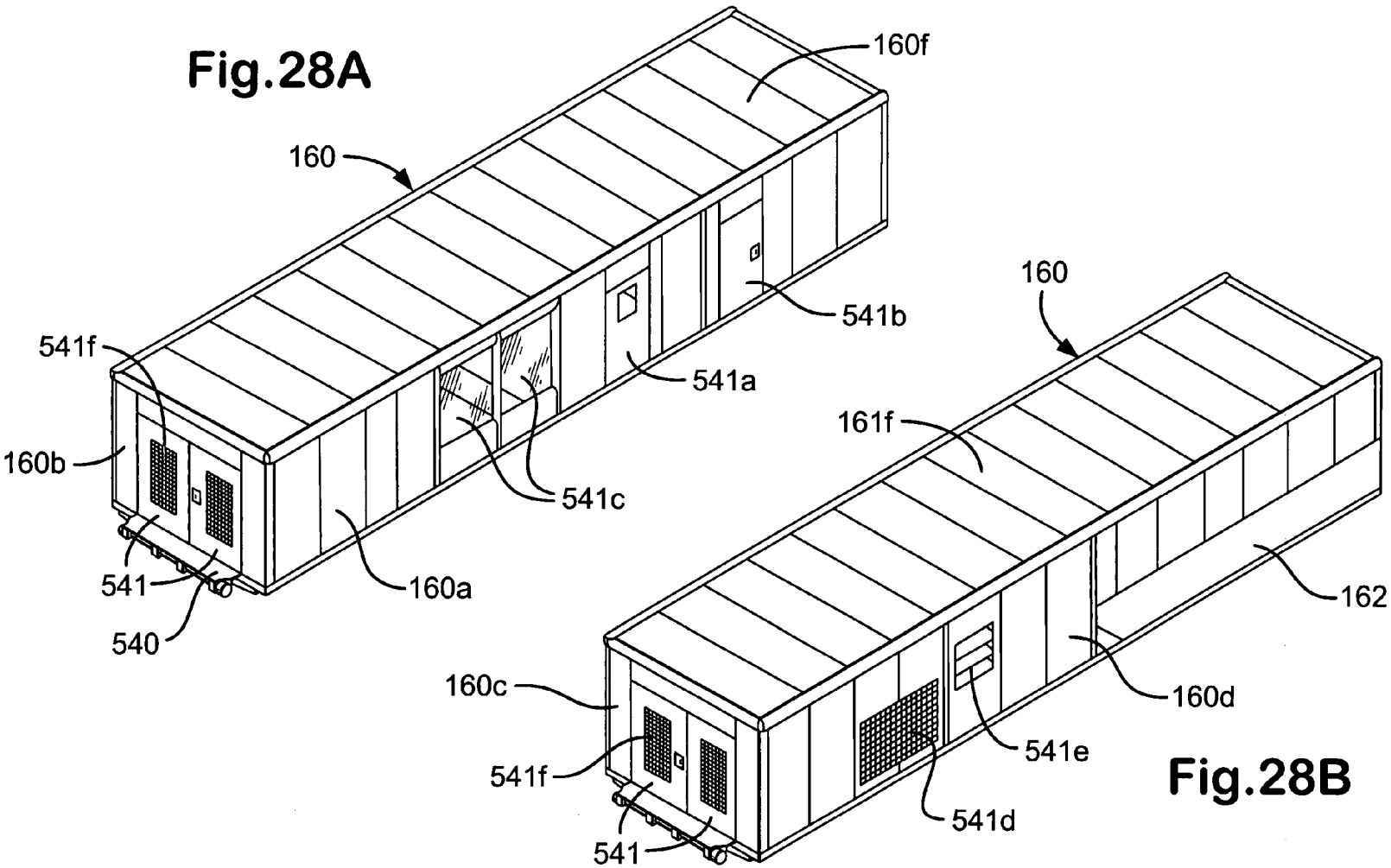
FIGS. 28A and 28B are perspective views of a building according to the present invention for use, e.g., with a system as in FIG. 1A.
Figure 28C:
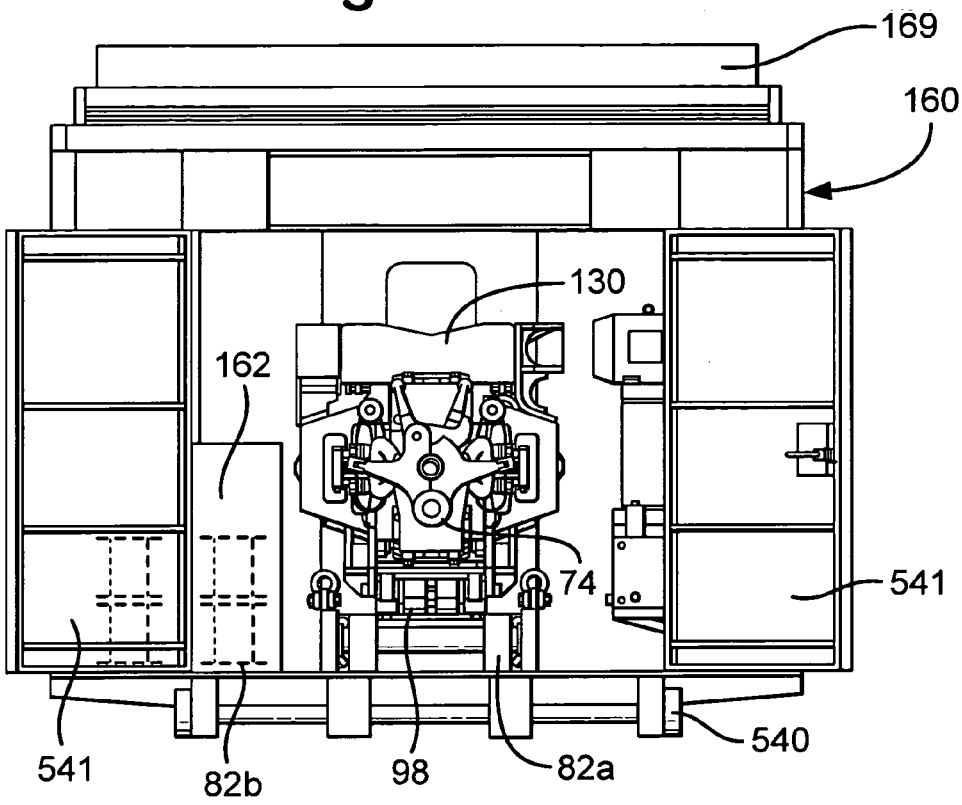
FIG. 28C is an end view of the building of FIG. 28A.
Figure 28E:
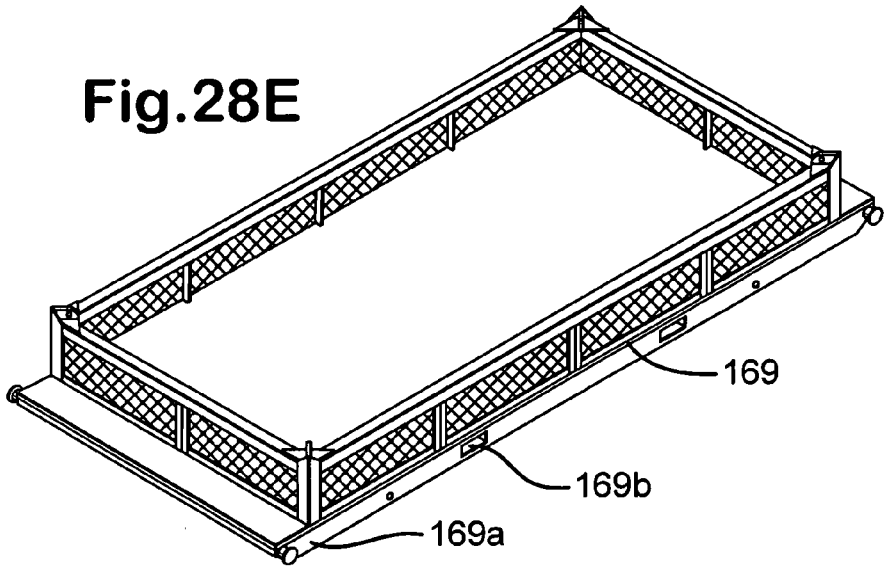
FIG. 28E is a perspective view of a carrier according to the present invention useful with the building of FIG. 28A.
Figure 28D:
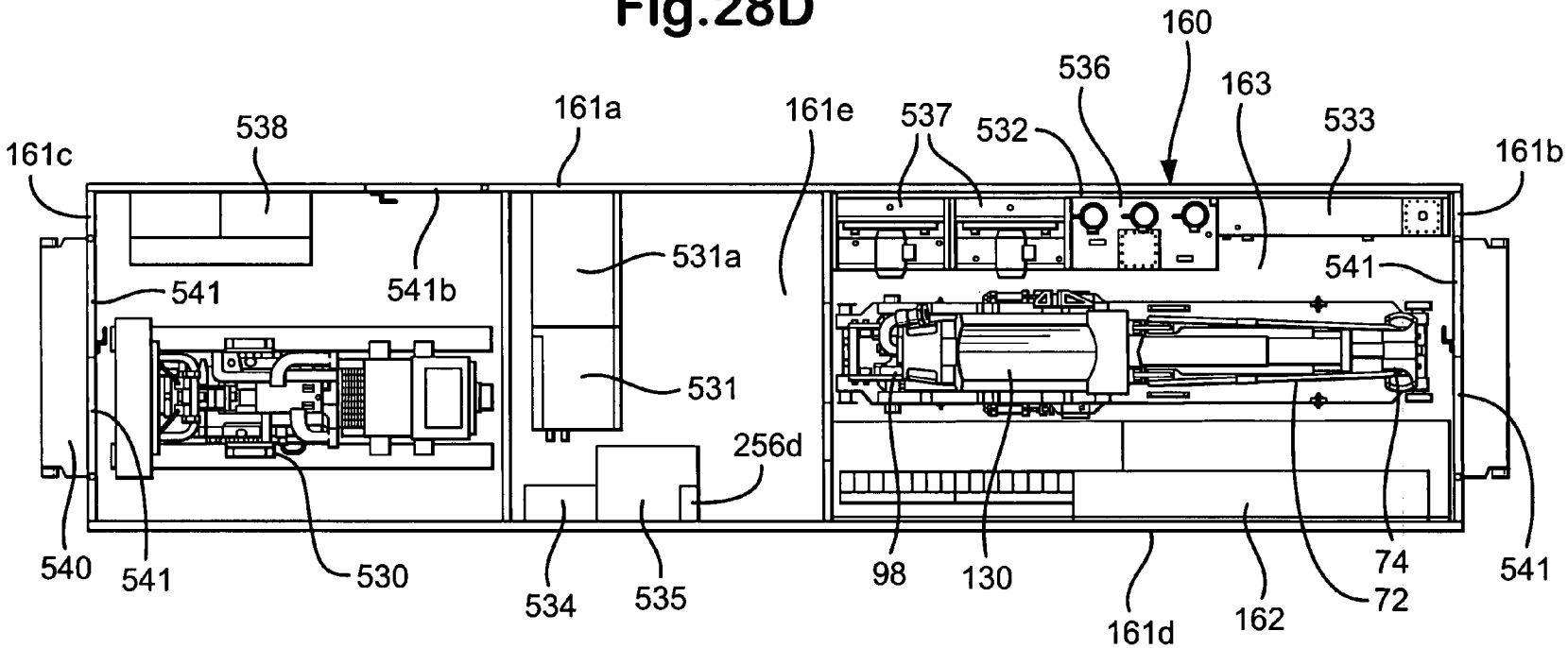
FIG. 28D is a top view (roof removed) of the building of FIG. 28A.

In one particular aspect the permanent magnet motor 30 is a Model 2600 TERA TORQ (™) motor commercially available from Comprehensive Power Ltd. which is a liquid-cooled AC permanent magnet hollow bore motor which generates 700 HP and operates at a maximum speed of 2400 RPM. The motor has axial bearings and a splined output shaft and is designed to hold drill string torque at full stall (at "full stall" motor RPM's are zero) or while engaged in jarring (e.g. using shock loads for various purposes). A central hollow bore 30*a* extends through the motor 30 from top to bottom through which fluid, e.g. drilling fluid, can flow through the motor. In one particular aspect such a motor is supplied with a Variable Frequency Drive control system (in one aspect, drive system 531, FIG. 28D) which is a liquid-cooled modular electronic unit with modules that can be changed in about five minutes. Such a system can translate generator horsepower at over 90% efficiency and can run in temperatures of −40° C. to 60° C. and in high (e.g. up to 100%) humidity.

In one particular aspect the gear system 20 includes a single speed planetary gear reduction system with gear combinations providing a 9.25:1 ratio (or a 12:1 ratio) and with a liquid-cooled gear box which is fully lubricated down to 0 RPM. The system has a splined input shaft 26 for mating with the splined motor output shaft 32 for transmitting power to the quill 50.

The compensator system 110 permits a soft landing for a tubular when the top drive is lowered to stab the tubular into a connection.

In one particular aspect the mud saver system 90 is a commercially available double ball internal blowout preventer system from R Folk Ventures of Calgary, Canada which has two internal blowout preventers and which is rated to 15,000 psi. An upper valve is hydraulically actuated by an actuator mounted on the valve and a lower valve is manually opened and closed. Alternatively, a Hi-Kalibre mud saver system (commercially available) can be used instead of this mud saver system.

FIGS. 4A-4D show, among other things, the interconnection of the motor 30 and gear system 20 and the respective position of these items, the bonnet 44, the brake system 40, the spacer plate 22, the swivel body 12, the quill 50, and the load sleeve 170. Within the lower part of the bonnet 44 are three caliper disc brakes 180 (e.g. commercially available systems) which act on a brake disc 183 (see FIG. 10B) which is secured to a brake hub 41 (see FIG. 10A) secured to the motor 30. Shims preload the bearing 59, a pre-load that does not need to be re-set due to a shoulder structure of the spacer plate 22.

Figure 4A:
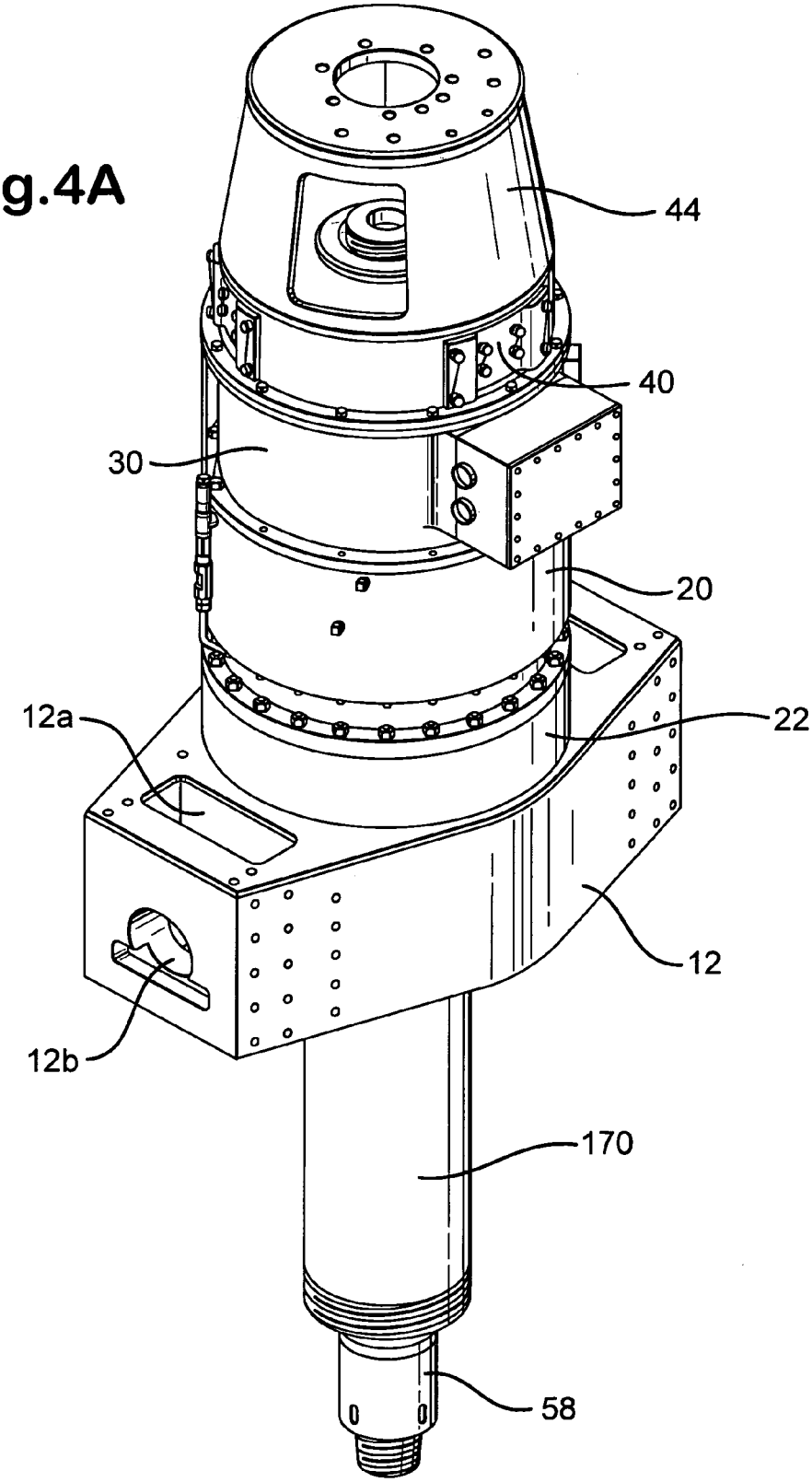
FIG. 4A is a perspective view of part of the system of FIG. 1A.
Figure 4B:
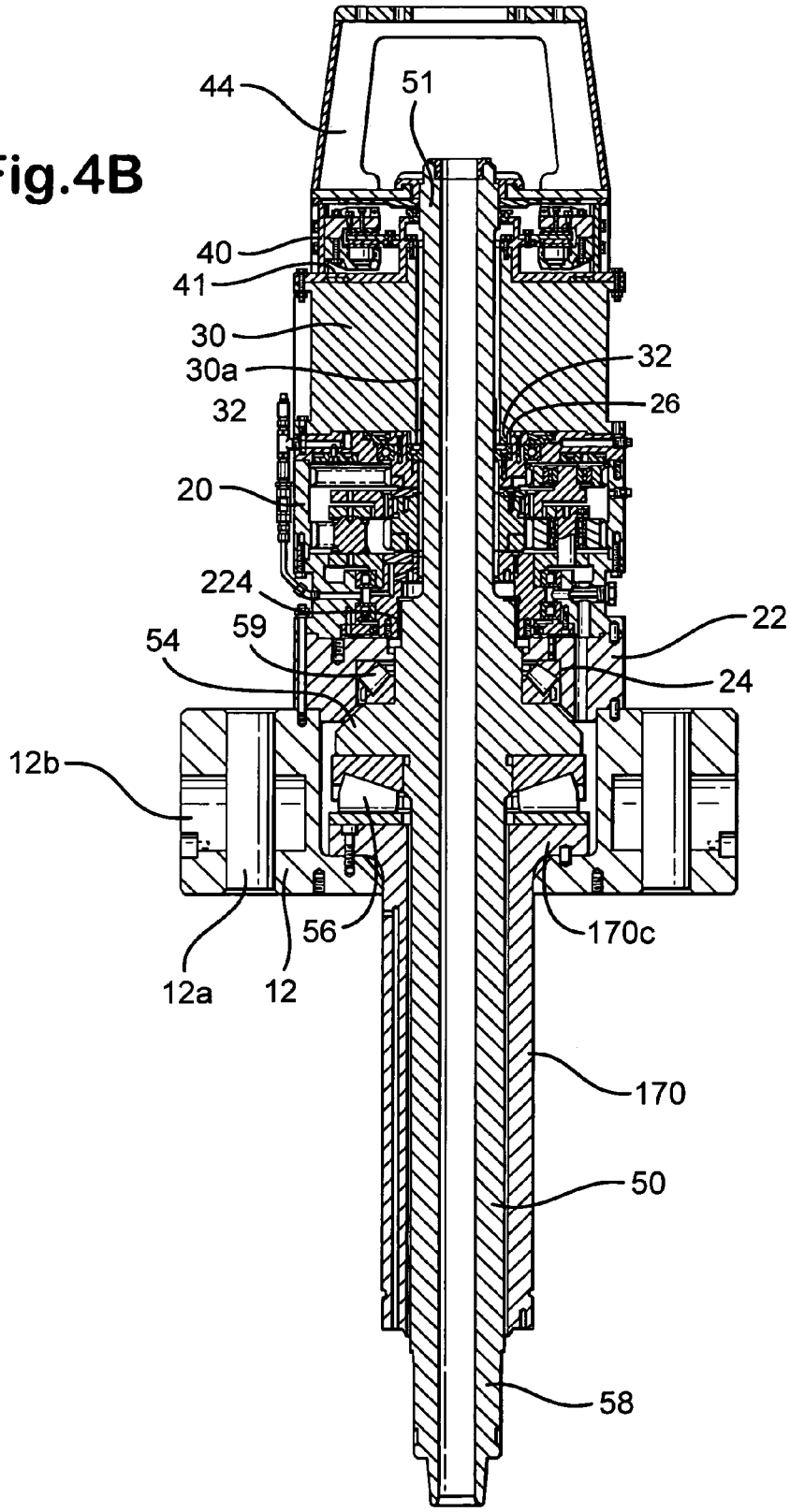
FIG. 4B is a cross-section view of what is shown in FIG. 4A.
Figure 4C:
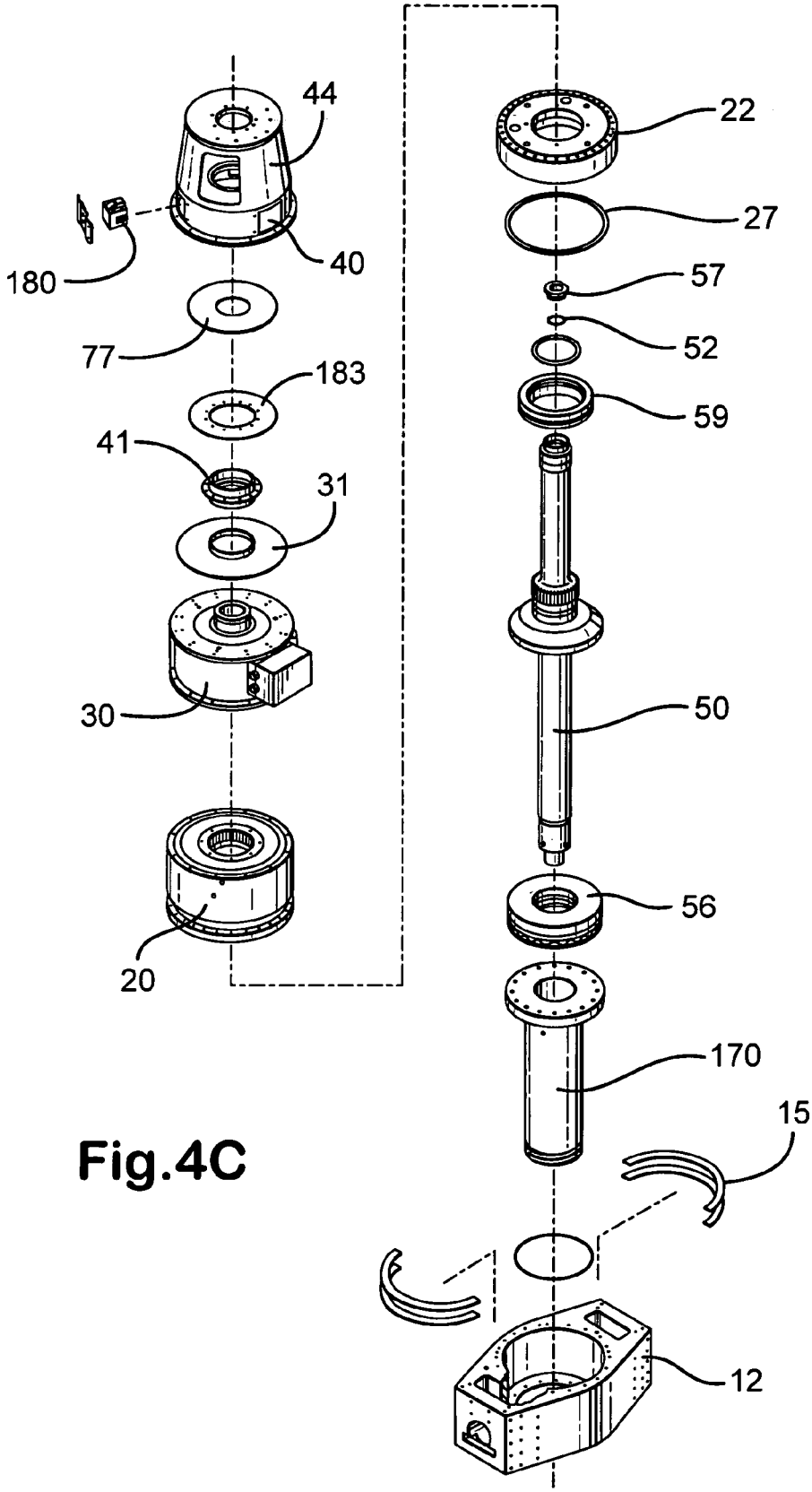
FIG. 4C is an exploded view of part of the system of FIG. 1A including parts shown in FIG. 4A.
Figure 4D:
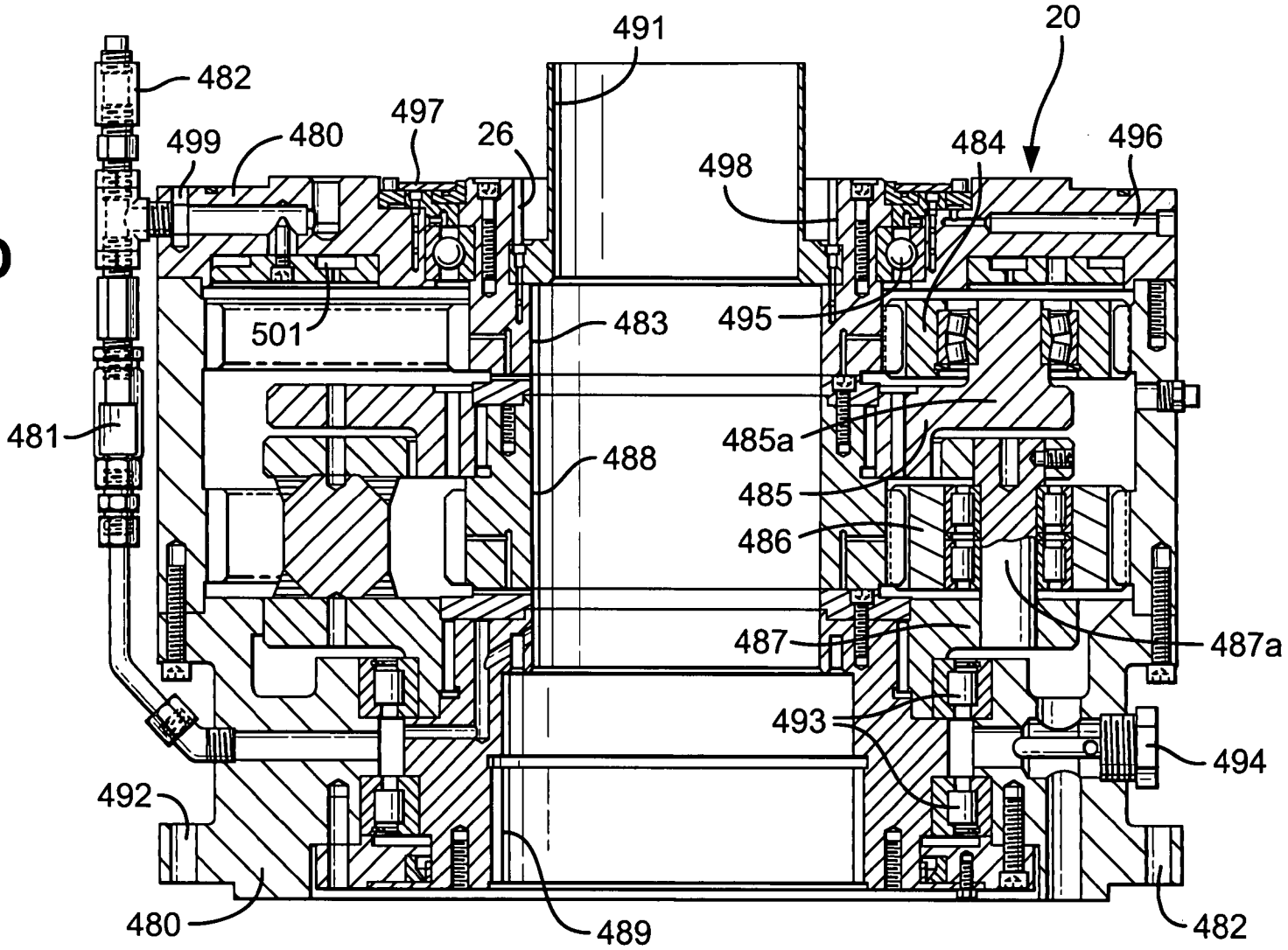
FIG. 4D is an enlargement of a gear system according to the present invention as shown in FIG. 4B.
Figure 6A:
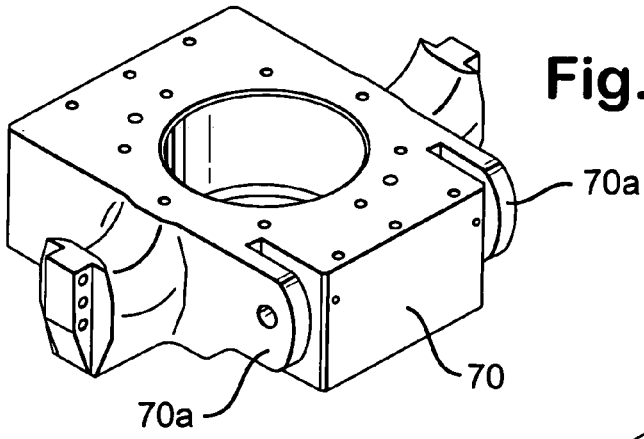
FIG. 6A is a top perspective view of a load collar of the system of FIG. 1A.
Figure 6B:
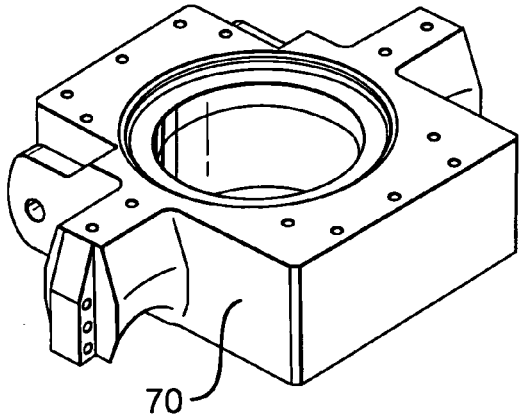
FIG. 6B is a bottom perspective view of the load collar of FIG. 6A.
Figure 6C:
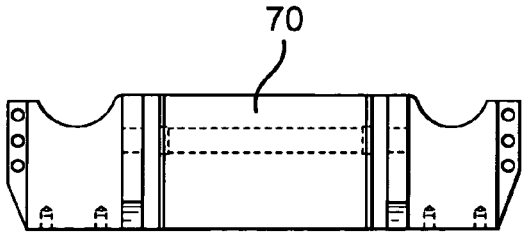
FIG. 6C is a front view of the load collar of FIG. 6A.
Figure 6D:
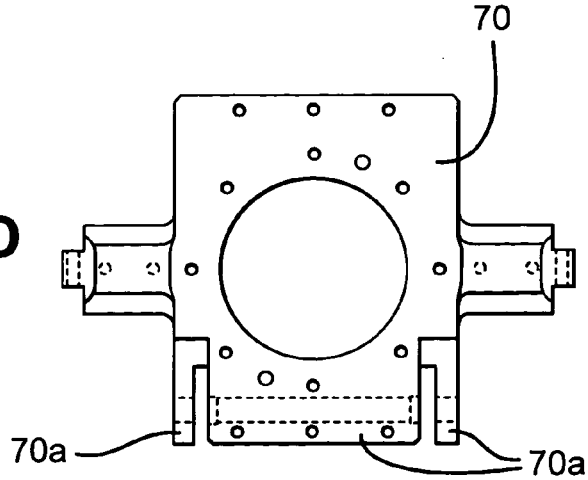
FIG. 6D is a top view of the load collar of FIG. 6A.

FIG. 4D shows a gear system 20 which has a housing 480 from which extends a sight glass apparatus 481 for checking fluid level in the system 20 which includes a breather apparatus 482 that allows atmospheric pressure above the lube system to encourage downward gravitational flow. An input spline 26 drivingly meshes with the correspondingly splined output shaft 32. A first sun gear 483 rotates, e.g. at 2400 rpm and three planet gears 484 on stubs 485*a* of an upper carrier 485 rotate around the first sun gear 483. Five lower planet gears 486 rotatably mounted on stubs 487*a* of a lower carrier 487 encircle a second sun gear 488. An output spline 489 drivingly meshes with the splined portion 52 of the quill. In one aspect the output spline rotates at 259 rpm when the first sun gear 483 rotates at 2400 rpm. An optional seal 491 seals an interface between the gear system 20 and the motor 30. Bolts through holes 492 connect the system 20 to the spacer plate 22. The first sun gear 483, driven by the motor 30, drives the planet gears 484 which drive the upper carrier 485, which rotates the second sun gear 488 which drives the five lower planet gears 486, which drive the lower carrier 487, which drives the output spline 489. The output spline 489 rides on bearings 493. Magnetic plugs 494 (one shown) collect metal debris. An upper bearing 495 is lubricated through a port 496 and a top mechanical seal 497 (which prevents oil from going up into the motor 3D) is located in a top member 498 connected to and rotatable with the sun gear 483. Bolts in bolt holes 499 (one shown; twenty four bolts used in one aspect) connect the gear system 20 to the motor 30. An oil path 501 allows oil to lubricate the planet gears and their bearings.

Figure 7A:
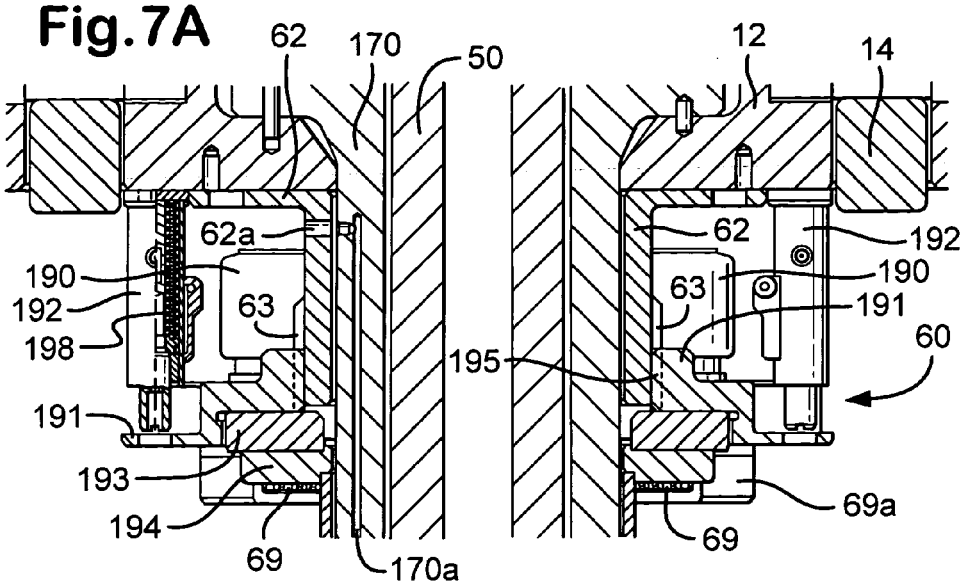
FIG. 7A is a cross-section view of parts of a locking mechanism for the system of FIG. 1A.
Figure 7B:
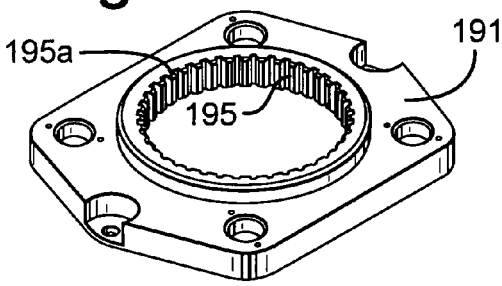
FIGS. 7B-7F are perspective views of parts of the mechanism of FIG. 7A.
Figure 7C:
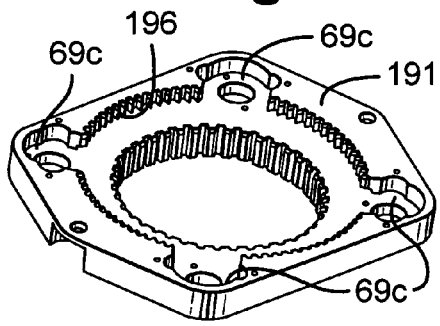
Figure 7F:
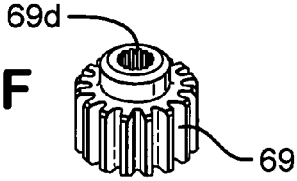
Figure 7D:
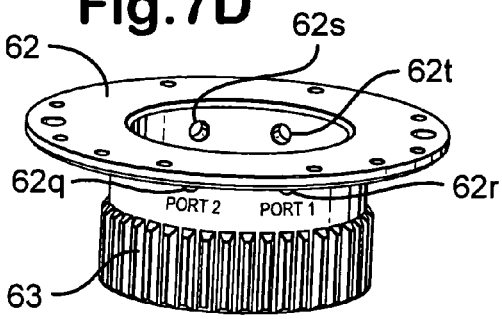
Figure 7E:
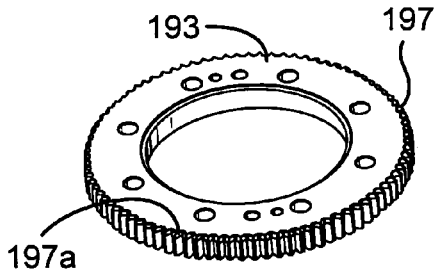

The locking mechanism 60, described in detail below, is bolted beneath the swivel body 12, supported on the load collar 70, and provides releasable locking of the system 100 in a desired position. In one particular aspect the system 100 is operable throughout a full 360° in both directions, at about 4 RPM. In one particular aspect the system 100 is driven by four low speed high-torque motors 190 which are fixed to a movable toothed lock plate 191 which is suspended by two hydraulic cylinders 192 which selectively move the lock plate 191 up and down (e.g. in one aspect with a range of motion of about 1.75 inches) to engage and disengage a rotate gear 193 whose rotation by pinion gears 69 located in pinion gear recesses 69*c* (driven by the motors 190) results in a rotation of the system 100. Shafts of the motors 190 are in channels 69*d* of the pinion gears 69. The rotate gear 193 is bolted to the top of a gear collar 194 which itself is bolted on top of the load collar 70. A lock guide 62 (FIG. 7D), bolted to and beneath the swivel body 12, has a splined portion 63 which is always in mating engagement with a corresponding splined portion 195 of the lock plate 191, so that lowering of the lock plate 191 results in engagement of the rotate gear 193 with the locking plate 191 and thus in locking of the system 100 preventing its rotation when the hydraulic cylinders 192 have lowered the lock plate 191 so that its inner teeth 196 engage teeth 197 of the rotate gear 193. The pinion gears 69 (FIG. 7F) are in contact with the rotate gear 193 whether the system is locked or not and rotation of the pinion gears 69 by the motors 190 results in rotation of the system 100. FIG. 7A shows the lock engaged in a locked position, i.e. the system 100 cannot rotate. When the system is unlocked, the pinion gears 69, turned by the motors 190, turn the rotate gear 193, e.g. to reposition the system 100 or the elevator 74. In the locked position the quill 50 can still rotate, but the system 100 cannot. Optionally, to facilitate tooth engagement, the teeth 195 can have tapered lead-ins 195*a* and the teeth 197 can have tapered lead-ins 197*a*. These profiles insure synchronization between the gear 196 and the rotate gear 193. The gear 196 has teeth for the great majority of its circumference providing more structure and more strength to hold the system 100 and the link-tilt apparatus and prevent rotation of the system 100 in a locked position. Cups 69*a* maintain the pinion gears 69 in recesses 69*c*. The lock guide 62 has four ports 62*q*-62*t* each aligned with a channel 170*a* of the load sleeve 170 so that hydraulic fluid from the upper hydraulic manifold 452 can flow to and through the load sleeve 170 to the rotating head 80. Suitable hoses and/or tubing conduct fluid from the upper hydraulic manifold 452 to the lock guide ports 62*q*-62*t*.

The gear collar 194 (FIGS. 5A, 5B) is bolted on top of the load collar 70 with bolts 194*a*. Grease to lubricate the wear sleeve 62 and the load collar bearing 67 is introduced into grease ports 194*d*. When the lock plate 191 has been lowered to engage the rotate gear 193 to prevent rotation of the system 100, the quill 50 can still rotate. Optionally the hydraulic cylinders 192 can have springs and/or spring washers 198 to provide a fail safe lock, e.g. when there is a loss of power to the hydraulic cylinders 192. Depending on the size, configuration, and disposition of interengaging teeth, the system 100 can be locked at desired circumferential increments. In one particular aspect, e.g. with components as shown in FIGS. 7A-7E, the system 100 can be locked every 4 degrees. Such a range of movement—a full 360°—allows the lower pipe handling equipment to thread tubulars together.

A rotating head 80 provides hydraulic power to the rotatable system 100. This hydraulic power operates a generator 240 mounted in a lower electrical junction box 250 and valves 260 (see, e.g. FIG. 8A). In one aspect the generator 240 is a mini generator, e.g., but not limited to, a commercially available mini generator set from Comprehensive Power Ltd. of Boston, Mass. In one aspect the junction box 250 is a zone 0 rated junction box. The generator 240 provides electric power to directional valves 260 on the lower hydraulic manifold 400 mounted on an upper leg of the system 100. The generator 240 is powered by hydraulic fluid from the rotating head which powers the generator. Also, optionally, the system includes digital signal processor card systems 256*a*, 256*b*, 256*c* (lower electrical junction box 250), 256*d*, each with its own RF antenna. A DSP system 256*a* (shown schematically in FIG. 2A), is located in the driller's panel 141; a DSP system 256*b*, is on the rear guard 454 in the upper electrical box 450; and a DSP system is in the lower electrical junction box 250 on a lower leg of the system 100; and/or a DSP system 256*d* in the building 160. These DSP systems provide communication between the top drivers components [e.g. the mud saver system 90, extension system 98, motor 30, system 100, elevator 74, (when powered), brake system 40, lock system 60] and the driller; and, in one aspect, with personnel in the building 160.

Figure 8A:
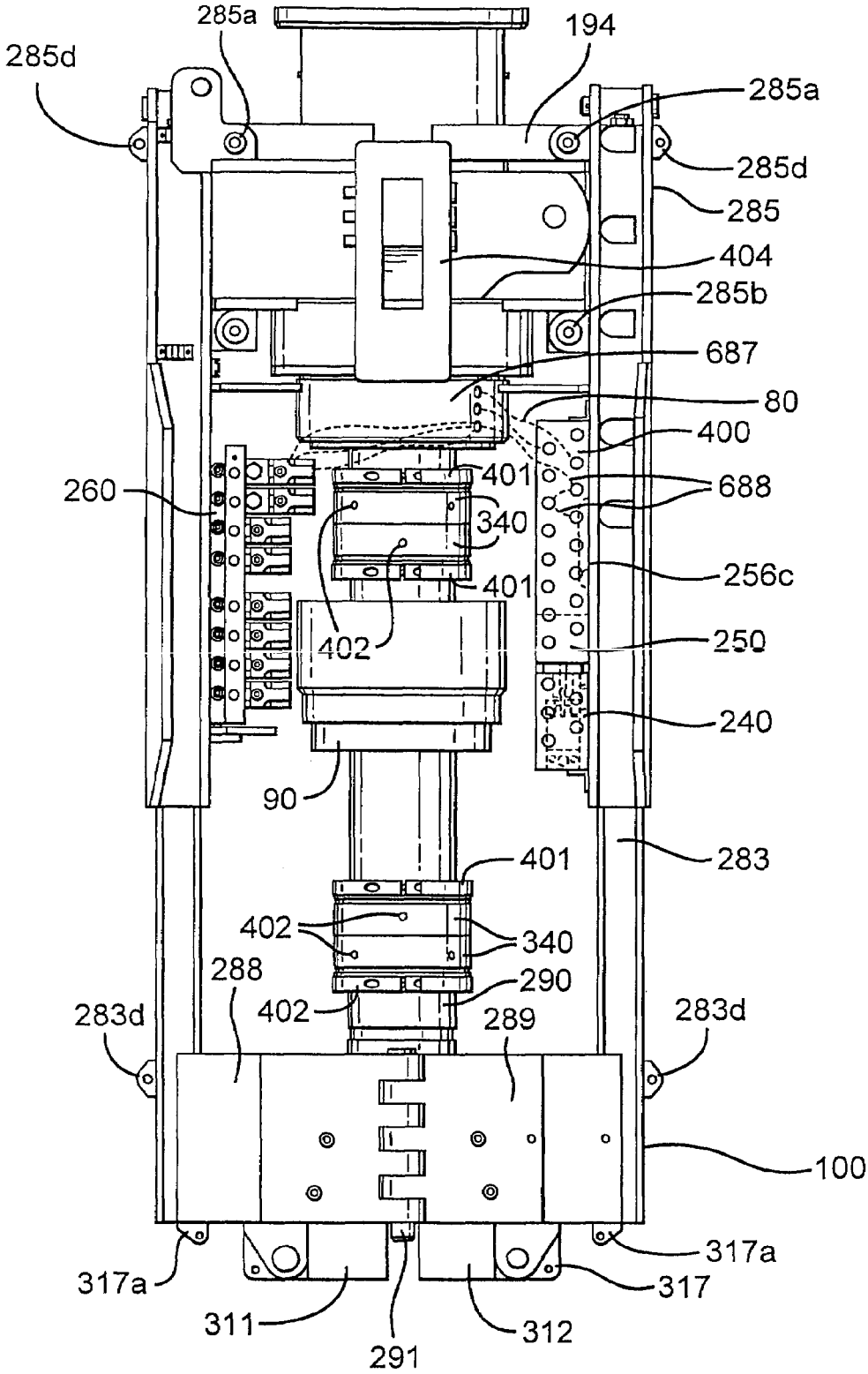
FIG. 8A is a front view of clamping apparatus of the system of FIG. 1A.
Figure 8B:
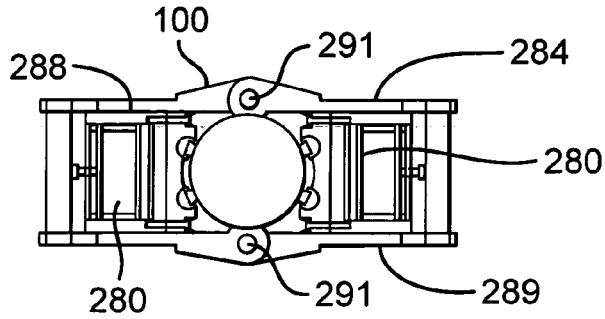
FIG. 8B is a top cross-section view of the apparatus of FIG. 8A.
Figure 8C:
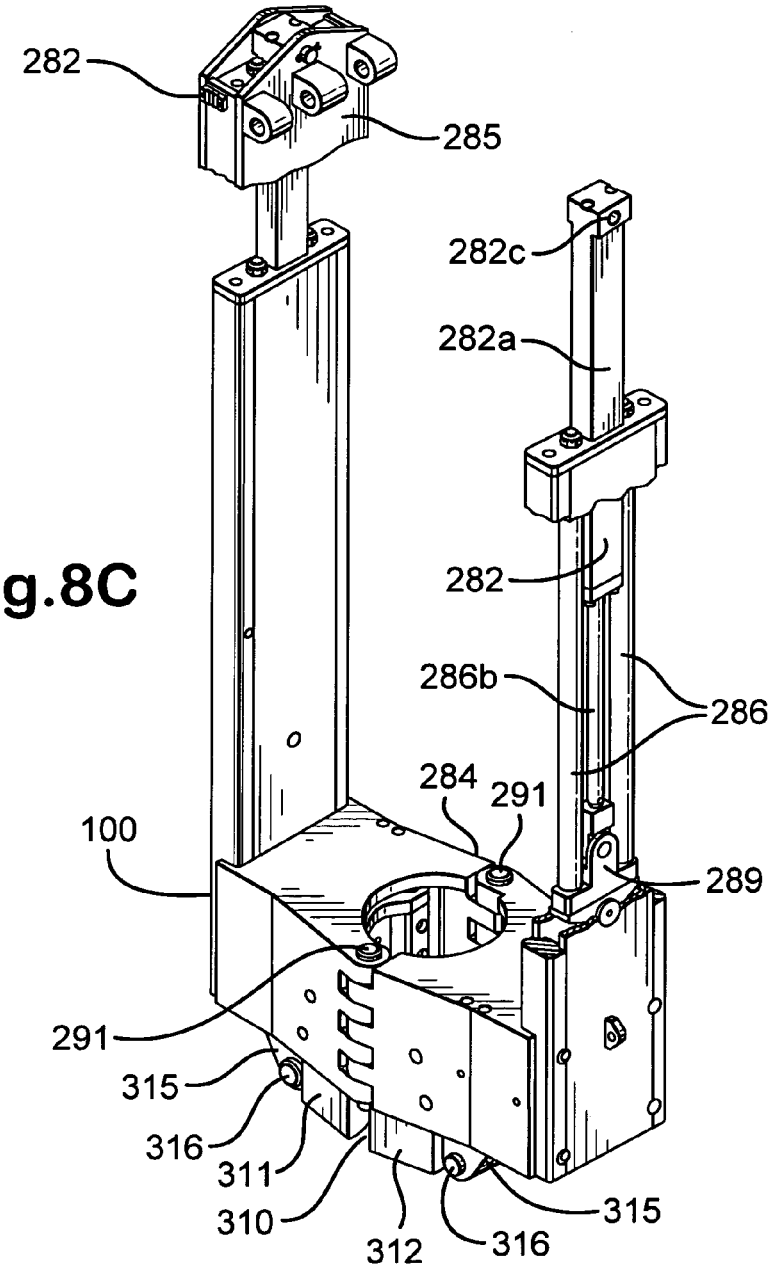
FIG. 8C is a perspective view, partially cutaway, of the apparatus of FIG. 8A.
Figure 8D:
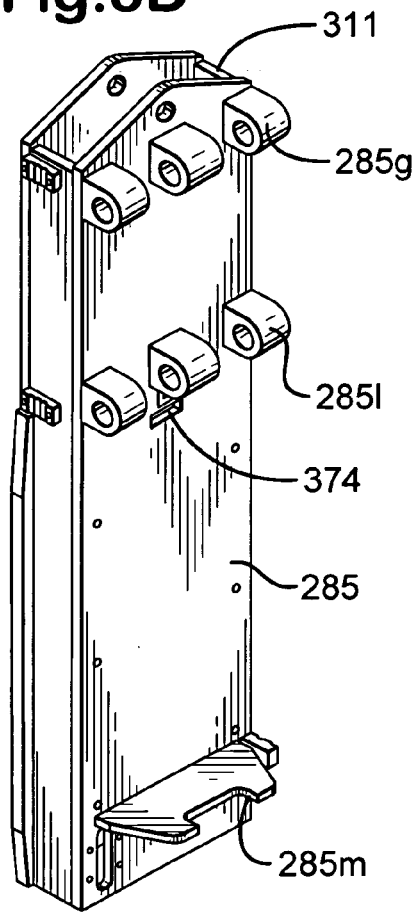
FIG. 8D is a perspective view of an upper leg of the apparatus of FIG. 8A.
Figure 8E:
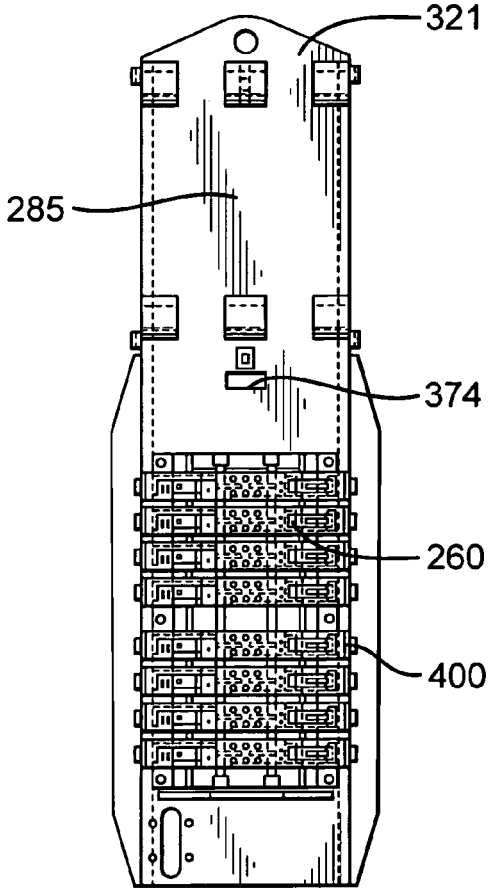
FIG. 8E is a front view of the leg of FIG. 8D.
Figure 8F:
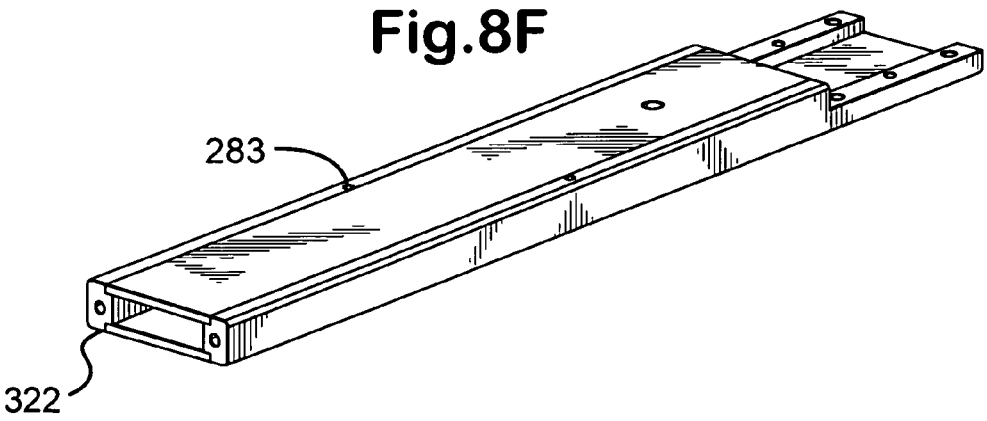
FIG. 8F is a perspective view of an inner leg of the apparatus of FIG. 8A.
Figure 8G:
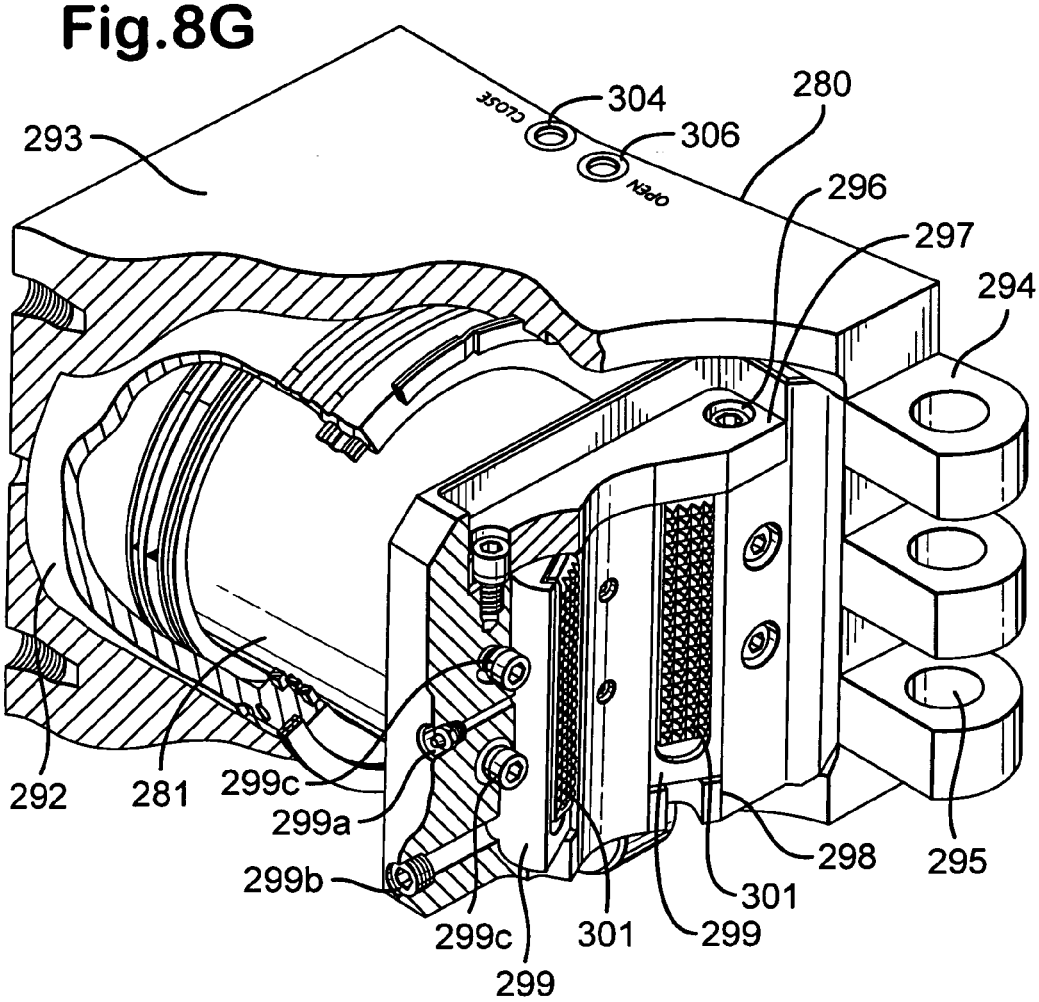
FIG. 8G is a perspective view, partially cutaway, of clamping apparatus of the apparatus of FIG. 8A.
Figure 8H:
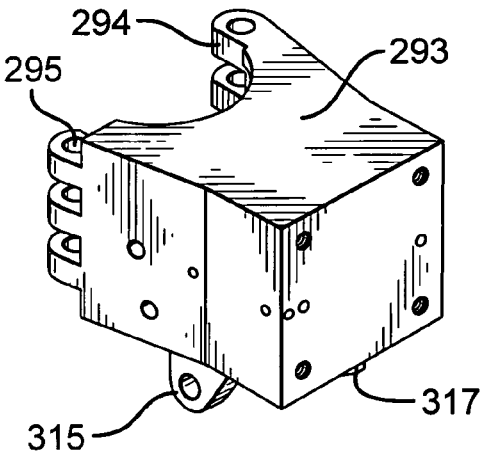
FIG. 8H is a perspective view of part of the apparatus of FIG. 8G.
Figure 8I:
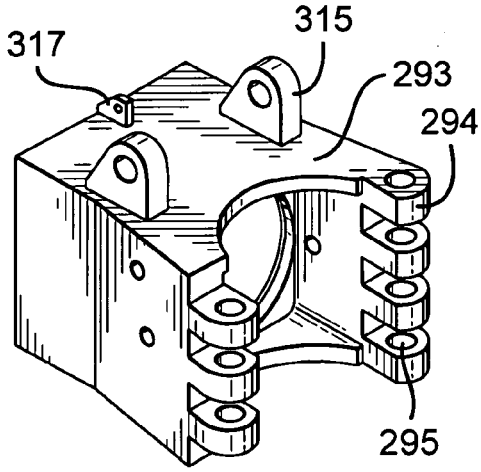
FIG. 8I is a perspective view of part of the apparatus of FIG. 8G.
Figure 8J:
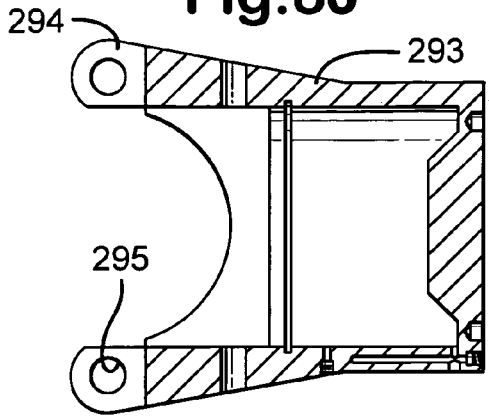
FIG. 8J is a top cross-section view of the apparatus of FIG. 8H.
Figure 8K:
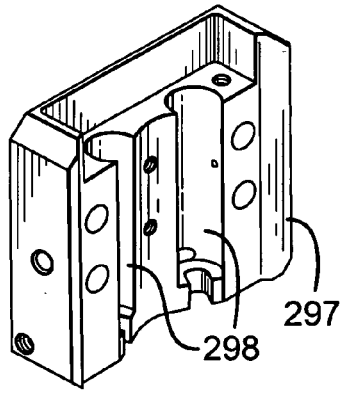
FIG. 8K is a perspective view of a die holder of the apparatus of FIG. 8G.
Figure 8L:
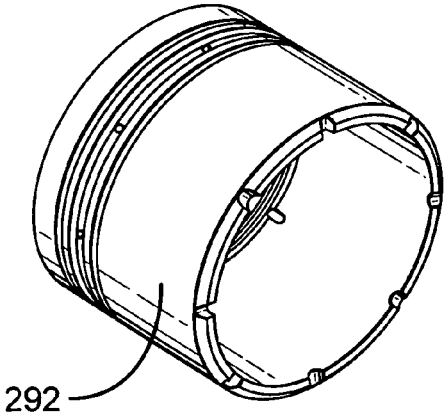
FIG. 8L is a perspective view of a liner of the apparatus of FIG. 8G.
Figure 8M:
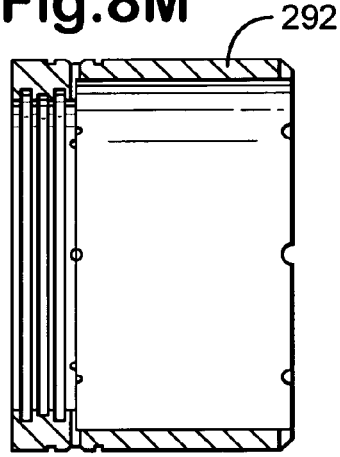
FIG. 8M is a cross-section view of the liner of FIG. 8L.
Figure 8N:
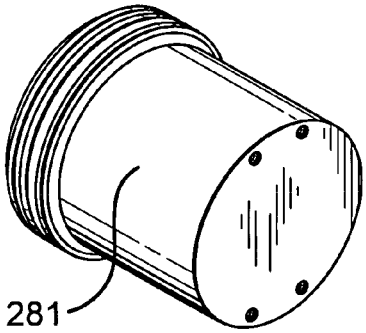
Figure 8O:
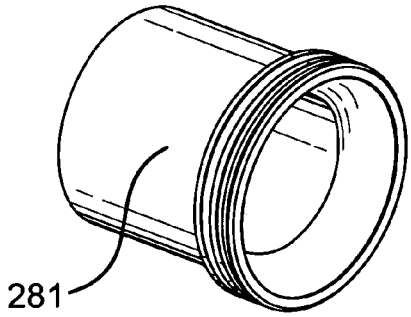

FIGS. 8A-8C illustrate one embodiment of the system 100 for selectively clamping tubulars, e.g. pipe or casing. Top ends of the outer legs 285 of the system 100 are connected to connection structures 194*b* and 194*c* of the gear collar 194 with pins 285*a* and with pins 285*b* to connection structures 70*a* of the load collar 70; and the bottom ends of the inner legs 283 are bolted to a body 284. Each leg has two parts, an inner (lower) part 283 and an outer (upper) part 285. The inner parts 283 move within the outer parts 285 to provide a telescoping action that permits upward and downward motion of the system 100 (e.g. in one aspect with an up/down travel range of 28.5"). A spring or springs 286 within each leg on a spring mount 289 so that when breaking a connection the springs compensate for thread travel; and when making a connection the vacuum in assemblies 282 compensates for upward travel of the threads. In one particular aspect (see FIG. 8C) there is a stack of belleville springs 286 in each leg mounted on rods 289*a* of the spring mount 289 which is connected to the inner leg.

The body 284 has dual opposed halves 288, 289 pinned together with removable pins 291 so that the body 284 can be opened from either side with the structure on the unopened side serving as a hinge. Also, both halves can be unpinned (removing the pins 291) permitting the legs to be moved apart (following removal of the pins 285*b*) allowing access to items on the legs (e.g. the lower electrical junction box 250 and the lower hydraulic manifold 400) and to other components of the system. In certain aspects the two halves are identical facilitating replacement and minimizing required inventory. Each inner leg has a piston/cylinder assembly 282 which receives hydraulic power fluid via an inlet 282*c* from the lower hydraulic manifold 400. Each assembly 282 has a hollow cylinder 282*a* and an extensible rod 282*b* which provides the range of movement for the legs.

Two clamping apparatuses 280 (see FIGS. 8G-8Q) disposed in the body 284 selectively and releasably clamp a tubular to be gripped by the system 100. Each clamping apparatus 280 has a piston 281 movably disposed within a liner 292 which itself is mounted within a mount 293. Each mount 293 has a plurality of ears 294 with holes 295 therethrough for receiving the pins 291. Connected to each piston 281 with bolts 299*c* (in holes 299*d* of the pistons 281) is a die holder 297 with recesses 298 for releasably receiving and holding die mounts 299 with dies 301. In one aspect the liner 292 is made of steel or other suitably hard material and is replaceable. Lubricating grease is applied through grease fittings 299*a* (one shown) and pins 299*b* (one shown) limit rotation of the die holders 297. The gear collar 194 is connected to the legs 285 with connectors 285*g* and the load collar is connected to the legs 285 with connectors 285*l*.

Hydraulic fluid under pressure from the rotating head 80 supplied from the lower hydraulic manifold 400 at a rear 302 of each piston 281 flows into a "CLOSE" port 304 to clamp a tubular. To release a tubular, hydraulic fluid is supplied to an "OPEN" port 306. Dotted lines 687 indicate the lines between the rotating head 80 and the lower hydraulic manifold 400. One of the lines 687 may be a spare line which is plugged shut until needed. Power cables 688 convey electrical power to the lower electrical junction box 250. Gland connectors may be used for connections. This fluid pushes against a piston opening surface 307 to move the piston 281 and its associated die apparatus away from a tubular resulting in unclamping and release of the tubular. Fluid enters (or leaves) the ports 304, 306 and fills behind the pistons to clamp onto a tubular or other item. As fluid enters one port, fluid leaves the other port. Also, in one aspect fluid flows to (and from) both pistons simultaneously for balanced clamping and unclamping. Directional valves 260 in the lower hydraulic manifold 400 control flow to and from the ports 304, 306. A recess 285*m* receives and holds a corresponding projection member (not shown) of the mud saver system 90 to insure that the mud saver system 90 rotates with the system 100.

In one aspect the system 100 develops sufficient torque to break connections involving the quill 50 and the mud saver 90 and the mud saver 90 and a saver sub 290; and to make/break tubular connections between the saver sub 290 and tubulars. In one particular aspect a system 100 as shown in FIGS. 1C and 8A has a downward thread feed of about 6" against the springs 286; an upward range of movement of about 7" against an hydraulic cylinder vacuum in the cylinders 282; and an up-down travel range when unclamped of about 28.5". By using two spaced-apart legs instead of a single support to support the system 100, relatively thinner legs may be used to accommodate the same amount of torque as a prior art single-leg support and, with the present invention, twisting is inhibited and decreased as compared to a single-leg support (e.g. in certain aspects a single leg of a single-leg prior art system is more than twice the thickness of each of the two legs according to the present invention), but the two legs are sufficient to handle the makeup/breakout torques produced (e.g. up to 60,000 ft. lbs in some embodiments). Providing relatively thinner legs also means that the overall area occupied by the system 100 is reduced, thus permitting the system 100 in rotation to require a smaller compact space for operation. By pulling both pins 291, the halves of the gripper system can be separated and moved apart from each other. The range of clamping apparatus up/down movement with corresponding clamping locations allows the system 100 to clamp onto the mud saver system 90, or the saver sub 290 to assist in the breaking of the quill/mud-saver-system connection, the mud-saver-system/saver sub connection or a connection between a tubular and the saver sub.

In one particular aspect a system 100 as shown in FIGS. 1C and 8A with a die holder 297 that is about 1.25 inches wide and dies 301 measuring 5¾" long×⅝" thick, a range of pipe between 3.5" (e.g. tool joints) and 9.5" (e.g. collars) can be handled. In one particular aspect the die mounts 299 are swivel die mounts which facilitate the system's ability to accommodate a range of tubular diameters; but it is within the scope of this invention to use non-swivelling die mounts.

A pipe guide 310 is connected to the bottom of the body 284. In one aspect the pipe guide 310 includes two halves 311 (see FIGS. 8R, 8S) with tapered surfaces 312 to facilitate tubular entry into the system 100. Pins through holes 313 in the halves 311 and through holes 316 in ears 315 of the mounts 293 releasably secure the halves 311 to the mounts 293. Safety chains 314 releasably connect to connectors 317 on the mounts 293 and to connectors 317*a* on the body 284 prevent the system 100 from falling if it is inadvertently released from the legs, grabbed, pulled on, or pulled up with the top drive. Legs 283, 285 may be chained together at connections 283*d*, 285*d*.

It is within the scope of this invention for the legs 282 to have a circular cross-sectional shape. In one aspect, as shown in FIGS. 8A-8F, the inner legs 283 have a rectangular cross-sectional shape 322 which prevents them from rotating within correspondingly shaped openings 321 in the outer legs 285. This non-rotation feature is desirable because it inhibits twisting of the legs and, thereby twisting of the system 100. It is within the scope of the present invention to achieve this non-rotation function with legs of non-circular cross-section, e.g. inner legs with non-circular shapes 323-329 as illustrated in FIG. 8T.

Figures 9A, 9B, 9C:
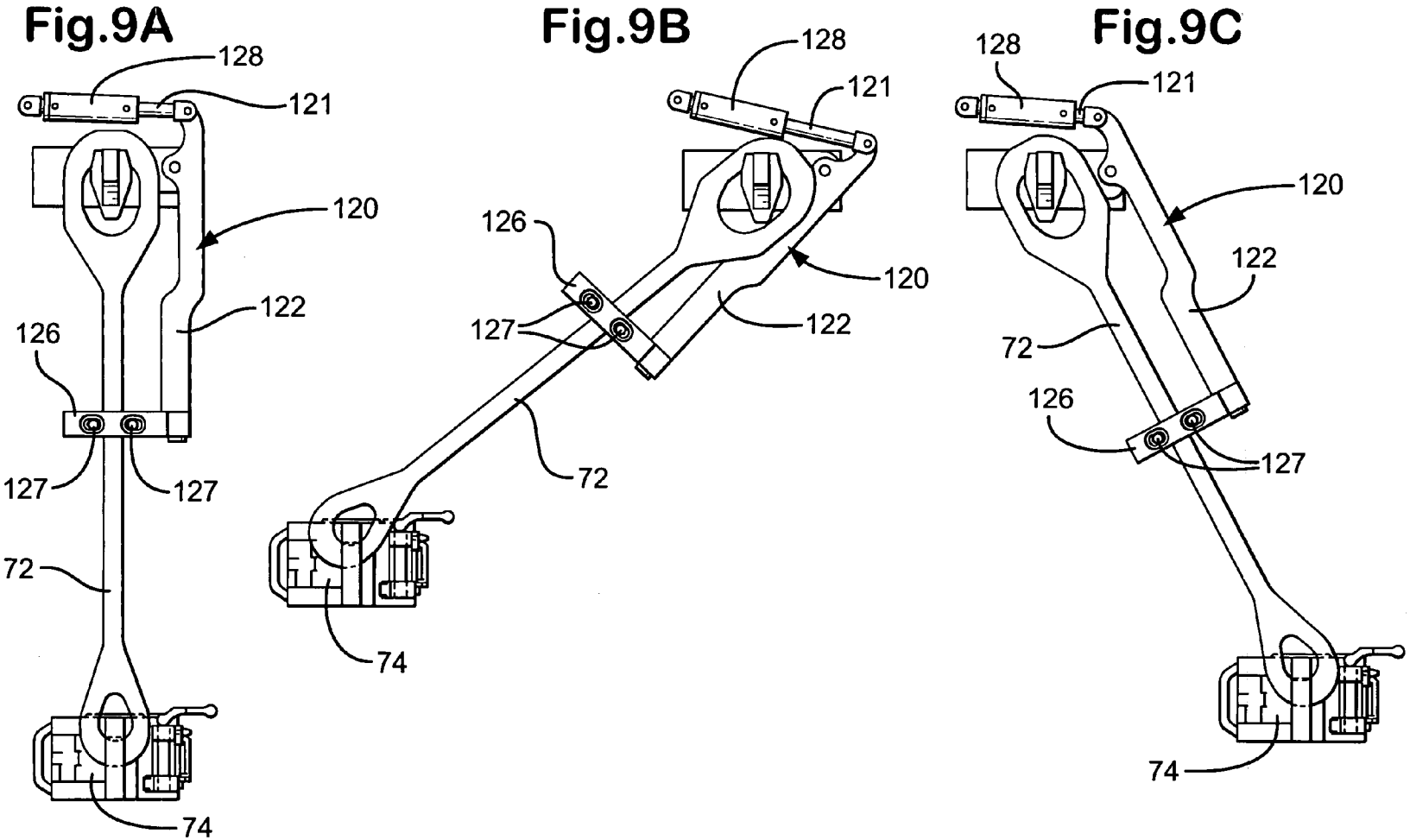
FIG. 9A is a side view of part of the system of FIG. 1A.
FIGS. 9B and 9C illustrate operation of the system as shown in FIG. 9A.

FIG. 9A shows the links 72 suspending the elevator 74 beneath the system 100. The link tilt system 120 is not actuated. As shown in FIG. 9B, the link tilt system 120 has been actuated with hydraulic fluid from the rotating head 230 applied to the piston/cylinder assemblies 128 to extend the piston 121 to move the links 72 and elevator 74 away from the system 100. As shown in FIG. 9C, the piston 121 has been retracted, resulting in the movement of the links 72 and elevator 74 in a direction opposite to the direction of movement shown in FIG. 9B. Roller pins 127 within the clamps 126 facilitate link movement with respect to the clamps 126. In one particular aspect such a bi-directional link tilt system can be tilted in one direction toward a V-door of a rig to more easily accept a stand of pipe from a monkey board, and in the other direction toward the rig, moving the elevator out of the way of a drill string and top drive, to permit drill down closer to a rig floor since the elevator is moved out of the way. In one particular aspect, the link tilt system 120 can move the links 72 and elevator 74 thirty degrees toward the V-door and, in the other direction, fifty degrees toward the mast.

FIGS. 11A-11D show a connection lock member 340. Corresponding connection lock member pairs (like the members 340) have corresponding teeth 341 that mesh to lock together: the quill 50 and the mud saver system 90; and the mud saver system 90 and the saver sub 290. Keys 395 on the quill 50, keys (not shown; like keys 395) on the mud saver system 90, and keys (not shown; like keys 395) on the saver sub 290 are received and held in corresponding keyways 344 of the connection lock members 340. The connection lock members 340 are secured with set screws 402 extending through holes 342. Clamps 401 clamp around the quill 50, the mud saver system 90, and the saver sub 290 (see FIG. 8A) to maintain the connection lock members in position with keys in their respective keyways. Use of the connection lock members 340 provides a positive releasable lock of the quill 50 to the mud saver system 90 and of the mud saver system 90 to the saver sub 290 so that the top drive cannot unscrew the mud saver system 90 from the quill 50 or the mud saver system 90 from the saver sub 290. Thus joints can be made and broken with the system 10 without the mud saver system 90 separating from the saver sub and without the quill 50 separating from the mud saver system 90.

Optionally, an integrated block becket apparatus 18 (see FIGS. 23A-23G; instead of a becket 16 as in FIG. 1A and instead of a travelling block/hook combination, e.g. as in FIG. 2G) is used in the system 10 which, in one particular embodiment, adds only 17 inches to the top drive system's height and which eliminates the need for a standard block/hook combination which can be over 9'high. Pin holes 303*a* in a becket 303 are alignable with pin holes 420*a* (four of them equally spaced apart in the block 420) in a block 420 to permit selective positioning of the becket 303 with respect to the block 420. This allows selective orientation which can, e.g. be beneficial in some smaller rigs with crown sheaves oriented differently from those in other rigs. With a block becket 18, the block 420 can be correctly oriented. It is within the scope of the present invention to use any desired number of becket and block pin holes to provide any desired number of positions. The becket 303 has ears 305, 307 with holes 305*a*, 307*a* respectively through which extend pins 309 to releasably connect to corresponding structure of a top drive system. Plates 311 bolted with bolts 313 to the becket 303 releasably hold the pins 309 in place. A shaft 422 of the block 420 is received on a channel 315 of the becket 303. Plates 424 bolted to the shaft 422 with bolts 426 and bolted to a bushing or retainer 428 with bolts 432 retain the becket 303 on the shaft 422. The channel 315 and the shaft 422 may be threaded for threaded connection of the block 420 and the becket 303. Typical lines or cables (not shown) are disposed around sheaves 434 which rotate around a shaft 436 of the block 420. The block becket 18 can be lifted and lowered using the eyes 442.

In one particular aspect, the height of a system 10 with a becket with the block becket 18 is about 19' from the becket throat down to a tool joint in an elevator using upper links which are about 96" long and a hook is used which may be, e.g. 10' long. Using an integrated block becket system according to the present invention this overall height is about 20'6".

Using the hollowbore permanent magnet motor 30, planetary gear system 20 and a standard swivel packing assembly mounted on top of the motor 30, a fluid course is provided through the entire top drive from the gooseneck 46 down to the saver sub 290 and then to a tubular or tubular stand connected to the saver sub 290. In certain aspects, this fluid course is rated at 5000 psi working pressure (e.g. a fluid course of about 3" in diameter from the wash pipe down to the saver sub). The swivel packing assembly (see FIGS. 16A, 16B) includes a standard wash pipe assembly 370 with a wash pipe 374, unitized packing 381, 385 and union-type nuts 371, 372 which allow the assembly to be removed as a unit.

FIGS. 12A-12C illustrate an optional crossover sub 350 with a body 351 which has interior threads 352 for selective releasable connection of the sub 350 to the lower end of the quill 50. Upper teeth 353 mesh with corresponding teeth of a connection lock member on the quill 50. Lower teeth 354 can mesh with teeth of a connection lock member on the mud saver system 90 located below a quill 50. These mesh teeth prevent unwanted disconnection. A smaller diameter threaded end 355 can threadedly mate with a correspondingly-threaded mud saver system.

FIG. 13 shows the bonnet 44 with its lower housing 361 which houses the brake system 40 and with an upper plate 362 with a hole 362*a* for the gooseneck 46. Hatches 363 provide access to the brake apparatuses 180 and permit their removal from within the bonnet 44.

A load nut 366 is shown in FIGS. 14A and 14B. As shown in FIG. 1F, the load nut 366 holds the load collar 70 on the load sleeve 170. The load collar 70 rotates on a bearing 367 housed within a recess 368 of the load nut 366. Threads 369 mate with threads 170*e* on the load sleeve 170 to secure the load nut 366 to the load sleeve 170.

The rotating head 80 shown in FIG. 1C and FIGS. 15A-15H at the bottom of the load sleeve 170 has an inner barrel 230 with a body 82 with an upper flange 83 and an outer barrel 372 with rotating ears 373 which are received in recesses 374 (see FIG. 8D) in the outer legs 285 of the system 100 to insure that the rotating head 80 rotates with the system 100. A recess 84 in the inner barrel 230 provides space for a stabilizing bearing 85 which stabilizes the bottom end of the quill 50. A bearing retainer 560 retains the bearing 85 in place. Bolts 561 (eight; one shown) bolt the inner barrel 230 to the load sleeve 170. A gap 562 (e.g. between 0.30 inches and 0.10 inches) between the inner barrel 230 and the load nut 366 prevents a load from being transmitted from the load nut to the inner barrel. Bolts 563 prevent the load nut 366 from rotating.

The inner barrel 230 has four ports 230*a*, 230*b*, 230*c*, 230*d* which correspond to and are aligned with the four channels 170*a* of the load sleeve 170 and fluid flows down through the channels 170*a* into the ports 230*a*-230*d*. Three of the channels 230*a* are in fluid communication with corresponding paths 372*a*, 372*b*, 372*c* of the outer barrel 372 and one of the channels 230*a*-1, a lubrication channel provides lubrication to items below the rotating head 80 (e.g. the lower quill stabilizing bearing 85). Four seals 372*s* isolate the paths 372*a-c*.

The location and function of the rotating head 80 (which rotates with items like the system 100 below the top drive gear and motor components which are rotated by the motors 190) makes it possible to have a lower hydraulic manifold 400 with flow-controlling directional valves which also rotates when the motors 190 rotate the system 100. By locating the generator 240 at this level, electrical power is provided for the directional valves by the generator 240.

Figure 16A:
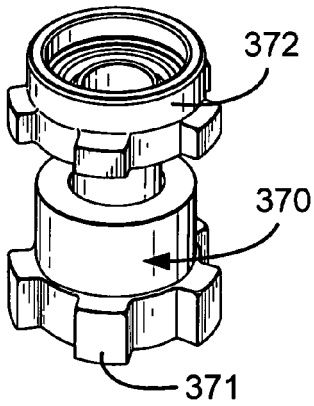
FIG. 16A is a perspective view of a washpipe assembly.
Figure 16B:
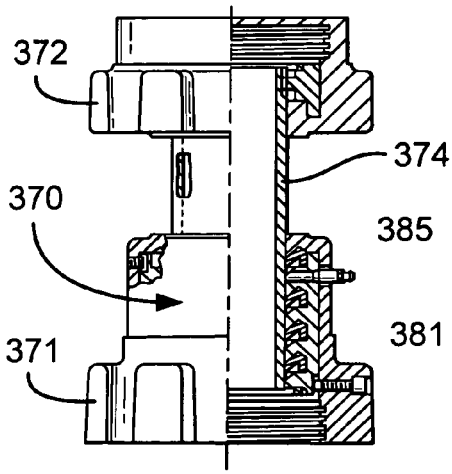
FIG. 16B is a side view, partially in cross-section, of the washpipe assembly of FIG. 16A.
Figure 15H:
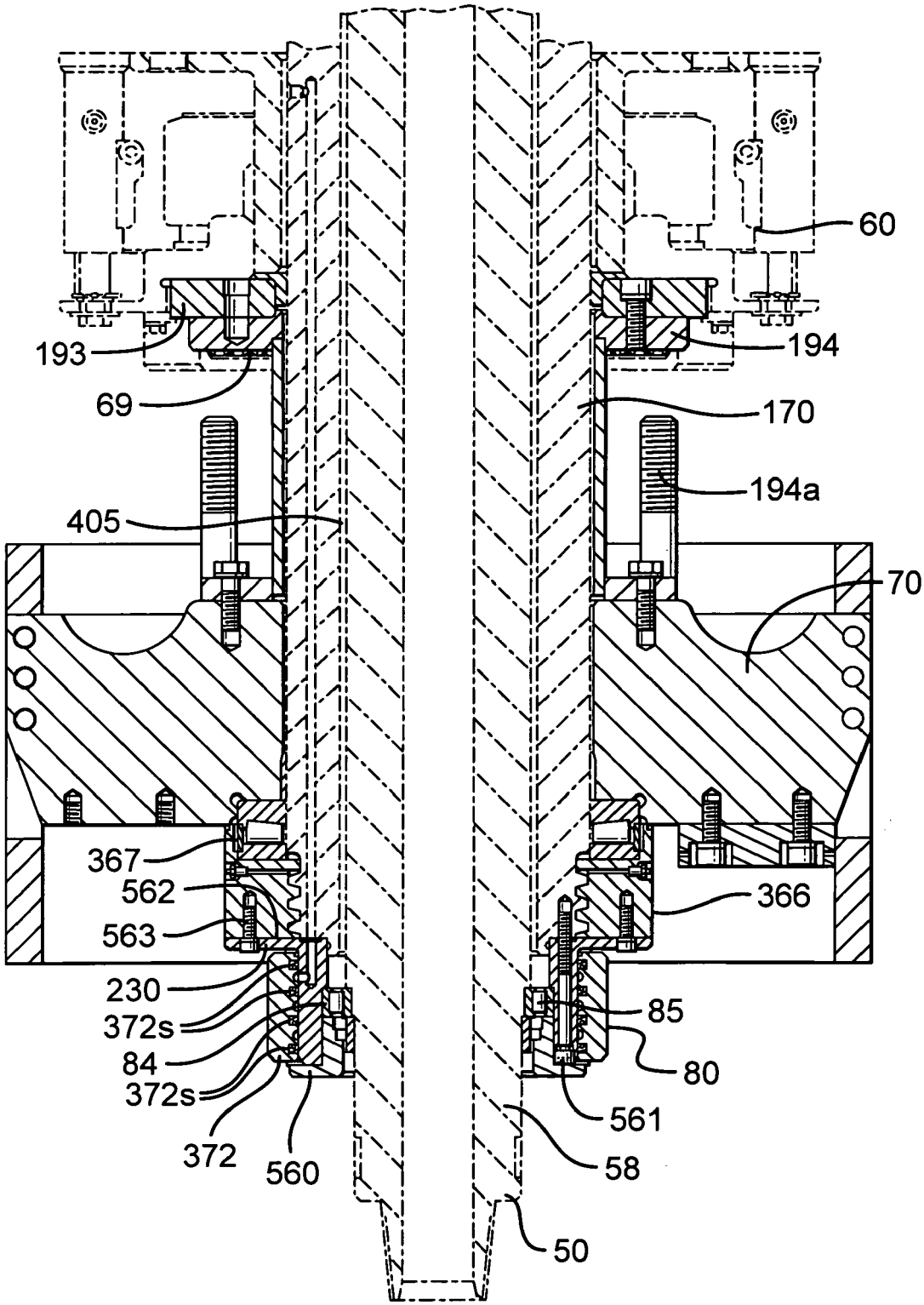
FIG. 15H is a side cross-section view of part of the system of FIG. 1A.

FIGS. 16A and 16B illustrate the wash pipe assembly 370. In use the nut 372 does not rotate and the gooseneck 46 is connected at its top so that fluid is flowable through the gooseneck 46 into a central fluid channel of the nut 372. The nut 371 has a female threaded end for threaded connection to the top of the quill 50. The nut 371 rotates with the quill 50 about the wash pipe 374.

Figure 17A:
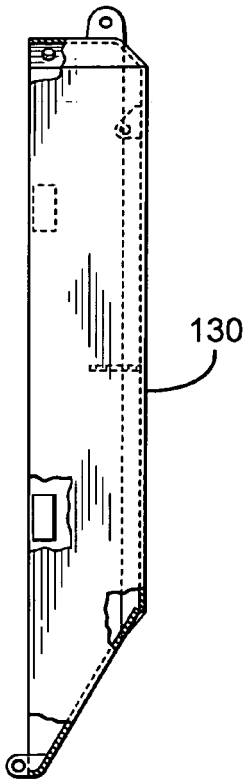
FIG. 17A is a side view of an access platform of the system of FIG. 1A.
Figure 17B:
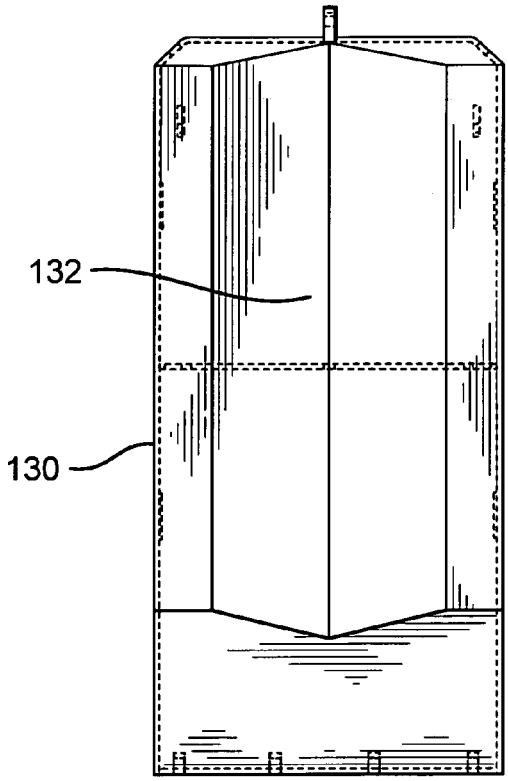
FIG. 17B is a front view.
Figure 17C:
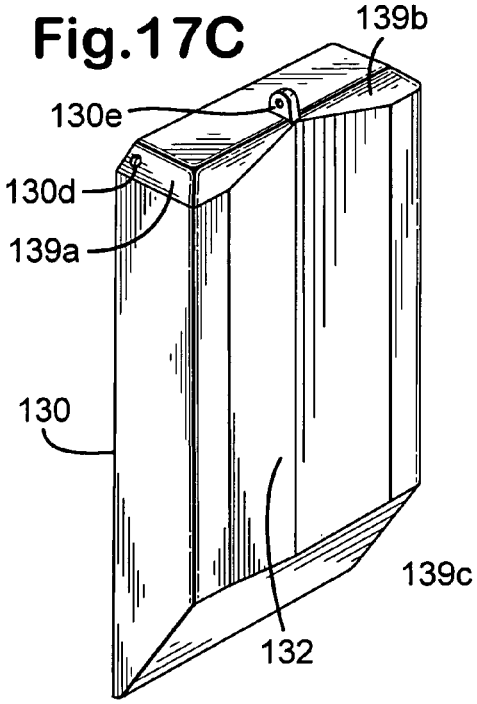
FIG. 17C is a front perspective view.
Figure 17D:
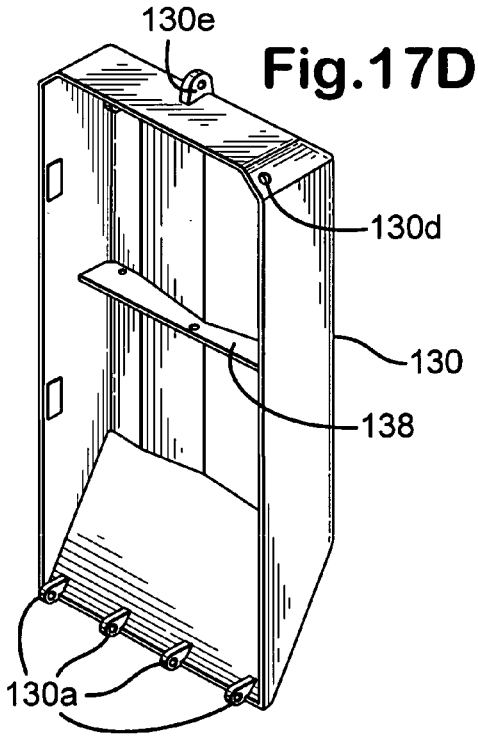
FIG. 17D is a rear perspective view.
Figure 17E:
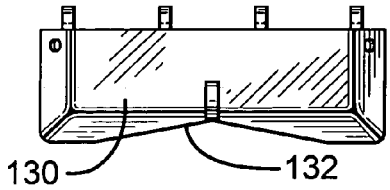
FIG. 17E is a bottom view.
Figure 17F:
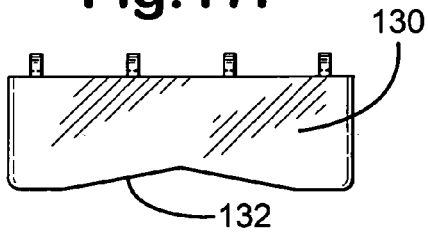
FIG. 17F is a top view of the access platform of FIG. 17A.
Figure 17H:
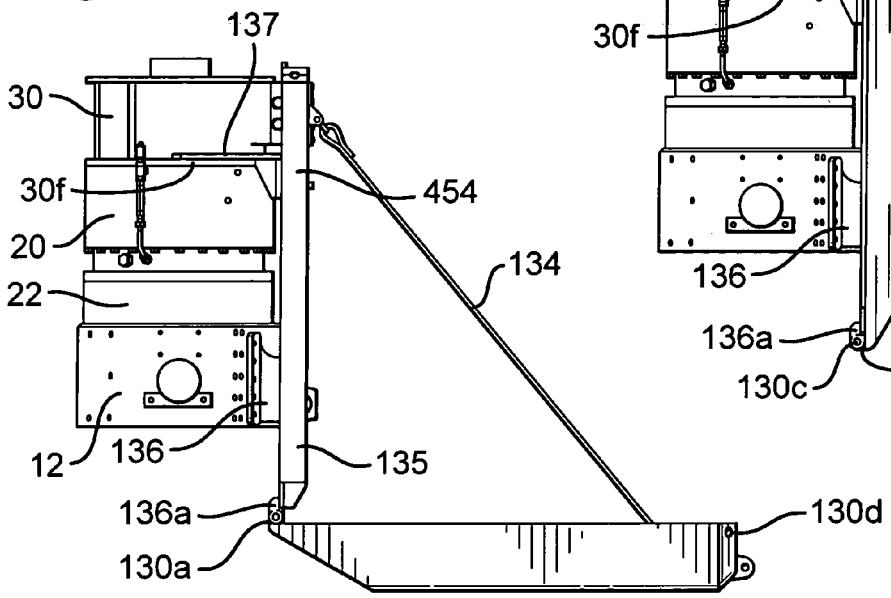
FIGS. 17G and 17H are side views of the access platform of FIG. 17A (and related structures).
Figure 17G:
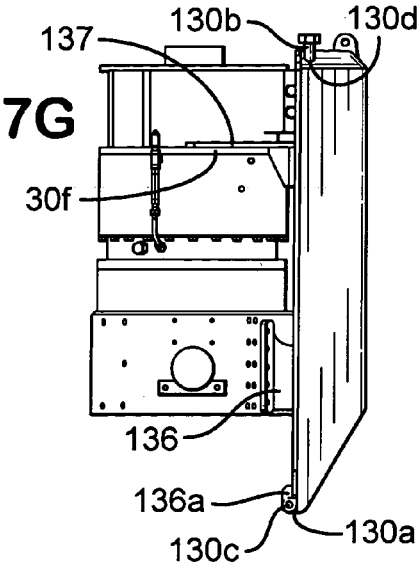
Figure 17I:
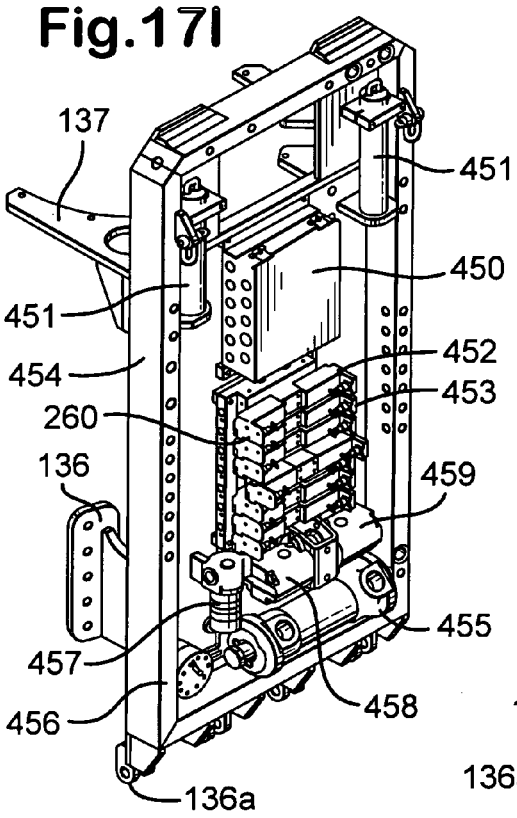
FIG. 17I is a front perspective view of a guard member adjacent the access platform of FIG. 17A.
Figure 17J:
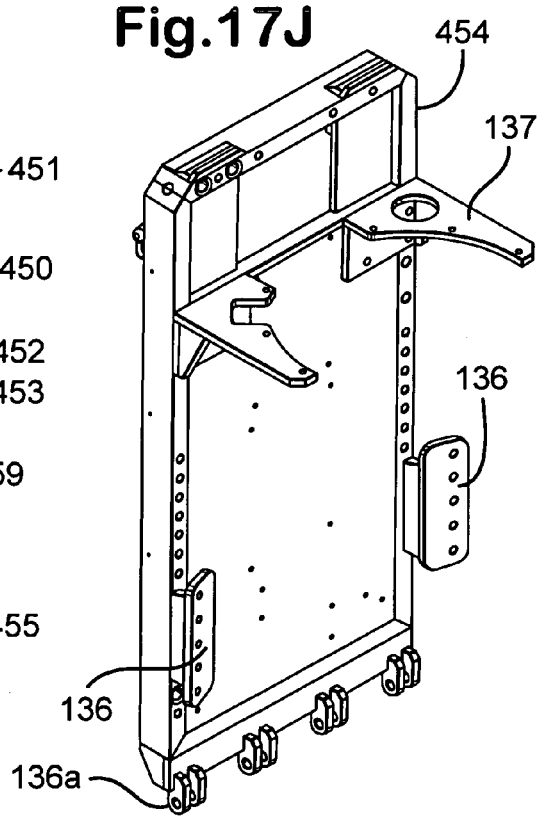
FIG. 17J is a rear perspective view of the member of FIG. 17I.
Figure 23A:
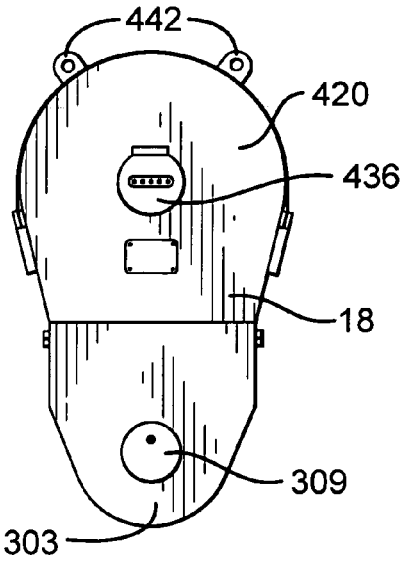
FIG. 23A is a side view of a block becket according to the present invention.
Figure 23B:
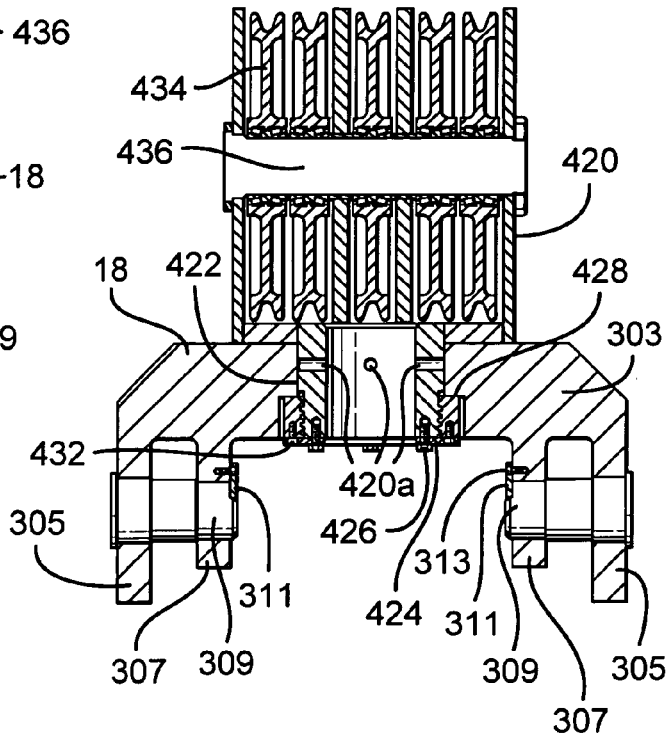
FIG. 23B is a cross-section view of the block becket of FIG. 23A.
Figure 23C:
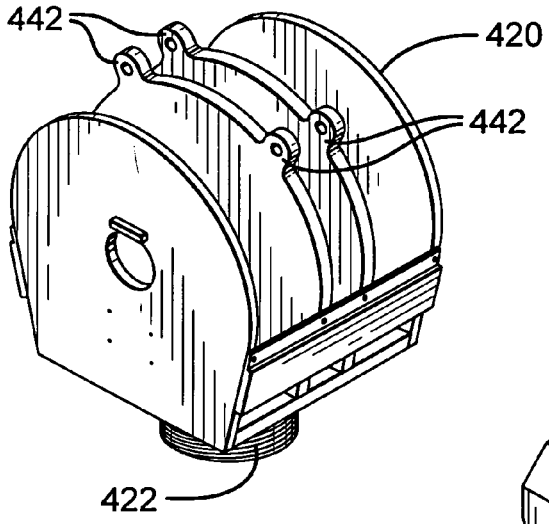
FIG. 23C is a perspective view of a block of the block becket of FIG. 23A.
Figure 23D:
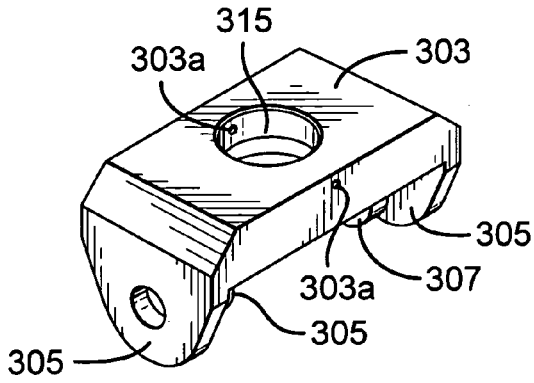
FIG. 23D is a perspective view of a becket part of the block becket of FIG. 23A.
Figure 23E:
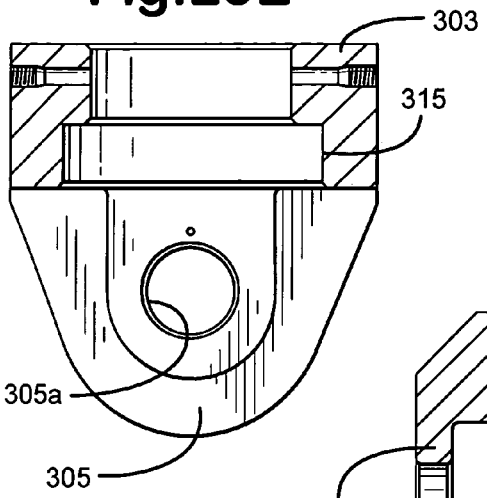
FIG. 23E is a side cross-section view of the becket part of FIG. 23D.
Figure 23F:
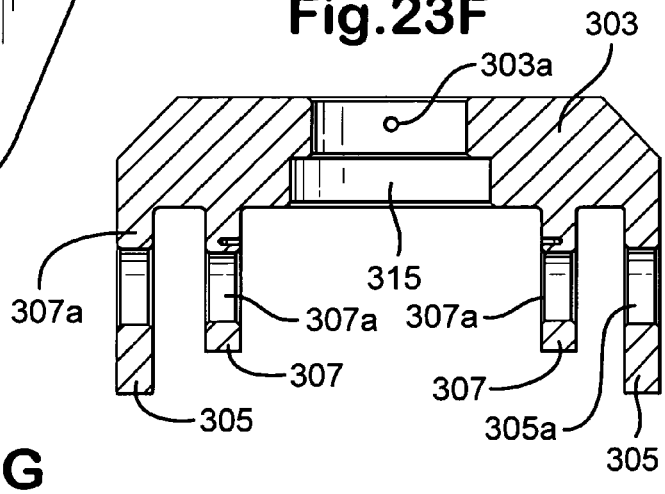
FIG. 23F is a front (or rear) cross-section view of the becket part of FIG. 23D.
Figure 23G:
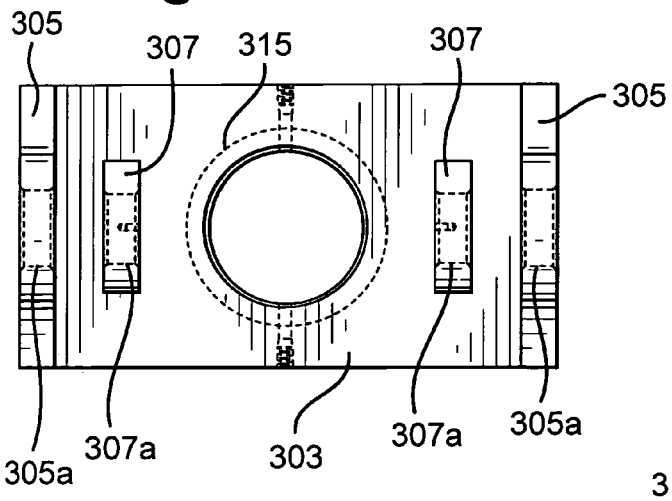
FIG. 23G is a bottom view of the becket part of FIG. 23D.
Figure 23H:
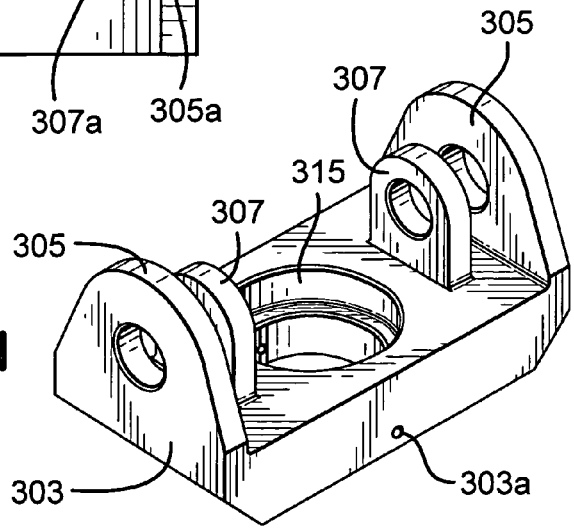
FIG. 23H is a bottom perspective view of the becket part of FIG. 23D.

FIGS. 17A-17H show the access platform 130 of the system 10 (see, e.g. also FIGS. 1A, 1B, 1D). Upon release, the access platform 130 is pivotable from a position as shown in FIG. 17G to a position as shown in FIG. 17H, supported by one or more cables 134. In the position of FIG. 17H, a person can stand on the access platform 130 to access the motor 30, and/or items connected to an inner guard member 135 (shown in FIGS. 17H, 17I), e.g. items including items on a rear guard 454 including a heat exchanger 455, pump 458, upper electric junction box 450, extend accumulators 451, filer 457 for hydraulic fluid, motor 459, pump 458, flow meter 456, upper hydraulic manifold 452 with electrically powered directional valves 453. Connectors 136 are bolted to the swivel body 12 and a stabilizer member 137 is connected to a motor flange 30*f*. Connectors 130*a* of the access platform 130 are hingedly connected to connectors 136*a* of the rear guard 454, e.g. with a pin or pins 130*c*. Bolts 130*b* through holes 130*d* releasably secure the access platform 130 to the top of the rear guard 454. An optional brace 138 extends across the interior of the access platform 130. Optionally, bevelled, tapered, rounded, or chamfered edges 139*a*, 139*b*, 139*c*, 139*d*, 139*e* are used and/or with a tapered bottom portion 139*d* to inhibit items catching onto part of the access platform 130. The access platform 130 can be lifted using an eye member 130*e*.

Figure 18A:
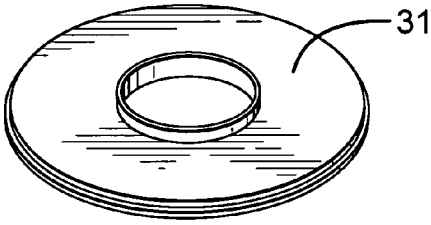
FIG. 18A is a perspective view of a motor dam for use with the motor of the system of FIG. 1A.
Figure 18B:
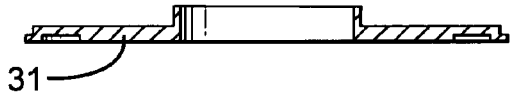
FIG. 18B is a cross-section view of the motor dam of FIG. 18A.

FIGS. 18A and 18B illustrate a motor dam 31 emplaced on the motor 30 to inhibit drilling mud or other fluid from getting into the motor 30.

Figure 19B:
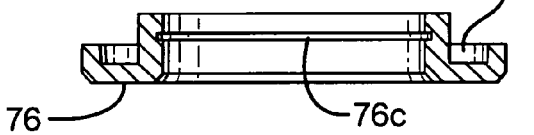
FIG. 19B is a cross-section view of the slinger of FIG. 19A.
Figure 19A:
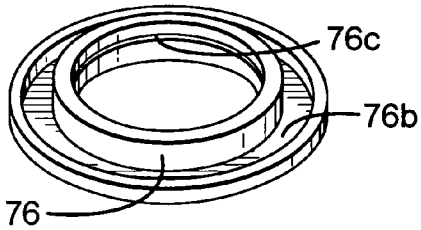
FIG. 19A is a perspective view of a slinger for use with the system of FIG. 1A.
Figure 20B:
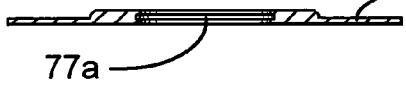
FIG. 20B is a cross-section view of the slinger of FIG. 20A.
Figure 20A:
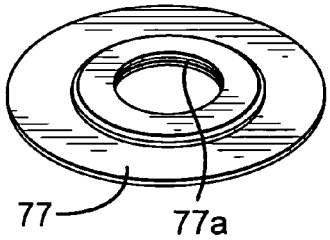
FIG. 20A is a perspective view of a slinger for use with the system of FIG. 1A.

Two slingers, slingers 76 and 77, inhibit fluid (e.g. drilling mud) from contacting the brake system 40, FIGS. 19A and 19B show an upper slinger 76 with a recess 76*b* for accommodating a lip of the bonnet 44 and a groove 76*c* for an O-ring seal to seal the slinger/quill interface. FIGS. 20A and 20B show a lower slinger 77 with an O-ring groove 77*a* for an O-ring seal to seal the slinger/quill interface. These slingers prevent drilling fluid from getting on the brake disc.

Figure 21:
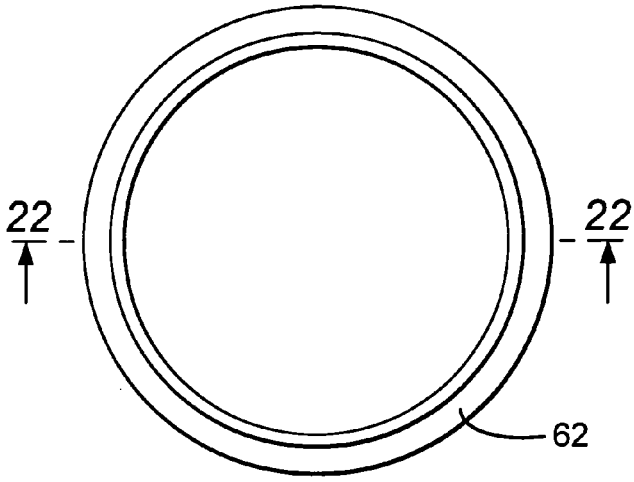
FIG. 21 is a top view of a wear guide for use with the system of FIG. 1A.
Figure 22:
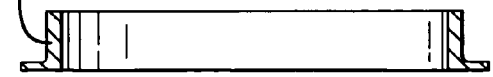
FIG. 22 is a cross-section view of the guide of FIG. 21.

FIGS. 21 and 22 show a wear sleeve locking guide 62. This wear sleeve lock guide acts as a bearing on which the rotate gear 193 rotates and also maintains a desired gap between the rotate gear 193 and the lock guide 62. In one aspect the guide 62 is made of phenolic material.

Figure 24A:
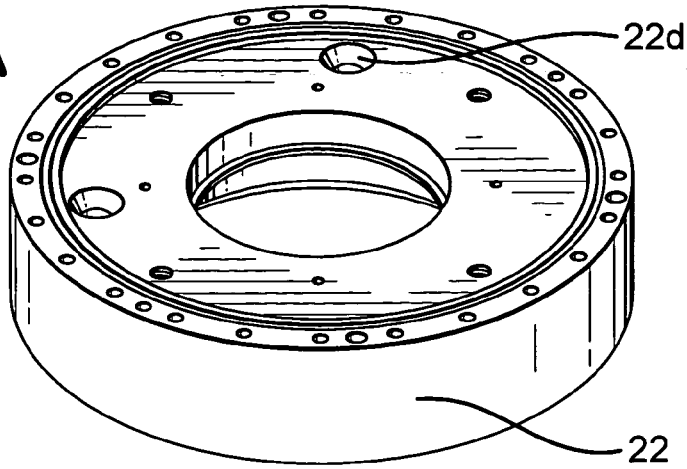
FIG. 24A is a perspective view of a spacer plate according to the present invention.
Figure 24B:
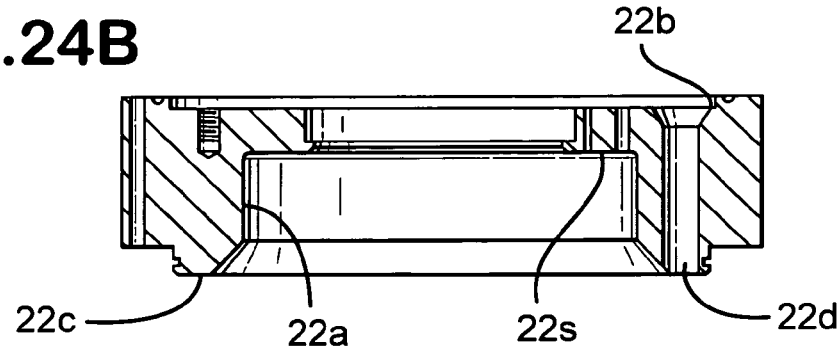
FIG. 24B is a cross-section view of the spacer plate of FIG. 24A.
Figure 25:
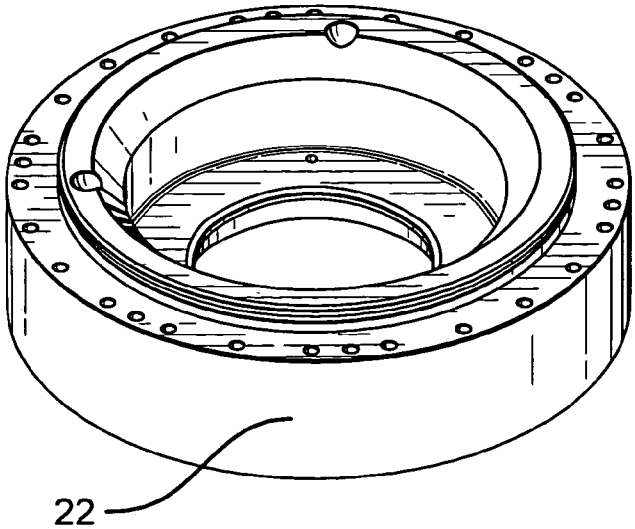
FIG. 25 is a bottom view of the spacer plate of FIG. 24A.
Figures 26A, 26B, 26C, 26D, 26E, 26F:
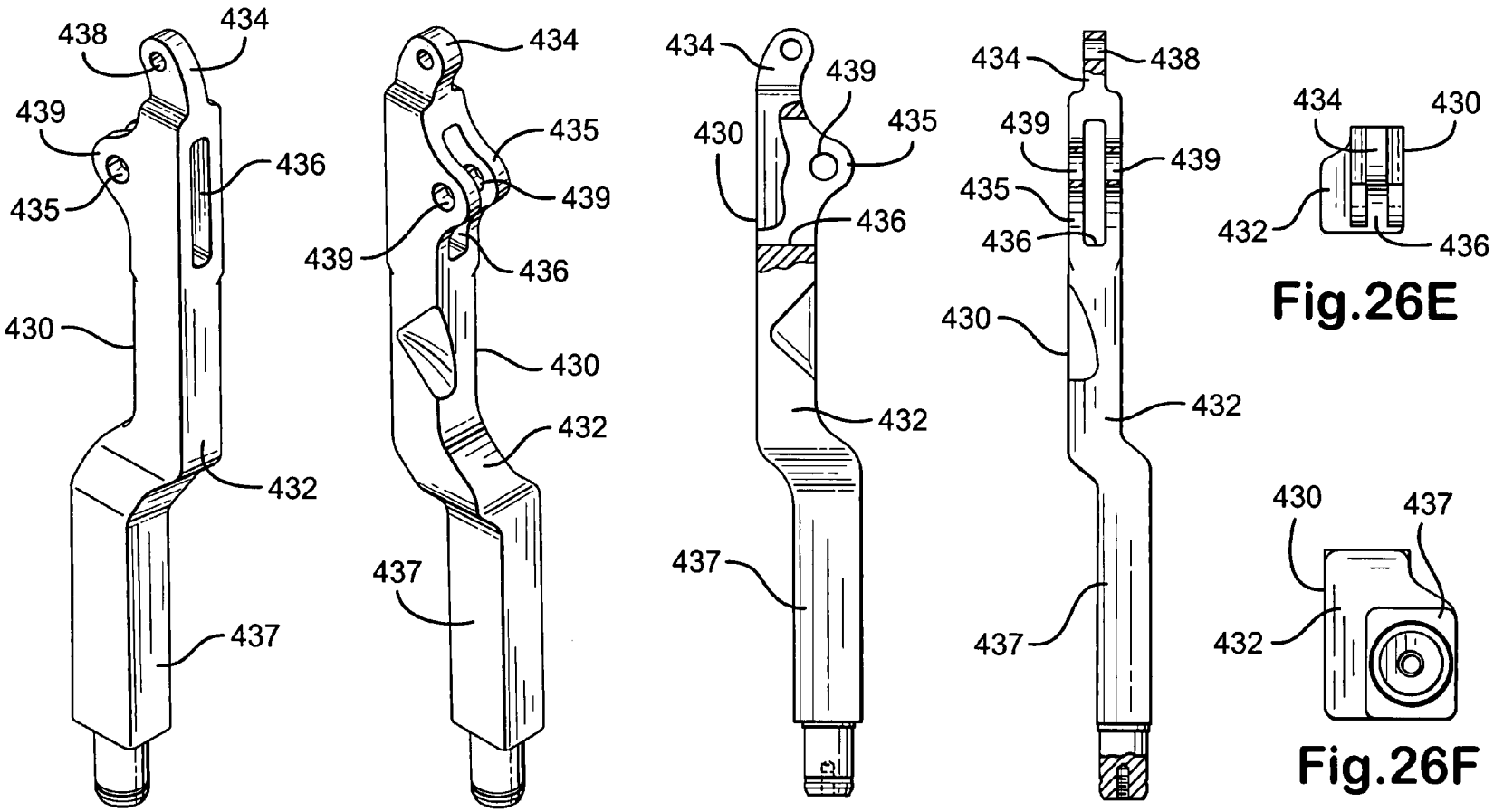
FIGS. 26A and 26B are perspective views of a link for use with a system as in FIG. 1A.
FIG. 26C is a side view and FIG. 26D is a front view of the link of FIG. 26A.
FIG. 26E is a top view and FIG. 26F is a bottom view of the link of FIG. 26A.

FIGS. 24A, 24B, and 25 show the spacer plate 22 with its recess 22*a* for receiving the bearing 59. The gear system 20 sits in a recess 22*b*. An extension 22*c* fits into the channel 12*c* in the swivel body 12. Through a hole 22*d* passes lubricating fluid coming from the gear system 20 which flows down into the swivel body 12 and then downward to lubricate items below the swivel body 12. From the swivel body 12 this lubricating fluid flows into the lubricating path of the load sleeve 170 and from there to the rotary seal 80, then to the lower stabilizer bearing 85. A shoulder 22*s* inhibits bearing deflection, e.g. while jarring, and makes it unnecessary to re-set bearing pre-load.

FIGS. 26A-26E show links 430 which is one form for the links 72. Each link 430 has a body member 432 with an upper connector 434 at the top and a lower connector 435. A slot 436 extends through the body member 432.

A lower portion 437 of the link 430 is disposed outwardly (e.g. to the right in FIG. 26C) from the link's upper part. A hole 438 permits connection to the link. Holes 439 permit connection to the load collar. This disposition of the lower portion 437 facilitates movement of the link with respect to system components adjacent this portion of the link.

Figures 27A, 27B, 27C, 27D, 27E, 27F:
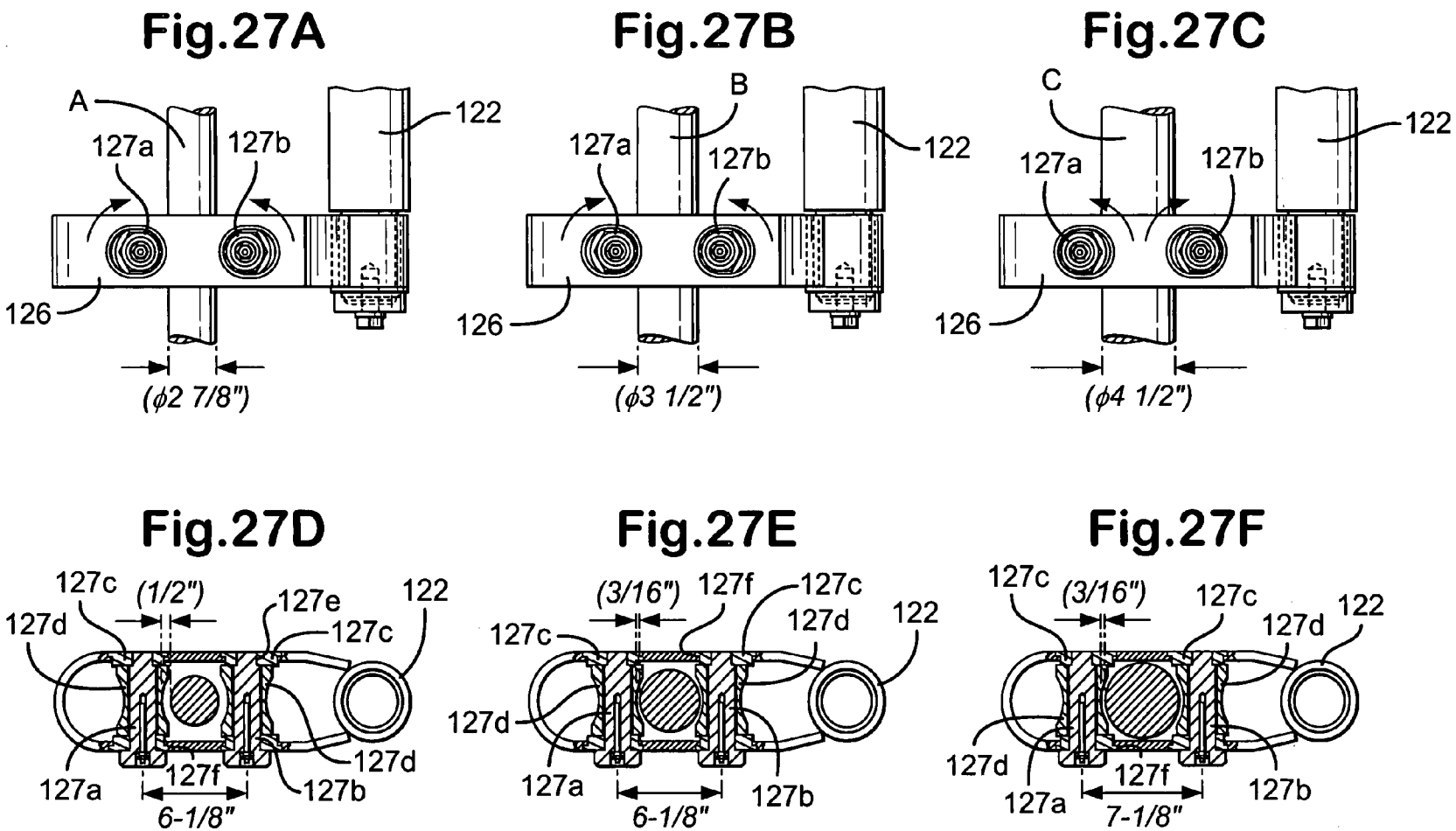
FIGS. 27A-27C are side views of part of the system of FIG. 1A.
FIGS. 27D-27F are top cross-section views of the parts of the system of FIG. 1A shown above each of the drawings FIGS. 27A-27C, respectively.

FIGS. 27A-27F illustrate how clamps 126 of the link tilt system 120 can accommodate links of different cross-sectional diameters. The clamps 126 have two roller pins 127*a*, 127*b* each with a roller 127*d* and roller mounts 127*c*. Holes 127*e* are offset in each roller mount 127*c* providing two positions for the rollers 127*d*. As shown in FIGS. 27A and 27D, a link A (like the link 72) moves between the rollers 127*d* and is, e.g. about 2⅞" wide. As shown in FIGS. 27B and 27E, with the rollers 127*d* in the same position as the rollers 127*d* in FIG. 27D, a link B (like the link 72) is accommodated, e.g. a link B with a width of 3.5". As shown in FIGS. 27C and 27F, the roller mounts 127*c* have been repositioned in holes 127*f*, moving the rollers 127*d* further apart so that the clamp can accommodate a wider link, e.g. the link C (like the link 72) which is 4.5" wide. A grease nipple 127*g* is provided for each pin 127*a*, 127*b*. Each pin 127*a*, 127*b* has a threaded end (a top end as viewed in FIG. 27D) which is threadedly engaged in corresponding threads in the roller mounts 127*c* (top roller mounts 127*c* as viewed in FIGS. 27D, 27E, 27F). Holes in the other roller mounts (lower ones as viewed in FIGS. 27D, 27E, 27F) may be unthreaded. In one aspect, links A are 250 ton links; links B are 350 ton links; and links C are 500 ton links.

Figure 3:
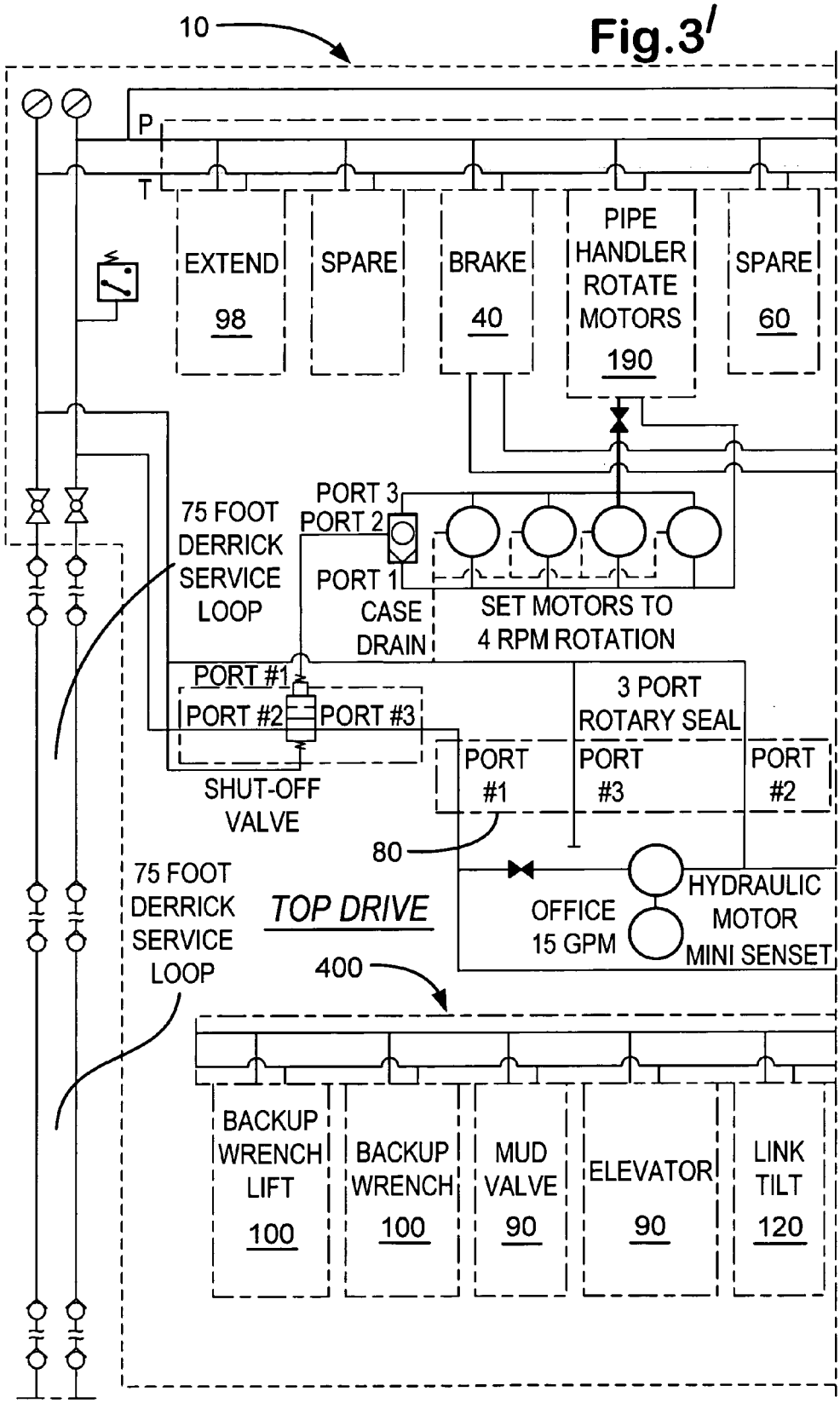
FIG. 3 is a schematic view of a control system according to the present invention for a top drive according to the present invention as, e.g., in FIG. 1A.

FIG. 3 shows schematically a control system 150 for a top drive 152 according to the present invention (e.g. like the top drive 10) with a building 160 according to the present invention adjacent a location of the top drive 152. The building 160 houses various circuits and controls, among other things, as discussed in detail below.

FIGS. 28A-28C and 28E show the building 160 on a skid 540 according to the present invention which has four walls 161*a-d*, a floor 161*e*, and a roof 161*f* (which in one aspect comprise a typical ISO container). A carrier 169 (see FIG. 28D) with a skid 169*a* with fork lift pockets 169*b* is mounted on top of the roof 161*f* for holding and storing of the service loop and/or of hoses. Doors 541 are at both ends of the building 160 and doors 541*a* and 541*b* (optionally vented with vents 541*f*) are on a side. Windows 541*c* are on a side and vent openings 541*d*, 541*e* are on another side. Pieces 82*b* of the beam 82 or ("torque track") are housed within compartments 162 in the wall 161*d*. A space 163 within the building 160 is sufficiently large to hold the major components of a top drive system like the system 10 FIG. 1A.

The building 160 also houses electrical power generator 530 (e.g. diesel powered); variable frequency drive system 531 for providing electrical power for the motor 30; a temperature/humidity control system 531*a* for controlling temperature and humidity of the system 531 and of a coolant system 532; an hydraulic fluid tank 533; an electrical junction box 534; an optional control system 535; pumps 536 and radiators 537 of the coolant system 532; and furniture and furnishings, e.g. item 538. An optional vacuum system 688 will remove drilling fluid from the system in the event of a shut-down so the fluid will not freeze in the lines.

In certain aspects the beam 82 serves as a "torque tube" through which torque generated by the top drive is reacted from the top drive, to the extension system 98, to the beam 82 and then to the derrick. In one particular aspect part 82*a* of this beam 82 is used as a skid or support on which the top drive is mounted to facilitate transport of the top drive; and this part 82*a* of the beam 82, with a skid portion 82*d*, is removably housed in the building 160 with the top drive in place on the beam 82. In one particular aspect (see FIG. 2F), a top piece 82*f* (FIG. 2D) of the beam 82 is length adjustable to accommodate different derrick conditions. In one aspect one, some or all of the pieces are length adjustable, e.g. two telescoping pieces 82*g*, 82*h* which can be pinned through one hole 82*j* and one hole 82*k* with a pin (or pins) 82*i* at a number of different lengths depending on the holes selected; and/or such pieces can be threadedly connected together with threads 82*m*, 82*n* for length adjustability. Pieces that make up the beam 82 may have holes or pockets 82*e* for receiving a fork of a fork lift.

Figure 2C:
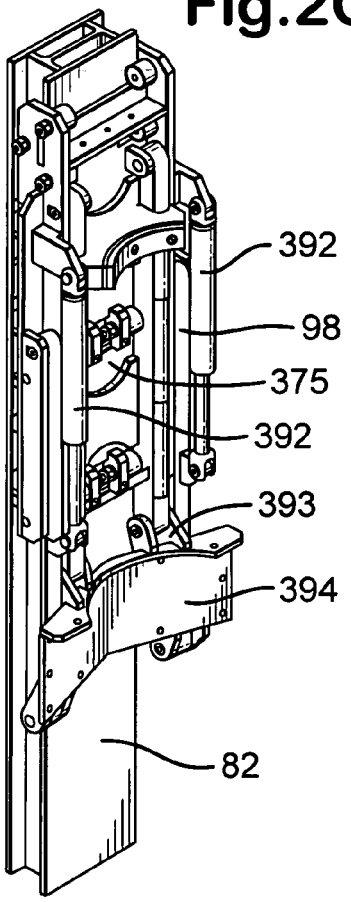
FIG. 2C is a perspective view of an extension system according to the present invention.
Figure 2D:
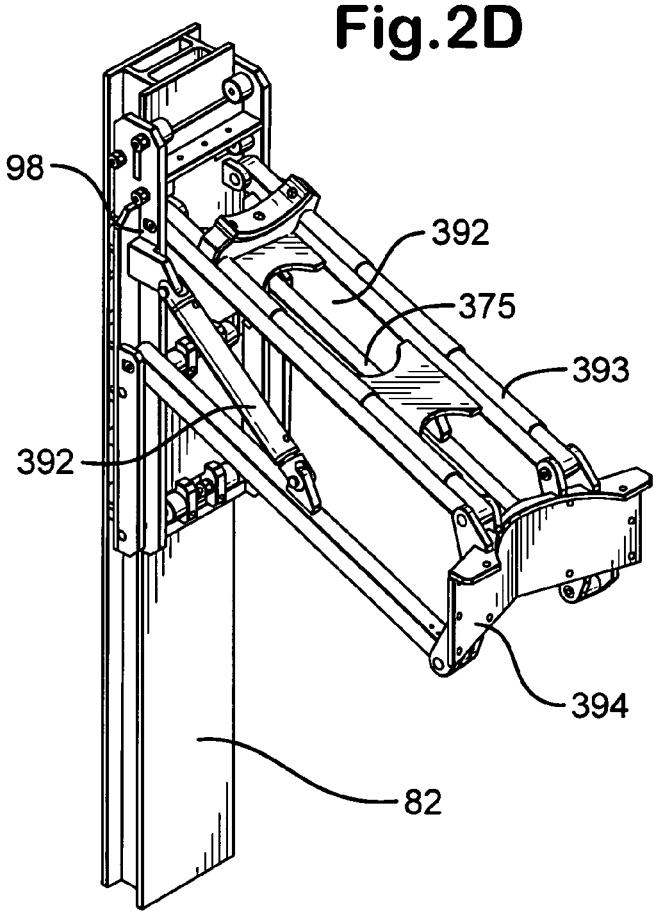
FIG. 2D shows the system of FIG. 2C extended.
Figure 2E:
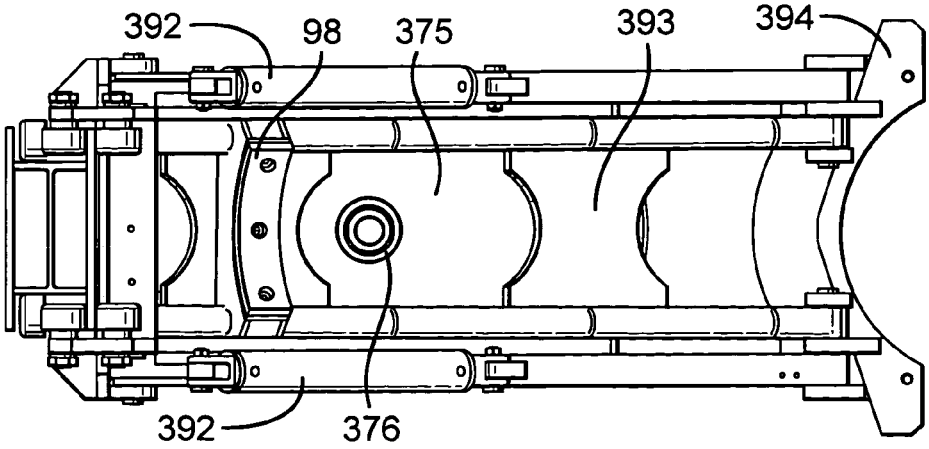
FIG. 2E is a top view of the system of FIG. 2C.

As shown in FIGS. 2C-2D, an opening 375 between members of the extension system 98 provides a passageway through which can pass a tubular stand 376 once a top drive supported by the extension system 98 is extended so that the top drive is no longer over the stand. This can be beneficial in a variety of circumstances, e.g., when pipe is stuck in the well or the top drive needs to be accessed, e.g. for inspection or repair. The saver sub is disconnected from the stand; the top drive is moved further outwardly so it is no longer directly over the stand; and the extension system 98 is lowered with the stand moving through the opening 375. This permits access to the top drive at a lower level, e.g. at or near the rig floor. The source of power for the cylinder assemblies 392 of the system 98 is the accumulators 451 (see FIG. 17D). The assemblies 392 are pivotably connected to support structure 393 with top drive mount 394 which is secured with bolts to the swivel body 12.

Control of the various system components is provided by a control system that includes: the driller's panel 141; a digital signal processor ("DSP") system 256*a* in the driller's panel 141; a DSP system 256*b* in the upper electrical junction box 450; a DSP system 256*c* in the lower electrical junction box 250; and/or a DSP system 256*d* with the control system 531. Each DSP system has an RF antenna so that all DSP systems can communicate with each other. Thus a driller at the driller's panel 141 and/or a person at the control system 531 can control all the functions of a top drive system 10.

Lubrication oil (hydraulic fluid) flows in the service loop 48 to the plugboard 391; into the upper hydraulic manifold 452 and heat exchanger on the rear guard 454, behind the access platform 130; through the filter 457 with flow metered by the flow meter 456; out to the gear system 20 (cleaned by the magnetic plugs 494) with level indicated in the sight glass 481; out the bottom of the gear system 20, lubing the splined portion 52 of the quill 50 and the upper bearing 59; into the swivel body 12 and out its drain 12*s*; into the load sleeve lubrication port and down a channel 170*a* of the load sleeve; into and through the rotating head 80 through the lubrication port of the inner barrel 230; to the lower quill stabilizing bearing 84; up through a space 405 between the load sleeve 170 and the quill 50 through the self cleaning main bearing 56; then back to an out line in the plugboard 391 and into an exit line in the service loop 48. Hydraulic fluid flows through the other three ports (other than the lube port/channels) in a similar fashion. Appropriate lines, hoses, cables, and conduits from the service loop 48 (including electrical lines etc. to the upper electrical junction box 450) are connected to the plugboard 391 and from it: control cables to the upper electrical junction box 450 and to an upper junction box (not shown) of the motor 30; hydraulic lines to the upper hydraulic manifold 452 and to the lubrication system; coolant fluid lines to the motor 459 and heat exchanger 455. Power cables from the service loop 48 are connected to the junction box of the motor 30.

Cables from the service loop 48 are connected to corresponding inlets on the plugboard 391; e.g., in one aspect, three hydraulic fluid power lines are used between the plug board 391 and the upper hydraulic manifold 452—an "in" fluid line, and "out" fluid line, and a spare line for use if there is a problem with either of the other two lines. Also in one aspect there are three lines from the plug board 391 to the motor 459. The motor 459 powered by hydraulic fluid under pressure, drives a pump 458 which pumps fluid to items below the rear guard 454. The fluid that is provided to the pump 458 is a coolant fluid (e.g. glycol and/or water; ethylene glycol) provided in one of the lines of the service loop 48. The pump 458 pumps the coolant fluid to and through the heat exchanger 455 and then, from the heat exchanger 455, the fluid is pumped to items below the access platform 130 for lubrication and for cooling. The fluid that flows through the motor 459 returns in a line back to the service loop 48 (e.g. back to a fluid reservoir, e.g. the fluid reservoir 533, FIG. 28D). Optionally, the fluid from the motor 459 can first go through the heat exchanger 455 then to the service loop 48. Appropriate lines with flow controlled by the directional control valves 260 provide hydraulic power fluid to each of the items powered thereby.

The present invention, therefore, provides in at least certain embodiments, a drive system with a permanent magnet motor with a first motor side, a second motor side, and a motor bore therethrough from the first motor side to the second motor side, the permanent magnet motor being a hollow bore alternating current permanent magnet motor; a planetary gear system coupled to the permanent magnet motor, the planetary gear system having a first gear side spaced-apart from the first motor side, a second gear side spaced-apart from the first gear side, and a gear system bore therethrough from the first gear side to the second gear side, the second motor side adjacent the first gear side; and the motor bore aligned with the gear system bore so that fluid is flowable through the drive system from the first motor side of the motor to the second gear side of the planetary gear system.

The present invention, therefore, provides in at least certain embodiments, a top drive system for wellbore operations, the top drive system with a permanent magnet motor with a top, a bottom, and a motor bore therethrough from the top to the bottom, the permanent magnet motor being a hollow bore alternating current permanent magnet motor; a planetary gear system coupled to the permanent magnet motor, the planetary gear system having a top, a bottom, and a gear system bore therethrough from top to bottom, the bottom of the permanent magnet motor adjacent the top of the planetary gear system; the motor bore aligned with the gear system bore so that fluid is flowable through the top drive system from the top of the motor to the bottom of the planetary gear system; and a quill drivingly connected to the planetary gear system and rotatable thereby to rotate a tubular member located below the quill, the quill having a top end and a bottom end, the quill, permanent magnet motor, and planetary gear system comprising a top drive. Such a system may have one or some (in any possible combination) of the following: a support system for supporting the permanent magnet motor and the planetary gear system, the support system with a swivel body below the planetary gear system, a suspension member above the permanent magnet motor, two spaced-apart links each with an upper end and a lower end, the swivel body having two spaced-apart holes, each one for receiving a lower end of one of the two supporting links, and each upper end of one of the two spaced-apart links connected to the suspension member; a spacer plate below and supporting the planetary gear system, the spacer plate having a bearing recess, and a bearing in the bearing recess for facilitating rotation of the quill; wherein each of the two spaced-apart holes for receiving a lower end of a link is non-circular in shape as viewed from above; wherein the suspension member includes a block becket apparatus according to the present invention, the block becket apparatus including a travelling block and a becket, the becket releasably and directly connected to the traveling block, the becket releasably connectible to the two spaced-apart links; wherein the becket is selectively securable to the travelling block in a plurality of positions; a counterbalance system for compensating for system weight during tubular stabbing to inhibit damage to tubulars, the counterbalance system with two load compensators, each load compensator connected at a first end to one of the two spaced-apart links and at a second end to the swivel body; the swivel body having a swivel body interior, a main bearing disposed within the swivel body interior, the quill having a quill flange, the quill flange resting on and movable over the main bearing; a load sleeve having a sleeve top and a sleeve bottom, the sleeve top connected to the swivel body, the sleeve bottom having a sleeve bottom portion, a load collar positioned around the load sleeve and supported by the sleeve bottom portion, two lower links, the two lower links supported by the load collar, elevator apparatus for selectively receiving and holding a tubular, the elevator apparatus supported by the two lower links; link tilt apparatus connected to the two lower links and to the load collar for tilting the two lower links away from a central line extending down through a center of the permanent magnet through a center of the planetary gear system, through a center of the quill, said centers aligned; a mud saver system releasably connected to the quill; a saver sub releasably connected to and below the mud saver system; a mud saver system releasably connected to the bottom end of the quill, a saver sub releasably connected to and below the mud saver system, the mud saver system having a central longitudinal axis from a top to a bottom thereof, and a mud saver bore therethrough from top to bottom, the saver sub having a central longitudinal axis from a top to a bottom thereof, and a saver sub bore therethrough from top to bottom, the quill having a central longitudinal axis and a quill bore therethrough from the top end to the bottom end, the central longitudinal axis of the mud saver system of the saver sub and of the quill aligned with the center line, and the quill bore in fluid communication with the mud saver bore and the mud saver bore in fluid communication with the saver sub bore so that drilling fluid is passable through the quill to the mud saver system, to the saver sub, and out from the saver sub; a clamping system connected to the load collar and movable up and down beneath and with respect to the load collar, the clamping system for selectively clamping an item, and the clamping system disposed between the two lower links; wherein the clamping system has a main body, two opposed clamping apparatuses in the main body, the two opposed clamping apparatuses spaced-apart for selective receipt therebetween of a member to be clamped therebetweeen, each of the two opposed clamping apparatuses having a mount and a piston movable within the mount, the piston selectively movable toward and away from a member to be clamped, two spaced-apart legs, each leg with an upper end and a lower end, each lower end connected to the main body, each leg comprising an outer leg portion and an inner leg portion, the inner leg portion having part thereof movable within the outer leg portion to provide a range of up/down movement for the main body; each mount having a liner channel for a liner, a liner in each mount for facilitating piston movement, each piston movable in said liner, and each liner removably disposed in a corresponding liner channel; wherein clamping system support apparatus connects the clamping system to the load collar and the top drive system includes electrical power generating apparatus connected to the clamping system support apparatus for providing electrical power to at least one apparatus located below the load collar; a lower hydraulic manifold connected to the clamping system support apparatus; a plurality of directional control valves on the lower hydraulic manifold for control hydraulic fluid flow in a plurality of corresponding flow lines; the plurality of corresponding flow lines including flow lines for providing hydraulic fluid to power apparatus below the clamping system; a selective locking mechanism secured to the swivel body for selectively locking the clamping system preventing its rotation while the quill is allowed to rotate; wherein the load sleeve has fluid conducting channels and the top drive system has a rotating head connected to the load sleeve for receiving fluid from the load sleeve's fluid conducting channels and for conveying said fluid to the lower hydraulic manifold, and the rotating head rotatable with the clamping system; an access platform pivotably connected at a lower end to the swivel body, the access platform with a platform portion pivotable to a generally horizontal position so that personnel on the access platform can access components of the top drive system; an extension system connected to the top drive for moving the top drive horizontally; wherein the extension system has an opening through which a tubular stand is movable while the extension system with the top drive connected thereto moves with respect to the tubular stand; first connection locking apparatus locks the quill to the mud saver system, and second connection locking apparatus locks the mud saver system to the saver sub; the two lower links are a first link and a second link, the link tilt apparatus including a clamp on each of the first link and the second link, each clamp having two roller pins between which a portion of the corresponding link is movable to facilitate movement of the links with respect to the clamps; and/or wherein each roller is mounted with mounting plates having offset holes for mounting the roller pins so that reversing the mounting plates changes the distance between the roller pins to accommodate links of different widths.

The present invention, therefore, provides in at least certain embodiments, a top drive system with a drive motor, a gear system coupled to the drive motor, a drive quill coupled to the gear system, a top drive support system for supporting the drive motor, the gear system, and the drive quill, a lower support apparatus connected to the top drive support system, tubular handling apparatus connected to and supported by the lower support apparatus, the tubular handling apparatus including hydraulic-fluid-powered apparatus, provision apparatus for providing hydraulic fluid to power the hydraulic-fluid-powered apparatus, the provision apparatus including flow line apparatus for providing hydraulic fluid to the hydraulic-fluid-powered apparatus and electrically-operable control apparatus for controlling fluid flow to and from the flow line apparatus, and electrical power generating apparatus connected to the tubular handling apparatus for providing electrical power to the electrically-operable control apparatus.

The present invention, therefore, provides in at least certain embodiments, an apparatus for releasably holding a member, the apparatus with a main body, two opposed clamping apparatuses in the main body, the two opposed clamping apparatuses spaced-apart for selective receipt therebetween of a member to be clamped therebetweeen, each of the two opposed clamping apparatuses having a mount and a piston movable within the mount, the piston selectively movable toward and away from a member to be clamped, two spaced-apart legs, each leg with an upper end and a lower end, each lower end connected to the main body, and each leg with an outer leg portion and an inner leg portion, the inner leg portion having part thereof movable within the outer leg portion to provide a range of up/down movement for the main body.

The present invention, therefore, provides in at least certain embodiments, a containerized top drive system with a container, top drive apparatus removably disposed within the container, an extension system for moving the top drive apparatus generally horizontally within a derrick, the top drive apparatus secured to the extension system, the extension system removably disposed within the container with the top drive apparatus, a track, the track comprised of multiple track parts connectible together, the track including at least one track part which is a skid track part, the skid track part with a skid portion and a track portion, the top drive apparatus and the extension system located on the at least one skid track part within the container and the top drive apparatus supported by and movable with the at least one skid track part, at least one first compartment for removably storing the multiple track parts, the multiple track parts removably located in the at least one first compartment, and the track assembleable outside the container to include the multiple track parts and the at least one skid track part so that the extension system is movable along the track with the top drive apparatus.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112.

What is claimed is:

1. A top drive system comprising a drive motor, a gear system coupled to the drive motor, a drive quill coupled to the gear system, a top drive support system for supporting the drive motor, the gear system, and the drive quill, a lower support apparatus connected to the top drive support system, tubular handling apparatus connected to and below and supported by the lower support apparatus, the tubular handling apparatus including hydraulic-fluid-powered apparatus, provision apparatus connected to the tubular handling apparatus for providing hydraulic fluid to power the hydraulic-fluid-powered apparatus, the provision apparatus including flow line apparatus for providing hydraulic fluid to the hydraulic-fluid-powered apparatus and electrically-operable control apparatus for controlling fluid flow to and from the flow line apparatus, electrical power generating apparatus connected to the tubular handling apparatus for providing electrical power to the electrically-operable control apparatus, the tubular handling apparatus including clamping apparatus for clamping an item, the clamping apparatus powered by hydraulic fluid from the provision apparatus, the clamping apparatus rotatable with respect to the lower support apparatus, the lower support apparatus including a locking mechanism for selectively locking the tubular handling apparatus in position, and the locking mechanism includes driving apparatus for rotating the clamping apparatus, the drive quill rotatable by the gear system with the clamping apparatus locked in position by the locking mechanism.

2. The top drive system of claim 1 wherein the electrically-operable control apparatus includes a plurality of selectively operable control valves which selectively control flow of hydraulic fluid to apparatuses below the lower support apparatus.

3. The top drive system of claim 2 wherein the apparatuses below the lower support apparatus include clamping apparatus for clamping a first item, elevator apparatus for supporting a second item, and link-tilt apparatus for moving the elevator apparatus at an angle to the lower support apparatus, and the provision apparatus providing hydraulic fluid to power the clamping apparatus and the link-tilt apparatus.

4. The top drive system of claim 3 wherein the clamping apparatus comprises a main body, two opposed clamping apparatuses in the main body, the two opposed clamping apparatuses spaced-apart for selective receipt therebetween of the first item to be clamped therebetween, each of the two opposed clamping apparatuses having a mount and piston apparatus movable within the mount, the piston apparatus selectively movable toward and away from the first item to be clamped, two legs, the legs spaced-apart and each leg with an upper end and a lower end, each lower end connected to the main body, and each leg comprising an outer leg portion and an inner leg portion, the inner leg portion having part thereof movable within the outer leg portion to provide a range of up and down movement for the main body.

5. The top drive system of claim 4 further comprising piston and cylinder assembly apparatus in each leg with a first part thereof connected to the upper end and a second part thereof connected to the lower end, each piston and cylinder assembly including as the first part a hollow cylinder with a vacuum therein and as the second part a rod extensible from and retractable within the hollow cylinder, and the piston and cylinder assemblies providing compensation for movement of the member clamped by the clamping apparatus, fluid to power the piston cylinder assemblies provided by the provision apparatus.

6. The top drive system of claim 4 further comprising the electrical power generating apparatus connected to one of the two legs for generating electrical power.

7. The top drive system of claim 6 further comprising an hydraulic fluid manifold connected to one of the two legs for receiving hydraulic fluid from an hydraulic fluid source and for providing hydraulic fluid to the generator apparatus to power the generator apparatus.

8. The top drive system of claim 7 wherein the hydraulic fluid manifold includes a plurality of hydraulic fluid conduits and a plurality of controllable valves for selectively controlling fluid flow in each hydraulic fluid conduit.

9. The top drive system of claim 4 further comprising generator apparatus connected to one of the two legs for generating electrical power, and controller apparatus on one of the two legs in communication with the controllable valves for controlling the controllable valves.

10. The top drive system of claim 4 further comprising each mount having a liner removably disposed therein, each piston movable within a corresponding liner.

11. The top drive system of claim 8 further comprising a rotating head connected to and between the two legs, the rotating head for receiving hydraulic fluid from a fluid supply and for providing said hydraulic fluid to power the generator.

12. The top drive system of claim 11 wherein the rotating head provides hydraulic fluid for the plurality of controllable valves.

13. The top drive system of claim 4 wherein the motor is a permanent magnet motor with a top, a bottom, and a motor bore therethrough from the top to the bottom, the permanent magnet motor comprising a hollow bore alternating current permanent magnet motor, the gear system is a planetary gear system coupled to the permanent magnet motor, the planetary gear system having a top, a bottom, and a gear system bore therethrough from top to bottom, the bottom of the permanent magnet motor adjacent the top of the planetary gear system, the motor bore aligned with the gear system bore so that fluid is flowable through the top drive system from the top of the motor to the bottom of the planetary gear system, and the drive quill is drivingly connected to the planetary gear system and rotatable thereby to rotate a tubular member located below the drive quill, the drive quill having a top end and a bottom end, the quill, permanent magnet motor, and planetary gear system comprising a top drive.

14. The top drive system of claim 13 further comprising a motor support system for supporting the permanent magnet motor and the planetary gear system, the motor support system comprising a swivel body below the planetary gear system, a suspension member above the permanent magnet motor, two spaced-apart links each with an upper end and a lower end, the swivel body having two spaced-apart holes, each one for receiving a lower end of one of the two supporting links, and each upper end of one of the two spaced-apart links connected to the suspension member.

15. The top drive system of claim 14 wherein the suspension member includes a block becket apparatus, the block becket apparatus including a travelling block and a becket, the becket releasably and directly connected to the traveling block, the becket releasably connectible to the two spaced-apart links.

16. The top drive system of claim 15 further comprising a load sleeve having a sleeve top and a sleeve bottom, the sleeve top connected to the swivel body, the sleeve bottom having a sleeve bottom portion, a load collar positioned around the load sleeve and supported by the sleeve bottom portion, two lower links, the two lower links supported by the load collar, elevator apparatus which is part of the tubular handling apparatus and is for selectively receiving and holding a tubular, the elevator apparatus supported by the two lower links, a clamping system which is part of the tubular handling apparatus and is connected to the load collar and movable up and down beneath and with respect to the load collar, the clamping system for selectively clamping an item, the clamping system disposed between the two lower links, wherein clamping system support apparatus connects the clamping system to the load collar, the electrical power generating apparatus for providing electrical power to at least one apparatus located below the load collar, wherein the load sleeve has fluid conducting channels, a rotating head connected to the load sleeve, a lower hydraulic manifold, the rotating head for receiving fluid from the load sleeve's fluid conducting channels and for conveying said fluid to the lower hydraulic manifold, and the rotating head rotatable with the clamping system.

17. The top drive system of claim 14 further comprising an access platform pivotably connected at a lower end to the swivel body, the access platform with a platform portion pivotable to a generally horizontal position so that personnel on the access platform can access components of the top drive system.

18. The top drive system of claim 14 further comprising an extension system connected to the top drive system for moving the top drive system horizontally, and wherein the extension system has an opening through which a tubular stand is movable while the extension system with the top drive system connected thereto moves with respect to the tubular stand.

19. A top drive system comprising a drive motor, a gear system coupled to the drive motor, a drive quill coupled to the gear system, a top drive support system for supporting the drive motor, the gear system, and the drive quill, a lower support apparatus connected to the top drive support system, tubular handling apparatus connected to and below and supported by the lower support apparatus, the tubular handling apparatus including hydraulic-fluid-powered apparatus, provision apparatus connected to the tubular handling apparatus for providing hydraulic fluid to power the hydraulic-fluid-powered apparatus, the provision apparatus including flow line apparatus for providing hydraulic fluid to the hydraulic-fluid-powered apparatus and electrically-operable control apparatus for controlling fluid flow to and from the flow line apparatus, electrical power generating apparatus connected to the tubular handling apparatus for providing electrical power to the electrically-operable control apparatus, wherein the electrically-operable control apparatus includes a plurality of selectively operable control valves which selectively control flow of hydraulic fluid to apparatuses below the lower support apparatus, the apparatuses below the lower support apparatus include clamping apparatus for clamping a first item, elevator apparatus for supporting a second item, and link-tilt apparatus for moving the elevator apparatus at an angle to the lower support apparatus, the provision apparatus providing hydraulic fluid to power the clamping apparatus and the link-tilt apparatus, and wherein the clamping apparatus comprises a main body, two opposed clamping apparatuses in the main body, the two opposed clamping apparatuses spaced-apart for selective receipt therebetween of the first item to be clamped therebetween, each of the two opposed clamping apparatuses having a mount and piston apparatus movable within the mount, the piston apparatus selectively movable toward and away from the first item to be clamped, two legs, the legs spaced-apart and each leg with an upper end and a lower end, each lower end connected to the main body, and each leg comprising an outer leg portion and an inner leg portion, the inner leg portion having part thereof movable within the outer leg portion to provide a range of up and down movement for the main body.

* * * * *